US009414160B2

(12) United States Patent
Van Schyndel et al.

(10) Patent No.: US 9,414,160 B2
(45) Date of Patent: Aug. 9, 2016

(54) METHOD, SYSTEM AND APPARATUS FOR LOUDSPEAKER EXCURSION DOMAIN PROCESSING

(71) Applicant: BLACKBERRY LIMITED, Waterloo (CA)

(72) Inventors: Andre John Van Schyndel, Kanata (CA); James David Gordy, Ottawa (CA); Brady Nicholas Laska, Arnprior (CA)

(73) Assignee: BLACKBERRY LIMITED, Waterloo, Ontario (CA)

( * ) Notice: Subject to any disclaimer, the term of this patent is extended or adjusted under 35 U.S.C. 154(b) by 53 days.

(21) Appl. No.: 14/555,632

(22) Filed: Nov. 27, 2014

(65) Prior Publication Data

US 2016/0157014 A1 Jun. 2, 2016

(51) Int. Cl.
*H04R 3/00* (2006.01)

(52) U.S. Cl.
CPC ..... *H04R 3/007* (2013.01); *H04R 2499/11* (2013.01)

(58) Field of Classification Search
None
See application file for complete search history.

(56) References Cited

U.S. PATENT DOCUMENTS 5,548,650 A 8/1996 Clark
2001/0031060 A1 10/2001 Carver
2002/0118841 A1* 8/2002 Button ..... H04R 3/00 381/55
2010/0290643 A1* 11/2010 Mihelich ..... H04S 7/301 381/99
2012/0237045 A1* 9/2012 Mihelich ..... H04R 3/002 381/59
2012/0281844 A1 11/2012 Luo
2013/0259245 A1 10/2013 Cheng et al.
2014/0254805 A1 9/2014 Su et al.

FOREIGN PATENT DOCUMENTS

EP 2355542 A1 8/2011
WO 2012009670 A2 1/2012

OTHER PUBLICATIONS

Extended European Search Report dated Apr. 29, 2016 for European Patent Application No. 15196178.6.

* cited by examiner

*Primary Examiner* — Muhammad N Edun
(74) *Attorney, Agent, or Firm* — Perry + Currier, Inc.

(57) ABSTRACT

A method, system and apparatus for loudspeaker excursion domain processing are provided. At a device comprising: a processor, a loudspeaker comprising a voice coil, one or more devices for determining loudspeaker voltage and current as a function of time, t, and a memory storing a Bl product for the loudspeaker, loudspeaker currents I(t) and corresponding voltages V(t) are received at the processor from the one or more devices. A current-from-voltage transfer function $H_{IV}(\omega)$ is derived from the loudspeaker currents I(t) and voltages V(t), as a function of frequency, ω. A Fourier space excursion-from-voltage transfer function $H_{XV}(\omega)$ is determined, whose form is constrained by parameters $H_{IV}(\omega)$, Bl, $R_{vc}$, and $L_{vc}$, where: $R_{vc}$ comprises a resistance of the voice coil; and $L_{vc}$ comprises an inductance of the voice coil. Filter coefficients are determined using $H_{XV}(\omega)$, which are used in a filter applied to an input signal for the loudspeaker.

22 Claims, 92 Drawing Sheets

METHOD, SYSTEM AND APPARATUS FOR LOUDSPEAKER EXCURSION DOMAIN PROCESSING

FIELD

The specification relates generally to loudspeakers, and specifically to a method, system and apparatus for loudspeaker excursion domain processing.

BACKGROUND

Loudspeaker manufacturers limit the voltage to their products to prevent damage (often additionally specifying a particular acoustic implementation). Such voltage limits are provided in order to limit the diaphragm excursion and the voice coil temperature of a loudspeaker. Products which use loudspeakers (for example mobile phones, smartphones and the like) generally do not "know" the excursion, or the temperature but rather, only the applied voltage. However, neither the excursion nor the temperature has simple relationships to the voltage so there are significant guard bands built in for tolerances. These tolerances exist for the parameters of the loudspeaker (e.g. sensitivity), its acoustic implementation (e.g. leaks in the back cavity) and its ambient temperature among other factors.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
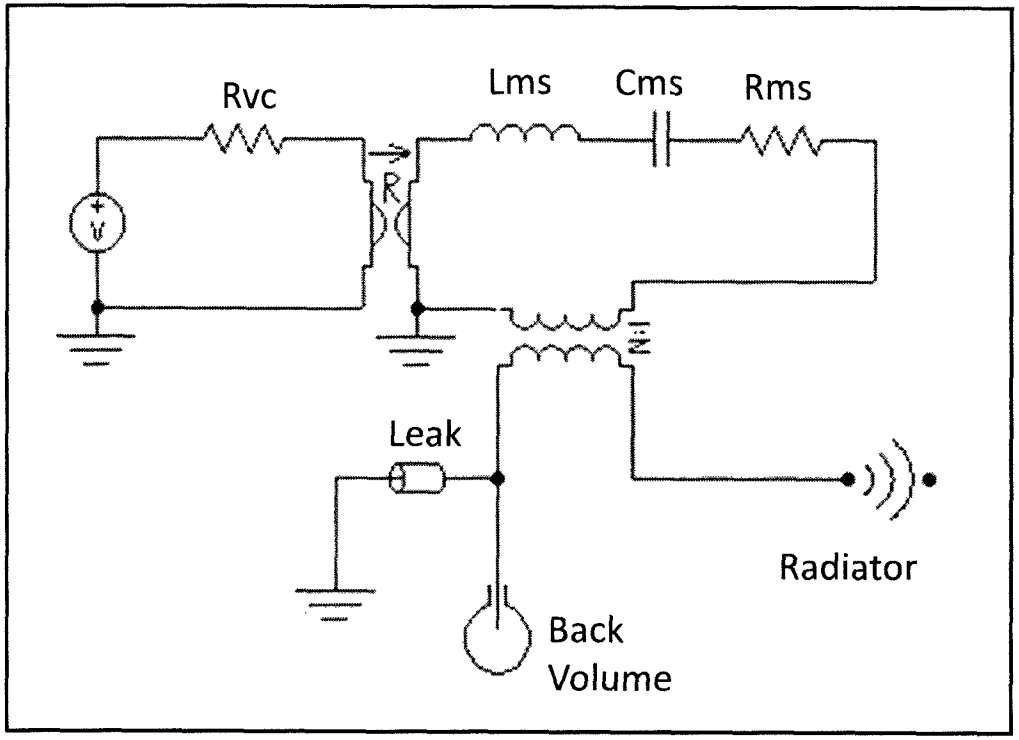
FIG. 1 depicts a generalized acoustic circuit of a loudspeaker, according to non-limiting implementations.

In general, this disclosure is directed to a system and/or device that measures excursion and the voice coil temperature, and places limits on a loudspeaker there from that generate more loudness without damage. Particular formulas and algorithms disclosed herein are used to generate a FIR (finite impulse response) filter which provides an indication of the voice coil excursion for a particular applied voltage. An excursion signal can be processed (e.g. compressed), translated back to a voltage and played through the loudspeaker which can result in a loudspeaker playing program material louder than systems which do not use the present FIR filter, the maximum coil excursions for each being otherwise similar.

In this specification, the term "loudspeaker", "speaker" and "microspeaker" will be used interchangeably, and while present implementations are described with respect to loudspeakers at a mobile device, present implementations can be applied to any device in which loudspeaker excursion is to be limited to avoid damage. Specifically, it is appreciated that the terms "loudspeaker" "speaker" and "microspeaker" each refer to hardware which is used to provide sound at a device by using a voltage representing sound data to drive a voice coil at the loudspeaker. Furthermore, while the present specification refers to a voice coil at a loudspeaker, it is appreciated that the term voice coil is used interchangeably with the terms speaker coil and loudspeaker voice coil, and that a voice coil is used to convert voltages to sound, including, but not limited to sound from voice data, music data, video data, and the like. In other words, while voice coils described herein can be used to produce sound that corresponds to the voice of a human, and the like, voice coils described herein are not to be limited to such implementations.

Reference will also be made herein to the term "program material" which can comprise sound data used to drive a loudspeaker including, but not limited to, voice data, music data, video data, and the like. In other words, "program material" as used herein can refer to sound data and/or sound files which can be processed to produce an input signal to a loudspeaker. In some instances, the term "program material", however, will be used colloquially and interchangeably with the terms input signal and output signal, signifying that the program material is used to produce an input signal to a loudspeaker and/or an output signal that drives the loudspeaker, the output signal comprising a filtered version of the input signal.

Furthermore, various equations are described herein and each are numbered as "(N)" and described thereafter as (N). This nomenclature will be used throughout the specification.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

It is understood that for the purpose of this specification, language of "at least one of X, Y, and Z" and "one or more of X, Y and Z" can be construed as X only, Y only, Z only, or any combination of two or more items X, Y, and Z (e.g., XYZ, XY, YZ, ZZ, and the like). Similar logic can be applied for two or more items in any occurrence of "at least one . . . " and "one or more . . . " language.

An aspect of the present specification provides a device comprising: a processor, a loudspeaker comprising a voice coil, one or more devices configured to determine loudspeaker voltage and loudspeaker current, and a memory storing a Bl product for the loudspeaker, the processor configured to: receive a plurality of loudspeaker currents I(t) and a corresponding plurality of loudspeaker voltages V(t) from the one or more devices as a function of time, t; derive a current-from-voltage transfer function $H_{IV}(\omega)$ from the plurality of loudspeaker currents I(t) and the corresponding plurality of loudspeaker voltages V(t), as a function of frequency, ω; determine a Fourier space excursion-from-voltage transfer function $H_{XV}(\omega)$, whose form is constrained by parameters $H_{IV}(\omega)$, Bl, $R_{vc}$, and $L_{vc}$, where: $R_{vc}$ comprises a resistance of the voice coil; and $L_{vc}$ comprises an inductance of the voice coil; determine filter coefficients using the Fourier space excursion-from-voltage transfer function, $H_{XV}(\omega)$; and, apply a filter to an input signal for the loudspeaker using the filter coefficients.

The Fourier space excursion-from-voltage transfer function $H_{XV}(\omega)$ can be determined using:

$$H_{XV}(\omega) = \frac{1}{Bl}\left[\frac{1 - H_{IV}(\omega)R_{vc}}{j\omega} - L_{vc}H_{IV}(\omega)\right],$$

where: j denotes a square root of −1.

The processor can be further configured to determine the resistance, $R_{vc}$, of the voice coil from one or more of: a value of the resistance, $R_{vc}$, stored in the memory; determining the resistance, $R_{vc}$, by adding a tone to the input signal at a frequency where impedance of the voice coil is about a DC (direct current) electrical resistance of the voice coil; and filtering the tone out of a voltage sense signal and a current sense signal and taking the quotient.

The processor can be further configured to determine the inductance, $L_{vc}$, of the voice coil from one or more of: a value of the inductance, $L_{vc}$, stored in the memory; determining the inductance, $L_{vc}$, by adding a tone to the input signal at a frequency where impedance of the voice coil is about a sum of electrical impedance of voice coil inductance and voice coil resistance; and filtering the tone out of a voltage sense signal and a current sense signal the deriving the inductance, $L_{vc}$, using a given value of the resistance, $R_{vc}$.

The processor can be further configured to determine the Fourier space excursion-from-voltage transfer function $H_{XV}(\omega)$ one or more of continuously and periodically, and update the filter accordingly.

The processor can be further configured to place limits on a filtered input signal, the limits based on a maximum excursion of the voice coil, the limits placed on the filter in an excursion domain.

The processor can be further configured to: determine an inverse of the Fourier space excursion-from-voltage transfer function, $H_{XV}(\omega)$; determine inverse filter coefficients using the inverse of the Fourier space excursion-from-voltage transfer function, $H_{XV}(\omega)$; and, convert a filtered input signal to an output signal using a voltage-from-excursion transfer function filter, derived from the inverse filter coefficients, to drive the voice coil.

The processor can be further configured to: derive a scaling factor for a portion of the input signal from a ratio of a pre-filter excursion of the input signal prior to applying the filter, and a post-filter excursion after applying the filter; and, apply the scaling factor to the portion of the input signal to produce a portion of an output signal driving the voice coil. The portion of the input signal can comprise a given time period of the input signal, and the processor can be further configured to derive respective scaling factors for each of a plurality of given time periods and apply the respective scaling factors to the input signal for each of the plurality of the given time periods.

The processor can be further configured to apply an equalization filter to a filtered input signal, prior to placing limits on the filtered input signal, by one or more of: flattening the filtered input signal; and equalizing one or more of peaks and trends in the filtered input signal.

The processor can be further configured to apply a thermal compensation filter to an output signal used to drive the voice coil by: determining whether a temperature of the voice coil will rise above a given maximum allowed temperature, $T_{max}$, of the voice coil stored in the memory based on determining whether: $T+\tau_{attack}dT/dt>T_{max}$ where T comprises a current temperature of the voice coil, $\tau_{attack}$ comprises a given compressor time constant, and dT/dt comprises a time derivative of the temperature; when $T+\tau_{attack}$ is greater than $T_{max}$, exponentially reducing a thermal compression gain, $g_T$, from a current value, the thermal compression gain, $g_T$, comprising a number between 0 and 1, inclusive; and, when $T+\tau_{attack}$ is not greater than $T_{max}$, exponentially increasing the thermal compression gain, $g_T$, from the current value, using a given time constant $\tau_{decay}$. The processor can be further configured to determine the temperature of the voice coil by measuring voice coil resistance.

Another aspect of the present specification provides a method comprising: receiving, at a processor of a device, a plurality of loudspeaker currents I(t) and a corresponding plurality of loudspeaker voltages V(t) from one or more devices configured to determine loudspeaker voltage and loudspeaker current as a function of time, t, the device comprising: the processor, a loudspeaker comprising a voice coil, the one or more devices, and a memory storing a Bl product for the loudspeaker; deriving, at the processor, a current-from-voltage transfer function $H_{IV}(\omega)$ from the plurality of loudspeaker currents I(t) and the corresponding plurality of loudspeaker voltages V(t), as a function of frequency, ω; determining, at the processor, a Fourier space excursion-from-voltage transfer function $H_{XV}(\omega)$, whose form is constrained by parameters $H_{IV}(\omega)$, Bl, $R_{vc}$, and $L_{vc}$, where: $R_{vc}$ comprises a resistance of the voice coil; and $L_{vc}$ comprises an inductance of the voice coil; determining, at the processor, filter coefficients using the Fourier space excursion-from-voltage transfer function, $H_{XV}(\omega)$; and, applying, at the processor, a filter to an input signal for the loudspeaker using the filter coefficients.

The Fourier space excursion-from-voltage transfer function $H_{XV}(\omega)$ can be determined using:

$$H_{XV}(\omega) = \frac{1}{Bl}\left[\frac{1 - H_{IV}(\omega)R_{vc}}{j\omega} - L_{vc}H_{IV}(\omega)\right],$$

where: j denotes a square root of −1.

The method can further comprise determining the Fourier space excursion-from-voltage transfer function $H_{XV}(\omega)$ one or more of continuously and periodically, and update the filter accordingly.

The method can further comprise determining the resistance, $R_{vc}$, of the voice coil from one or more of: from one or more of: a value of the resistance, $R_{vc}$, stored in the memory; determining the resistance, $R_{vc}$, by adding a tone to the input signal of a frequency where the impedance of the voice coil is about a DC (direct current) electrical resistance of the voice coil; and filtering the tone out of a voltage sense signal and a current sense signal and taking the quotient.

The method can further comprise determining the inductance, $L_{vc}$, of the voice coil from one or more of: value of the inductance, $L_{vc}$, stored in the memory; determining the inductance, $L_{vc}$, by adding a tone to the input signal at a frequency where impedance of the voice coil is about a sum of electrical impedance of voice coil inductance and voice coil resistance; and filtering the tone out of a voltage sense signal and a current sense signal the deriving the inductance, $L_{vc}$, using a given value of the resistance, $R_{vc}$.

The method can further comprise placing limits on a filtered input signal, the limits based on a maximum excursion of the voice coil, the limits placed on the filter in an excursion domain.

The method can further comprise: determining an inverse of the Fourier space excursion-from-voltage transfer function, $H_{XV}(\omega)$; determining inverse filter coefficients using the inverse of the Fourier space excursion-from-voltage transfer function, $H_{XV}(\omega)$; and, converting a filtered input signal to an output signal using a voltage-from-excursion transfer function filter, derived from the inverse filter coefficients, to drive the voice coil.

The method can further comprise: deriving a scaling factor for a portion of the input signal from a ratio of a pre-filter excursion of the input signal prior to applying the filter, and a post-filter excursion after applying the filter; and, applying the scaling factor to the portion of the input signal to produce a portion of an output signal driving the voice coil. The portion of the input signal can comprise a given time period of the input signal, and the method further can comprise deriving respective scaling factors for each of a plurality of given time periods and apply the respective scaling factors to the input signal for each of the plurality of the given time periods.

The method can further comprise applying an equalization filter to a filtered input signal, prior to placing limits on the filtered input signal, by one or more of: flattening the filtered input signal; and equalizing one or more of peaks and trends in the filtered input signal.

The method can further comprise applying a thermal compensation filter to an output signal used to drive the voice coil by: determining whether a temperature of the voice coil will rise above a given maximum allowed temperature, $T_{max}$, of the voice coil stored in the memory based on determining whether: $T+\tau_{attack}dT/dt>T_{max}$, where T comprises a current temperature of the voice coil, $\tau_{attack}$ comprises a given compressor time constant, and dT/dt comprises a time derivative of the temperature; when $T+\tau_{attack}$ is greater than $T_{max}$, exponentially reducing a thermal compression gain, $g_T$, from a current value, the thermal compression gain, $g_T$, comprising a number between 0 and 1, inclusive; and, when $T+\tau_{attack}$ is not greater than $T_{max}$, exponentially increasing the attack thermal compression gain, $g_T$, from the current value, using a given time constant $\tau_{decay}$. The method can further comprise determining the temperature of the voice coil by measuring voice coil resistance.

Another aspect of the present specification provides a computer program product, comprising a computer usable medium having a computer readable program code adapted to be executed to implement a method comprising: receiving, at a processor of a device, a plurality of loudspeaker currents I(t)

and a corresponding plurality of loudspeaker voltages V(t) from one or more devices configured to determine loudspeaker voltage and loudspeaker current as a function of time, t, the device comprising: the processor, a loudspeaker comprising a voice coil, the one or more devices, and a memory storing a Bl product for the loudspeaker; deriving, at the processor, a current-from-voltage transfer function $H_{IV}(\omega)$ from the plurality of loudspeaker currents I(t) and the corresponding plurality of loudspeaker voltages V(t), as a function of frequency, ω; determining, at the processor, a Fourier space excursion-from-voltage transfer function $H_{XV}(\omega)$, whose form is constrained by parameters $H_{IV}(\omega)$, Bl, $R_{vc}$, and $L_{vc}$, where: $R_{vc}$ comprises a resistance of the voice coil; and $L_{vc}$ comprises an inductance of the voice coil; determining, at the processor, filter coefficients using the Fourier space excursion-from-voltage transfer function, $H_{XV}(\omega)$; and, applying, at the processor, a filter to an input signal for the loudspeaker using the filter coefficients. The Fourier space excursion-from-voltage transfer function $H_{XV}(\omega)$ can be determined using:

$$H_{XV}(\omega) = \frac{1}{Bl}\left[\frac{1 - H_{IV}(\omega)R_{vc}}{j\omega} - L_{vc}H_{IV}(\omega)\right],$$

where: j denotes a square root of −1. The computer usable medium can comprise a non-transitory computer usable medium.

An aspect of the specification provides a device comprising: a processor, a loudspeaker comprising a voice coil, one or more devices configured to determine loudspeaker voltage and loudspeaker current; a volume device configured to set a volume of the loudspeaker; and a memory storing a Bl product for the loudspeaker, the processor configured to: determine a Fourier space excursion-from-voltage transfer function $H_{XV}(\omega)$; determine an acoustic response of the loudspeaker, as a function of frequency, below a dovetail frequency, and relative to a respective acoustic response at the dovetail frequency, using at least a second time derivative of the Fourier space excursion-from-voltage transfer function $H_{XV}(\omega)$; determine an equalization as a function of frequency using the acoustic response, the equalization comprising gains that, when applied to the acoustic response, will adjust the acoustic response to the respective acoustic response at the respective acoustic response at the dovetail frequency; determine filter coefficients of a filter that corresponds to the equalization; and, apply the filter to an input signal for the loudspeaker.

The Fourier space excursion-from-voltage transfer function $H_{XV}(\omega)$ can be determined using:

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1; $R_{vc}$ comprises a resistance of the voice coil; $L_{vc}$ comprises an inductance of the voice coil; and, $H_{IV}(\omega)$ comprises a current-from-voltage transfer function derived from a plurality of loudspeaker currents I(t) and a corresponding plurality of loudspeaker voltages V(t) measured by the one or more devices. However, other forms of Fourier space excursion-from-voltage transfer function $H_{XV}(\omega)$ whose form is constrained by parameters $H_{IV}(\omega)$, Bl, $R_{vc}$, and $L_{vc}$, are within the scope of present implementations.

The processor can be further configured to: determine available excursion of the voice coil at frequencies below the dovetail frequency, at a volume setting of the volume device, the available excursion can further comprise a difference between respective excursions at respective frequencies, as determined from the acoustic response, and an excursion limit of the voice coil, and wherein determining the equalization as a function of the frequency can comprise using the available excursion.

The processor can be further configured to determine the acoustic response of the loudspeaker by determining an absolute acoustic response expressed with respect to pressure, p, and assuming that the loudspeaker comprises a sealed back cavity, using:

$$p = \frac{\rho S_d}{4\pi r}\ddot{x}$$

where r is the distance from the loudspeaker, ρ is the density of a medium surrounding the voice coil, $S_d$ is an area of a diaphragm of the loudspeaker, $\ddot{x}$ is the second time derivative of the excursion-from-voltage transfer function, $H_{XV}(\omega)$.

The processor can be further configured to: determine a minimum frequency for which the equalization can be applied to the acoustic response without exceeding the excursion limit; and, determine at least the equalization between the minimum frequency and the dovetail frequency.

The dovetail frequency can comprise a maximum frequency above which the excursion of the voice coil is one or more of below a minimum excursion and the excursion is not significantly affected.

The processor can be further configured to apply limits using one or more of a maximum applied gain and a minimum equalization frequency.

The processor can be further configured to adjust the gains to match a respective excursion of at least one other loudspeaker.

The loudspeaker can comprise a first loudspeaker of a pair of two stereo loudspeakers, and the processor can be further configured to adjust the gains to match a respective excursion of at least a second loudspeaker of the pair of two stereo loudspeakers.

The processor can be further configured to control the loudspeaker to emit a sound at a given absolute acoustic level in a calibration procedure.

Another aspect of the specification provides a method comprising: determining, at a processor of a device, a Fourier space excursion-from-voltage transfer function $H_{XV}(\omega)$, the device comprising: the processor, a loudspeaker comprising a voice coil, one or more devices configured to determine loudspeaker voltage and loudspeaker current; a volume device configured to set a volume of the loudspeaker; and a memory storing a Bl product for the loudspeaker; determining, at the processor, an acoustic response of the loudspeaker, as a function of frequency, below a dovetail frequency, and relative to a respective acoustic response at the dovetail frequency, using at least a second time derivative of the Fourier space excursion-from-voltage transfer function $H_{XV}(\omega)$; determining, at the processor, an equalization as a function of frequency using the acoustic response, the equalization comprising gains that, when applied to the acoustic response, will adjust the acoustic response to the respective acoustic response at the respective acoustic response at the dovetail frequency; determining, at the processor, filter coefficients of a filter that corresponds to the equalization; and, applying, at the processor, the filter to an input signal for the loudspeaker.

The Fourier space excursion-from-voltage transfer function $H_{XV}(\omega)$ can be determined using:

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1; $R_{vc}$ comprises a resistance of the voice coil; $L_{vc}$ comprises an inductance of the voice coil; and, $H_{IV}(\omega)$ comprises a current-from-voltage transfer function derived from a plurality of loudspeaker currents I(t) and a corresponding plurality of loudspeaker voltages V(t) measured by the one or more devices. However, other forms of Fourier space excursion-from-voltage transfer function $H_{XV}(\omega)$ whose form is constrained by parameters $H_{IV}(\omega)$, Bl, $R_{vc}$, and $L_{vc}$, are within the scope of present implementations.

The method can further comprise: determining available excursion of the voice coil at frequencies below the dovetail frequency, at a volume setting of the volume device, the available excursion can comprise a difference between respective excursions at respective frequencies, as determined from the acoustic response, and an excursion limit of the voice coil, and wherein the determining the equalization as a function of the frequency can comprise using the available excursion.

The method can further comprise: determining the acoustic response of the loudspeaker by determining an absolute acoustic response expressed with respect to pressure, p, and assuming that the loudspeaker comprises a sealed back cavity, using:

$$p = \frac{\rho S_d}{4\pi r}\ddot{x}$$

where r is distance from the loudspeaker, ρ is the density of a medium surrounding the voice coil, $S_d$ is an area of a diaphragm of the loudspeaker, $\ddot{x}$ is the second time derivative of the excursion-from-voltage transfer function, $H_{XV}(\omega)$.

The method can further comprise: determining a minimum frequency for which the equalization can be applied to the acoustic response without exceeding the excursion limit; and, determine at least the equalization between the minimum frequency and the dovetail frequency.

The dovetail frequency can comprise a maximum frequency above which the excursion of the voice coil is one or more of below a minimum excursion and the excursion is not significantly affected.

The method can further comprise applying limits using one or more of a maximum applied gain and a minimum equalization frequency.

The method can further comprise adjusting the gains to match a respective excursion of at least one other loudspeaker.

The loudspeaker can comprise a first loudspeaker of a pair of two stereo loudspeakers, and the method can further comprise adjusting the gains to match a respective excursion of at least a second loudspeaker of the pair of two stereo loudspeakers.

The method can further comprise controlling the loudspeaker to emit a sound at a given absolute acoustic level in a calibration procedure.

A further aspect of the specification provides a computer program product, comprising a computer usable medium having a computer readable program code adapted to be executed to implement a method comprising: determining, at a processor of a device, a Fourier space excursion-from-voltage transfer function $H_{XV}(\omega)$, the device comprising: the processor, a loudspeaker comprising a voice coil, one or more devices configured to determine loudspeaker voltage and loudspeaker current; a volume device configured to set a volume of the loudspeaker; and a memory storing a Bl product for the loudspeaker, the Fourier space excursion-from-voltage transfer function $H_{XV}(\omega)$; determining, at the processor, an acoustic response of the loudspeaker, as a function of frequency, below a dovetail frequency, and relative to a respective acoustic response at the dovetail frequency, using at least a second time derivative of the Fourier space excursion-from-voltage transfer function $H_{XV}(\omega)$; determining, at the processor, an equalization as a function of frequency using the acoustic response, the equalization comprising gains that, when applied to the acoustic response, will adjust the acoustic response to the respective acoustic response at the respective acoustic response at the dovetail frequency; determining, at the processor, filter coefficients of a filter that corresponds to the equalization; and, applying, at the processor, the filter to an input signal for the loudspeaker. The Fourier space excursion-from-voltage transfer function $H_{XV}(\omega)$ can be determined using:

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1; $R_{vc}$ comprises a resistance of the voice coil; $L_{vc}$ comprises an inductance of the voice coil; and, $H_{IV}(\omega)$ comprises a current-from-voltage transfer function derived from a plurality of loudspeaker currents I(t) and a corresponding plurality of loudspeaker voltages V(t) measured by the one or more devices. However, other forms of Fourier space excursion-from-voltage transfer function $H_{XV}(\omega)$ whose form is constrained by parameters $H_{IV}(\omega)$, Bl, $R_{vc}$, and $L_{vc}$, are within the scope of present implementations.

The computer usable medium can comprise a non-transitory computer usable medium.

1 General Methodology 1.1 Present Implementations

This specification describes a methodology to convert a voltage signal (for example in volts) to excursion (for example in meters). Processing can then be performed in the excursion domain and a process is provided to transform back to the voltage domain. The transforms can be implemented as DSP (digital signal processor) filter topologies with delays of the order of about 10 ms. The filter taps can be updated about every 10 ms, responding to changes in acoustic loads on the loudspeaker and about every 100 ms for the voice coil resistance changes. Digital processing (e.g. limiting) can hence be done in the excursion domain, and the result can be transformed back to the voltage domain for application to the loudspeaker. This specification also describes a methodology to measure and model the voice coil temperature.

1.1.1 Thermal Limits

Small microspeakers rated at about ½ Watt can generally handle many times that for very short periods. Essentially all of the power dissipated by the microspeaker goes to heating the voice coil. If the temperature climbs too high, the unit can fail (for example the glue holding the voice coil together comes apart).

The loudspeaker is cooled by conducting the heat out through the membrane, case and other components and by the cooling effect of moving air. Lower frequencies generate more air movement causing more cooling and hence allowing higher powers. This relation breaks down when the loudspeaker port is blocked, the air movement is restricted and/or the ambient temperature rises. When the air cannot cool the coil, the internal temperature rises much faster than expected, and the loudspeaker can be damaged very quickly. The relationship between coil temperature, power level, frequency, duration, ambient temperature, and airflow is complex, and very difficult to reliably predict.

1.1.2 Excursion Limits

The maximum allowable diaphragm excursion for a microspeaker currently used in smartphones is for example about 0.5 mm. Pushing the excursion beyond its limit can irreversibly change the elastic constants of the membrane, skew the voice coil position or even pop the voice coil right out of the magnet gap.

A loudspeaker's biggest excursion problem comes at and/or near its resonant frequency. At the resonant frequency the membrane moves easily, so small amounts of power can push the loudspeaker beyond its limit. Microspeaker systems normally add a high-pass filter at around 1000 Hz to reduce the excursion. This can minimize the impact of the resonance peak, but losing the bass significantly degrades the sound quality. It can be difficult to properly equalize this resonant frequency as it varies between individual loudspeakers. Further, the resonant frequency can change dramatically over the operating conditions. Temperature, ageing, a poorly designed phone case, and changes in the acoustic environment like blocking a loudspeaker port will all cause shifts in the resonant frequency. Wear-and-tear on the phone case can also cause leaks in the loudspeaker's back-volume. Any of these changes can cause loudspeaker failure in a fixed-filter system. So while some benefit can be derived from a fixed filtering system, active monitoring of the parameters and accommodation is required to take full advantage of the capabilities of the loudspeaker.

2 Other Methodologies and Models

Loudspeaker systems are often well represented by their "Lumped Element" models (also called "Acoustic Circuit" models). Once derived, these models can accurately predict many aspects of the loudspeaker implementation including the excursion-from-voltage transfer function. A generalized acoustic circuit of a loudspeaker and its acoustic implementation is depicted in FIG. 1.

The immediate problem that arises is that the Acoustic Circuit topology is dependent on the actual loudspeaker used and the details of the acoustic implementation. For example, when a grill with an acoustic resistance is placed in front of the loudspeaker, the topology of the circuit in FIG. 1 must be changed in order to include it. Hence, for each smartphone design, an appropriate Acoustic Circuit can be adopted.

In order to make this approach adaptive, the parameter values in the model should be constantly updated to reflect changes in the implementation and accommodate device-to-device tolerances. For example, Acoustic Circuit models could be used to generate an impedance curve, and fit this curve using measurements of the voltage and the current applied to the loudspeaker. The component parameters can be changed until a good fit is found at which point excursion can be predicted. Unfortunately fitting techniques like this (often called nonlinear optimization techniques) are computationally expensive and dependent on parameter tolerance. Further, there is no guarantee that a good fit will be found.

3 Probe Tones 3.1 Low Frequency Probe Tone

In present implementations, voice coil temperature in a loudspeaker can be determined by measuring voice coil resistance. A measure of the voice coil resistance is also used for an excursion limiting calculation, described hereafter. At sufficiently low frequencies (for example about 100 Hz for a typical microspeaker used in mobile devices), the impedance of the loudspeaker is essentially about equal to its voice coil resistance. In general, program material can contain enough content at these sufficiently low frequencies that the resistance can be determined from the spectrum of frequencies of the program material.

In some implementations, a tone at the sufficiently low frequency described above can be added to an input signal and/or an output signal derived from the program material to provide a constant measure of the resistance. Such an added frequency can selected to be low enough that the combination of loudspeaker sensitivity and human hearing sensitivity will render the tone inaudible to a user. At the same time, such an added frequency can be selected to be high enough such that when subjected to a filter such as that shown in FIG. 2, it can be reliably detected even when its amplitude changes quickly. In some implementations, a frequency of about 100 Hz is selected as an added frequency tone, which has been determined to be a good compromise for a smartphone loudspeaker.

Figure 2:
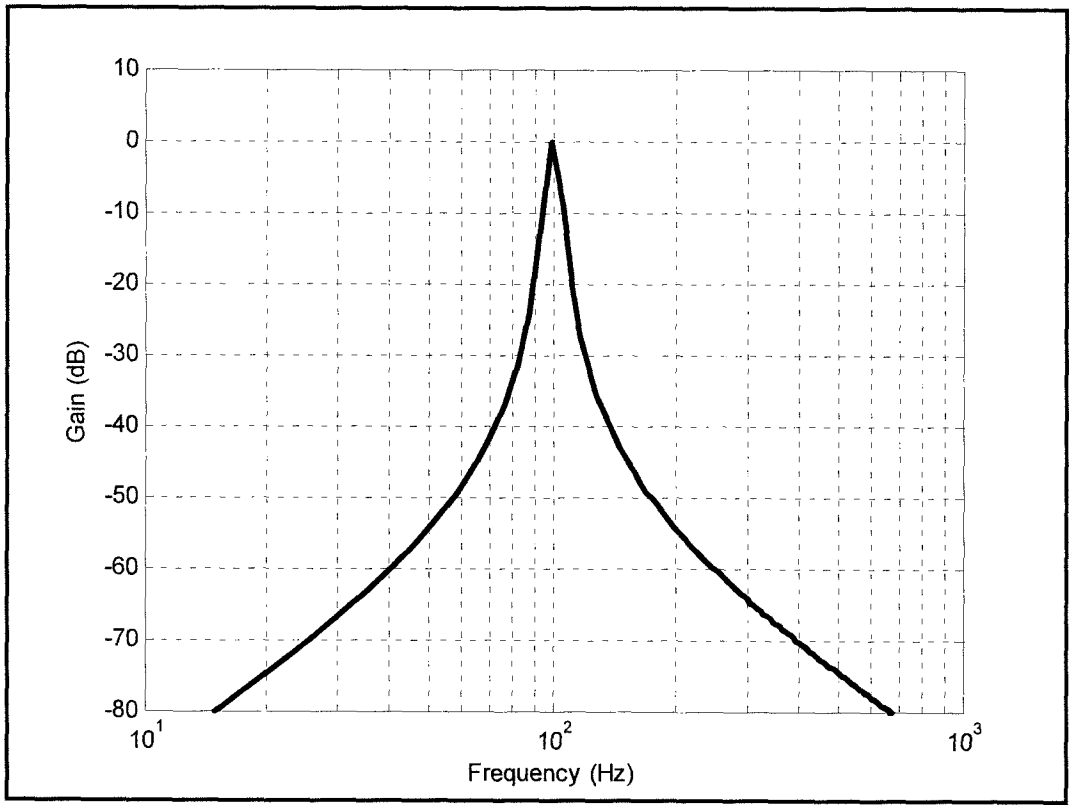
FIG. 2 depicts an acoustic filter to be used with a 100 Hz probe tone, according to non-limiting implementations.

The filter used to recover the probe tone (i.e. the frequency added to a signal used to drive the loudspeaker) can have a low enough Q to respond to changes in the amplitude. For a smart phone, this response time was found to be about 100 ms. FIG. 2 depicts an example filter used to recover the probe tone.

Although there is no specific need to filter out program material that would cover this band, in some implementations, such filtering can occur to prevent saturation of the voltage signal, and to make analysis and debugging easier (due to presence of only probe tones in these implementations).

3.2 High Frequency Probe Tone

Figure 3:
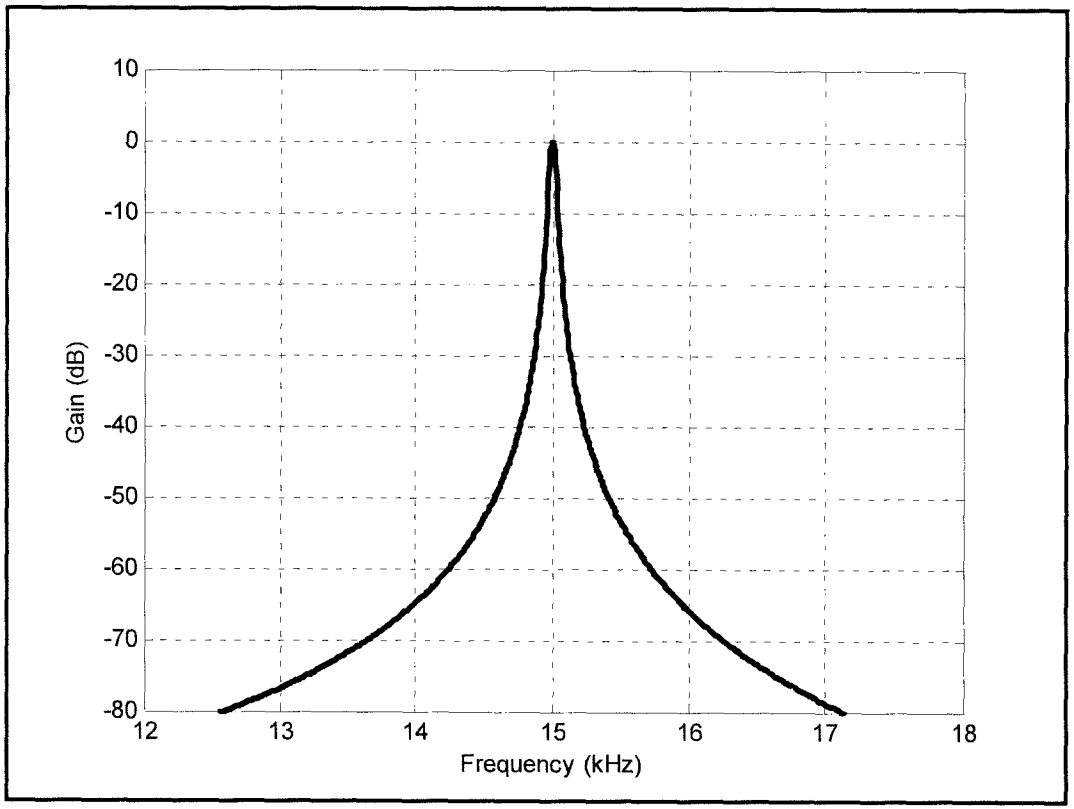
FIG. 3 depicts an acoustic filter to be used with a 15 kHz probe tone, according to non-limiting implementations.

A similar procedure as that described above for a low frequency tone can be used to generate and recover a high frequency probe tone for measuring the voice coil inductance. As before, the probe tone frequency should be high enough that the combination of the loudspeaker sensitivity and the human hearing sensitivity would render the tone inaudible to the user. The frequency must also be sufficiently high that the mechanical components of the loudspeaker do not contribute to the electrical impedance. In a typical microspeaker used with a mobile device, 15-20 kHz would fit these requirements. For example, attention is directed to FIG. 3 which depicts a filter to be used with a 15 kHz probe tone.

3.3 Filtering the Program Material

Figure 4:
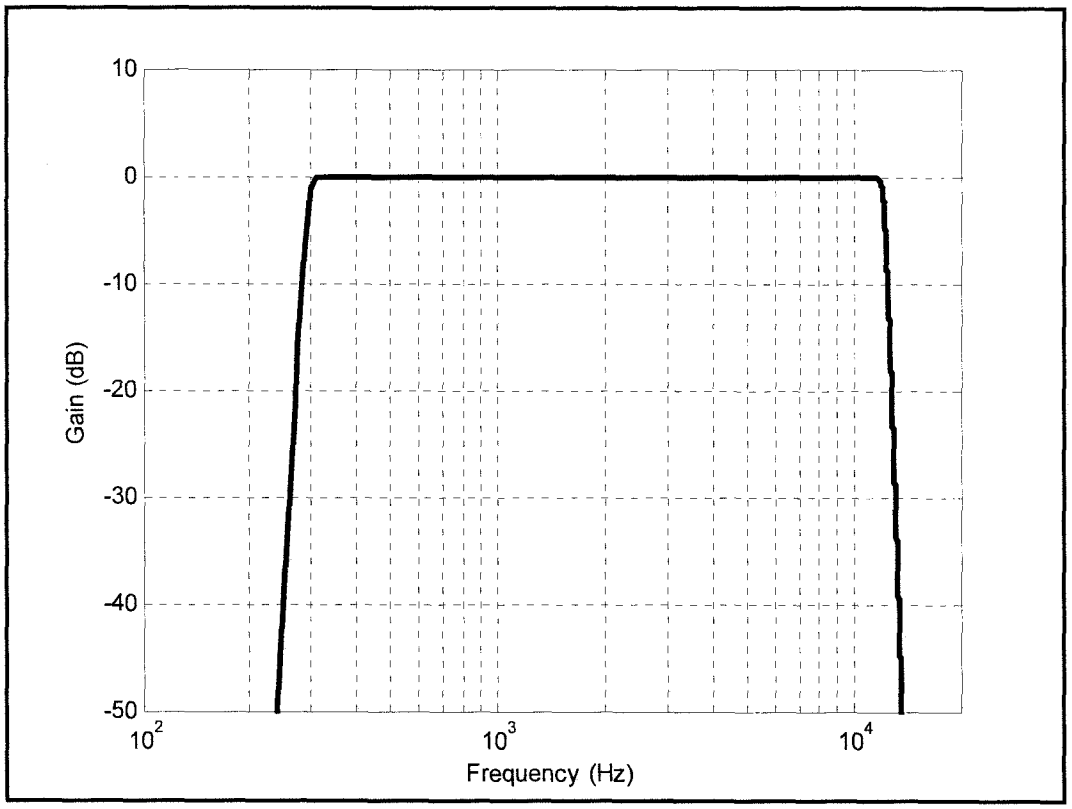
FIG. 4 depicts an example acoustic filter consistent with a low frequency probe tone and a high frequency probe tone, according to non-limiting implementations.

As mentioned above, filtering the program material so that it does not contain spectral content around the probe tones is not critical, but can be convenient. An example filter consistent with the tones described above with respect to a low frequency probe tone and a high frequency probe tone is depicted in FIG. 4.

4 Thermal Prediction Theory

The thermal coefficient, a, of the resistance of the voice coil winding is generally used in implementations described herein. For annealed copper $\alpha$=0.00393 Kelvin$^{-1}$. Present implementations can further use a manufacturer's maximum temperature specification for a loudspeaker (for example, often between about 100° C. and 150° C.).

The instantaneous relationship between temperature of the voice coil T and voice coil resistance (R) is given by:

$$T = T_0 + \frac{R - R_0}{\alpha R_0} \tag{1}$$

$T_0$ is a reference temperature chosen to be within the operating temperature of the final implementation. The voice coil resistance at this temperature is $R_0$. These values can be specified by the manufacturer (and/or measured) and stored on a device at design time, or at manufacturing time. These values generally remain sufficiently constant throughout the life of a product.

The maximum voice coil temperature can be of the order of about 100° C. to about 150° C. resulting in a resistance change from its room temperature value of about 40%.

4.1 Voice Coil Thermal Model

The response of both the excursion and thermal compression algorithms described herein are dependent on a current knowledge of the voice coil resistance. When probe tones are not used, input signal to a loudspeaker cannot be relied upon to always contain enough low frequency components where the impedance of the loudspeaker is essentially equal to its voice coil resistance. To do better, a model of the temperature from the thermal loads on the voice coil is constructed as follows:

$$\frac{dT}{dt} = \frac{1}{C_p}[P(t) - \kappa(x)(T - T_a)] \tag{2}$$

Where:

P(t) is the power dissipated as voice coil Ohmic heating (Watts)

T is the voice coil temperature (° C.)

$T_a$ is the ambient temperature (° C.)

$C_p$ is the heat capacity of the voice coil (Joule/C.°)

κ(x) is the voice coil—ambient heat conductivity (Watts/C.°)

The heat conductivity is excursion dependent because the voice coil can cool itself more efficiently when air is circulated due to the diaphragm motion.

The values $T_a$, κ(x), and $C_p$ are not expected to change quickly and can be periodically and/or constantly updated by the algorithm described herein. Using the model given in (2), a very quick estimate of the voice coil resistance can be obtained even when the input signal does not contain enough energy at frequencies where the impedance of the loudspeaker is essentially equal to its voice coil resistance.

Estimates of κ(x), and $C_p$ can be obtained by applying power to the loudspeaker and then releasing the power, while simultaneously measuring the resistance. $C_p$ can be determined at the onset of power:

$T=T_a$, so that:

$$\left.\frac{dT}{dt}\right]_{t=0} = \frac{P(0)}{C_p}$$

κ can be determined when the power is released:

P(t)=0, so that $$\left.\frac{dT}{dt}\right]_{t=0} = \frac{\kappa(x)(T - T_a)}{C_p}$$

Figure 5:
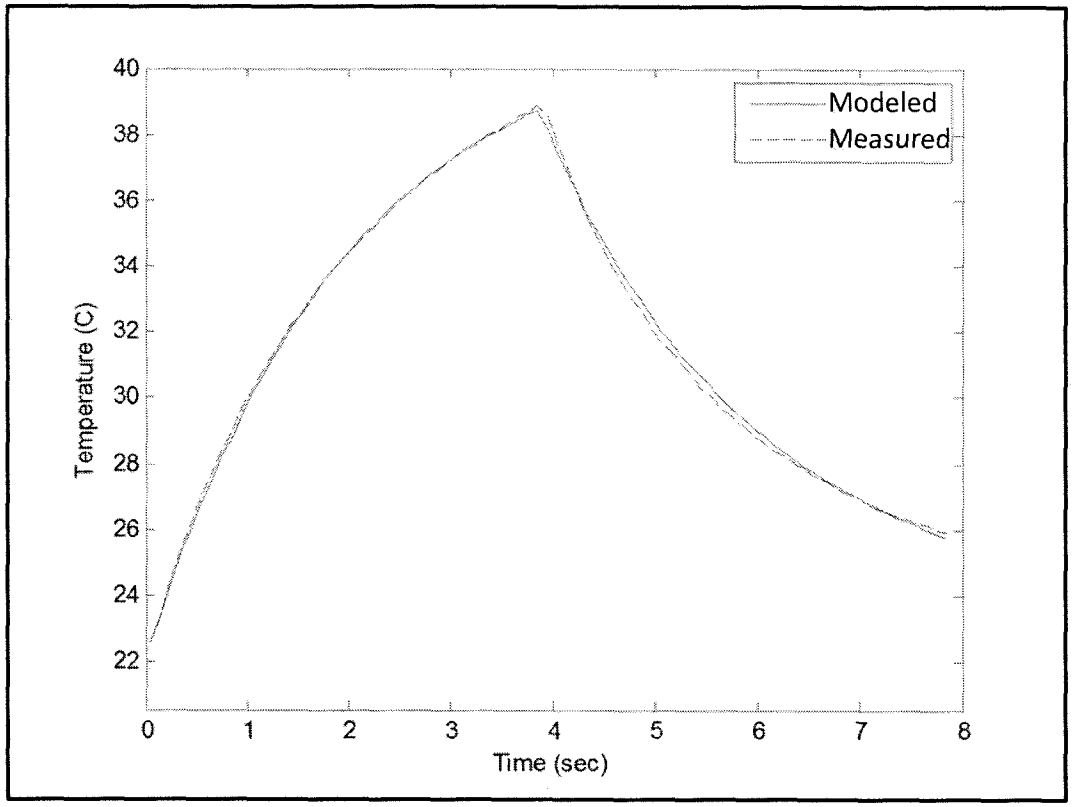
FIG. 5 depicts measured loudspeaker voice coil temperature as a function of time, according to non-limiting implementations.

FIG. 5 depicts a measured loudspeaker voice coil temperature as determined using Equation (1). The applied signal comprised a 5 kHz sinusoid at 500 mW for 4 seconds, then no signal for 4 seconds. Superimposed on the applied signal was a 100 Hz sinusoid at 1.5 mW to determine the resistance.

Using the methodology described above, the measured data FIG. 5 gives:

$T_a$=23.6° C.

$C_p$=0.0410 Joule/C.°

K=0.0193 Watt/C.°

Substituting these values in Equation (2), provides the modeled result depicted in FIG. 5 (however, these values were slightly adjusted for a better overall fit to the data: $T_a$ was increased by 1° C., $C_p$ was increased by 10% and κ was decreased by 10%).

4.2 Voice Coil Thermal Limiting

The thermal limiting implemented for some loudspeakers can be applied across an entire frequency band of the loudspeaker, and hence the entire signal is reduced in amplitude to prevent exceeding the thermal limit. The attack and decay time constants as well as the hold time can be set to about half the value of the thermal time constant for the voice coil ($\tau_T$). From Equation (3), and values for $C_p$ and κ derived above, $\tau_T$ can be determined to be about 2.1 s for a "typical" loudspeaker:

$$\tau_T = \frac{C_p}{\kappa} \tag{3}$$

The thermal compression can be applied by multiplying the output signal by the thermal compression gain ($g_T$). This gain is a number between 0 and 1. It is equal to 1 when there is no thermal compression and is reduced from one when temperature reduction is required. Using the time derivative of the temperature, Equation (4) can be used to predict whether the temperature will rise above the maximum temperature allowed ($T_{max}$) within a compressor attack time ($\tau_{attack}$).

$$T + \tau_{attack}\frac{dT}{dt} > T_{max} \tag{4}$$

When so, $g_T$ is exponentially reduced with a time constant $\tau_{attack}$. When the criterion in (4) is no longer met, $g_T$ exponentially rises with a time constant $\tau_{decay}$.

Responses for this thermal limiter were simulated herein using on a model conforming to Equation (2).

The parameters were set as follows:

$\tau_{attack}$=2 s $\tau_{decay}$=2 s $T_{max}$=90 C

Stimuli included, but are not limited to: sinusoids and square waves; sinusoids and square waves modulated by sinusoids and square waves; and music.

Figure 6:
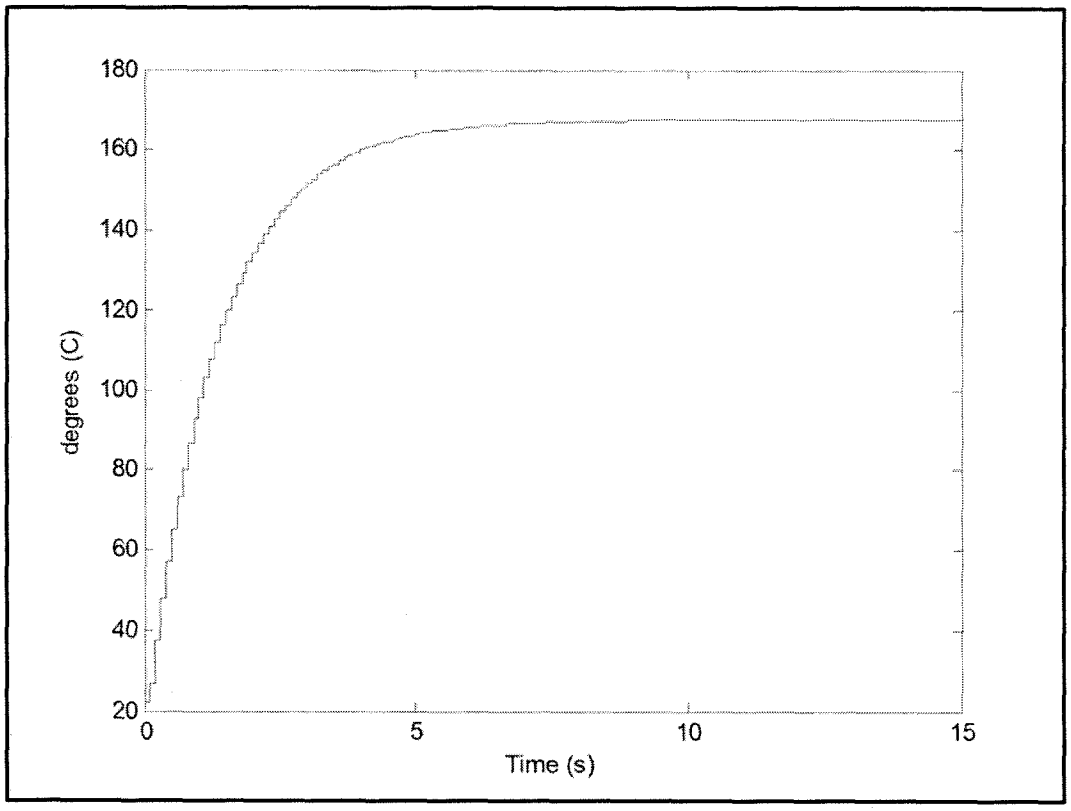
FIG. 6 depicts measured loudspeaker voice coil temperature as a function of time, according to further non-limiting implementations.

The example temperature vs. time curve, as depicted in FIG. 6, has a 1 kHz sinusoidal stimulus applied with an amplitude of 5 Vrms. Without regulation, the temperature quickly rises to about 170° C. The 100 ms steps in FIG. 6 are due to temperature being measured every 100 ms.

Figure 7:
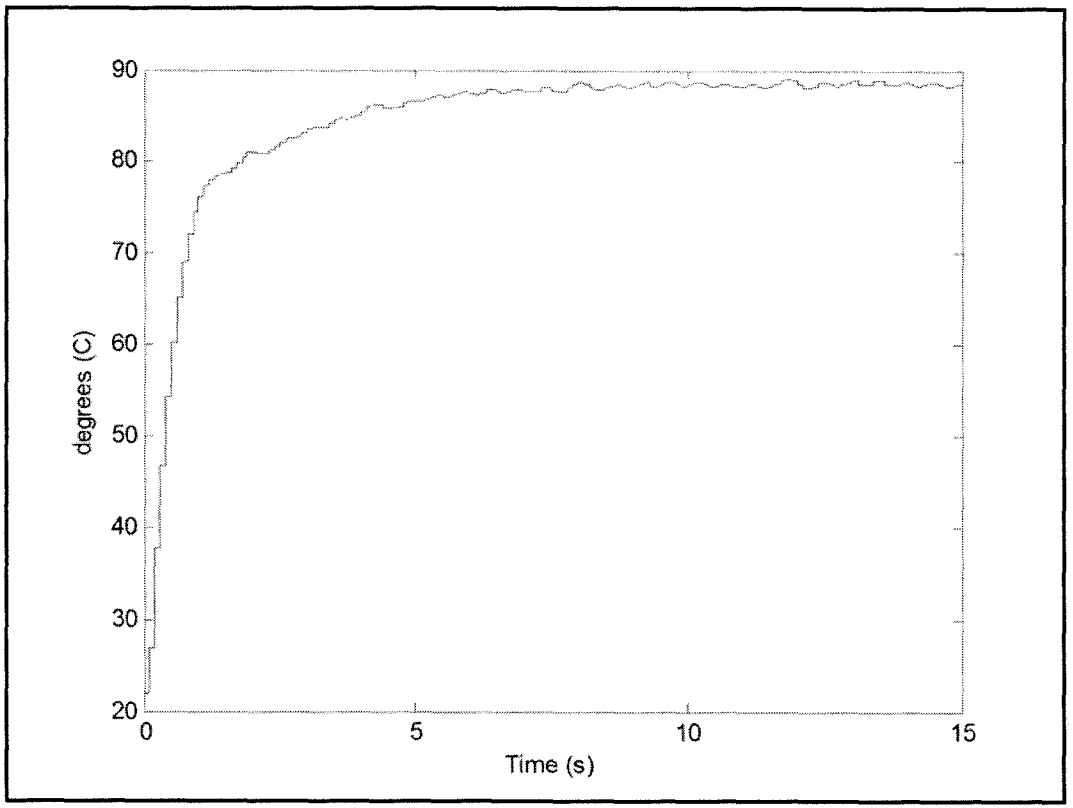
FIG. 7 depicts a regulated loudspeaker voice coil temperature as a function of time, according to non-limiting implementations.
Figure 8:
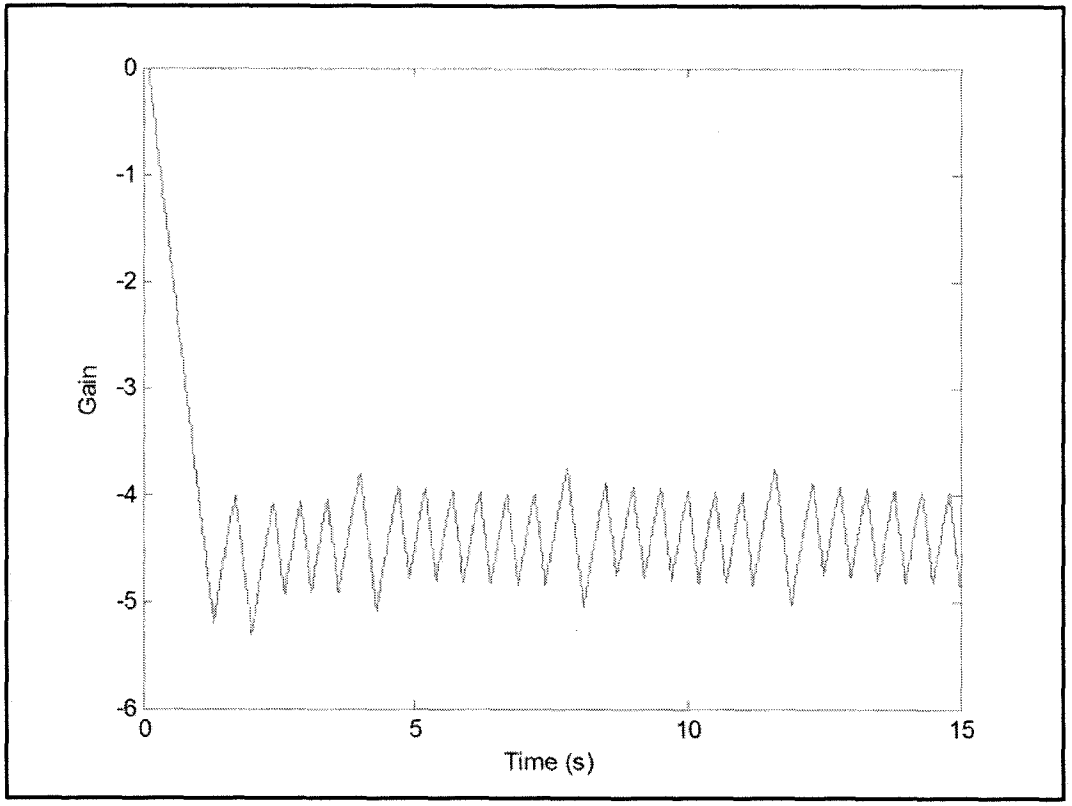
FIG. 8 depicts loudspeaker gain as a function of time, according to non-limiting implementations.

Using the algorithm described above, the temperature is hence regulated to just below a specified maximum temperature of about 90° C., as depicted in FIG. 7.

Furthermore, according to the algorithm described herein, $g_T$ will always be moving when it is less than one. This gain is plotted for the same example in FIG. 6. The gain is oscillating with an amplitude of about 1 dB at about 2 Hz.

5 Voice Coil Inductance Determination

The voice coil inductance can be measured in a similar way as the resistance was. A probe tone of sufficiently high frequency that the user will not hear it would be useful. At this sufficiently high frequency ($f_L$), the voice coil impedance is essentially only the sum of the voice coil resistance and inductive reactance. When the RMS impedance at the high frequency probe tone is $Z_L$, then the voice coil inductance will be given by $$L_{vc} = \frac{\sqrt{Z_L^2 - R_{vc}^2}}{2\pi f_L} \tag{5}$$

Figure 9:
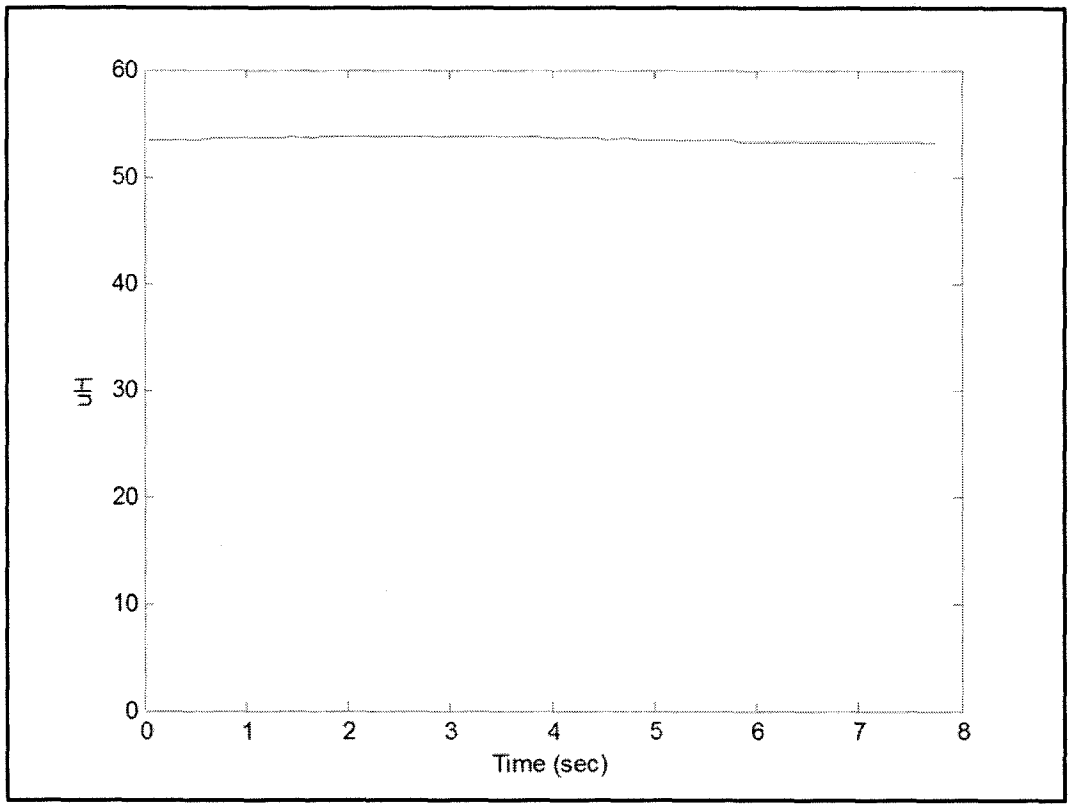
FIG. 9 depicts loudspeaker inductance as a function of time, according to non-limiting implementations.

The result of this calculation is depicted in FIG. 9. The stimulus in the figure is the same drastic stimulus as used in FIG. 5. Even though the stimulus can be quite violent, the inductance of the voice coil remains fairly constant. In some implementations, a constant value of the inductance can be used.

6 Excursion Prediction Theory

The examples in this section were generated using a "Virtual Loudspeaker". This was a mathematical loudspeaker represented by its Acoustic Circuit Model. Results from the Acoustic Circuit Model are referred to as "original". The Acoustic Circuit model was also used to calculate current through the virtual loudspeaker given the voltage applied to it. This was used to verify the algorithm and generate the figures referred to below.

6.1 Derivation of the Excursion-from-Voltage Transfer Function

A loudspeaker electrical impedance can be modeled by a lumped element model (or "acoustic circuit model") showing electrical, mechanical and acoustic components contributing to the electrical impedance. However, details of the mechanical acoustic impedances will be ignored presently, and but their overall effect on the back voltage generated on the voice coil will be described hereafter.

Loudspeaker terminals can be denoted as "+" and "−" such that when a positive voltage is placed on the "+" terminal, with respect to the "−" terminal the loudspeaker cone moves outward. Note that mechanically pushing the loudspeaker cone outward generates a positive voltage on the "+" terminal with respect to the "−" terminal (which can, for example, be referred to as a "back emf" (i.e. back Electromotive Force)).

Figure 10:
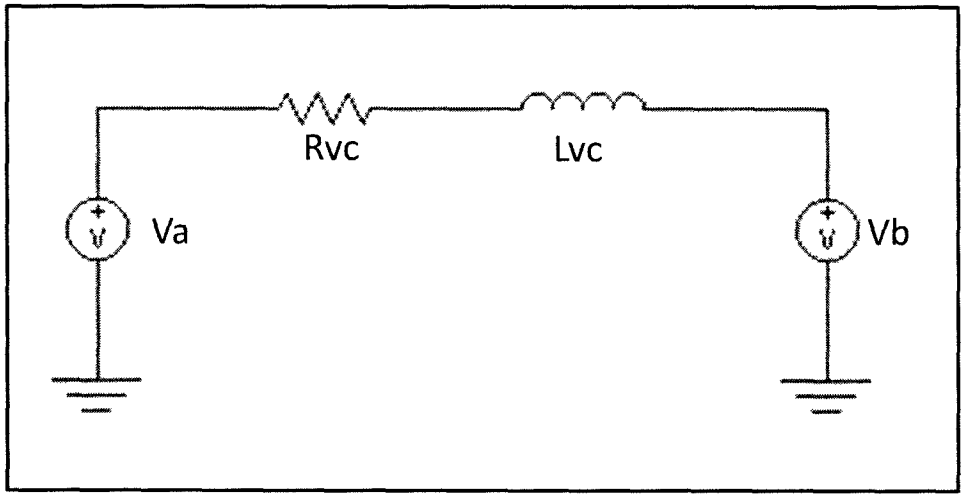
FIG. 10 depicts a loudspeaker model in which impedance is split into two components, according to non-limiting implementations.

The loudspeaker electrical impedance can be conceptually split into two components as depicted in FIG. 10:

1. The impedance due to the electrical components.
2. The impedance due to coupling with the mechanical and acoustic components of the system.

The electrical components are:

$R_{vc}$—The voice coil resistance $L_{vc}$—The voice coil inductance

The electrical components can be measured. $R_{vc}$ can be obtained by measuring the impedance at low frequencies where the impedance of the loudspeaker is essentially equal to its voice coil resistance. This can be done clandestinely and continuously and/or periodically by superimposing an inaudibly low frequency tone on the program material. Similarly, $L_{vc}$ can be obtained by measuring the impedance at inaudibly high frequencies.

The components of the impedance due to the mechanical and acoustic components can be perceived as depicted in FIG. 10: the electrical impedance changes when a back emf ($V_b$) is generated in the loudspeaker motor. Quantitatively, the voltage induced in the voice coil ($V_b$) is given by Faraday's law of induction:

$$V = -\frac{\partial \phi}{\partial t} \tag{6}$$

where t is time and:

$$\phi = \oiint_{\substack{Bounded\\Surface}} B \cdot dA \tag{7}$$

For simplicity, the voice coil can be conceptualized as a plurality of single loops of wire (and the contributions from these single loops can be summed to form the entire voice coil). The "Bounded Surface" is bounded by the single wire loop and the shape of the "Bounded Surface" can be selected for convenience. Hence, in one implementation, a surface can be formed such that B (i.e. magnetic field) is always parallel to A (i.e. area), so that the integrand in Equation (7) becomes |B||A|. In the magnet gap, such a surface would look like a circular cylinder of radius r ending at the wire loop. Within the magnet gap, when the voice coil position is changed by an amount (Δx), the flux change (Δϕ) would be:

$$\Delta\phi = -2\pi r \Delta x B = -Bl\Delta x \tag{8}$$

Where l is the length of wire in the magnet gap due to the sum of all the single wire loops forming the voice coil. Dividing by Δt, and taking the limit, the following is obtained:

$$V = -\frac{\partial \phi}{\partial t} = Bl\frac{\partial x}{\partial t} = uBl \tag{9}$$

Another form of Faraday's law can be used (which can be derived from the Lorentz force law) given in Equation (10):

$$V = \oint_{loop} (E + u \times B) \cdot dl = uBl \tag{10}$$

The voltage in Equation (10) results entirely from the magnetic field in the radial direction. When it is assumes that the magnetic field is constant, the integral is trivial: the voltage induced in the voice coil ($V_b$) is given by the velocity (u) of the voice coil times the Bl product of the loudspeaker. In general, a Bl of a loudspeaker is the product of magnet field strength in the voice coil gap and the length of wire in the magnetic field, (often specified in units of tesla-meters) and can be provided by a manufacturer of a loudspeaker.

The back voltage can then be expressed as a function of the sensed voltage and applied current in the Fourier domain:

$$V_b = V_a - I_a R_{vc} - j\omega L_{vc} I_a \tag{11}$$

From Equation (9), the velocity of the voice coil is given by $$u(\omega) = \frac{V_b}{Bl} \tag{12}$$

The excursion is given by the integral of the velocity (u) with respect to time. Integration over time in the Fourier Domain is equivalent to division by jω. Integrating Equation (12) and substituting the result into (11) gives the excursion-from-voltage transfer function.

$$H_{XV}(\omega) = \frac{1}{Bl}\left[\frac{1 - H_{IV}(\omega)R_{vc}}{j\omega} - L_{vc}H_{IV}(\omega)\right] \tag{13}$$

Where: $H_{XV}(\omega)$ is the excursion-from-voltage transfer function, and $H_{IV}(\omega)$ is the electrical current-from-voltage transfer function which will be determined below.

Equation (13) provides a formulation for the excursion-from-voltage transfer function (and specifically applied voltage), as derived from the electrical current-from-voltage transfer function. This transfer function can be measured in a continuous and/or periodic fashion, and can be updated every 10 ms or so. However, it is appreciated that other forms of an excursion-from-voltage transfer function transfer function are within the scope of present implementations as described in more detail below with respect to FIG. 91.

6.2 Determination of the Current-from-Voltage Transfer Function

Figure 11:
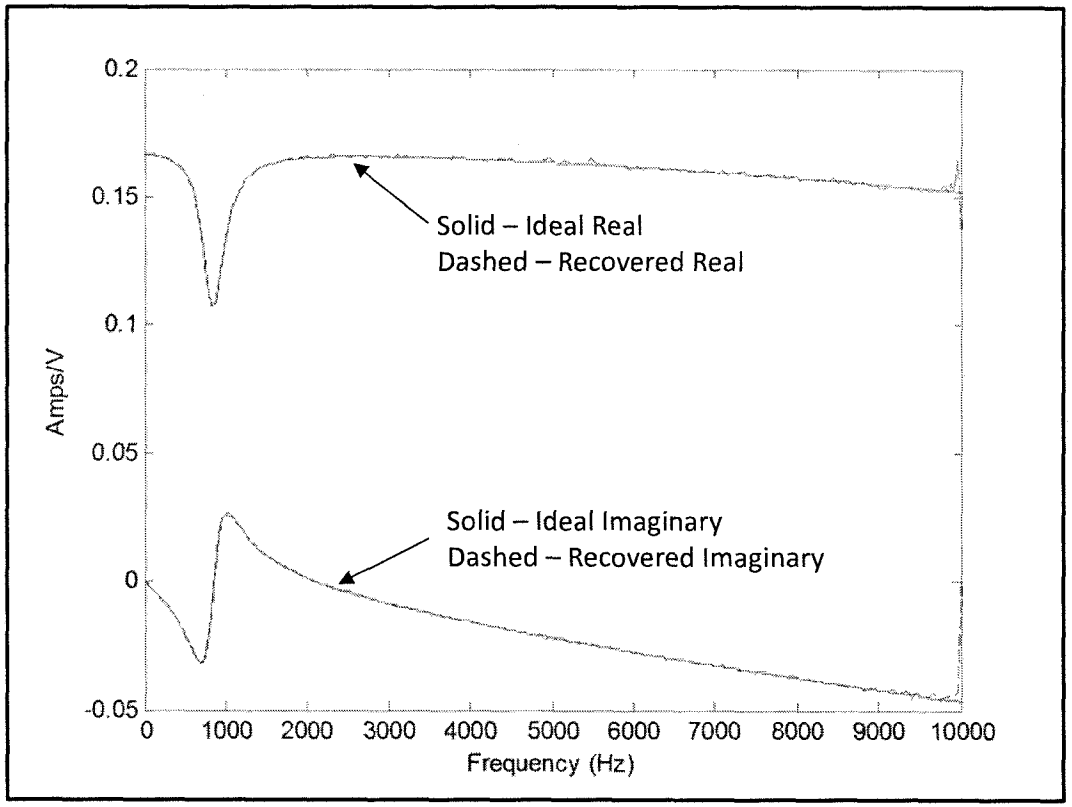
FIG. 11 depicts the electrical-current-from-voltage transfer function, according to non-limiting implementations.

Equation (13) generally uses Electrical Current-from-Voltage transfer function, $H_{IV}(\omega)$, as an input. When a voltage stimulus to the loudspeaker is obtained, as well as the current through the loudspeaker over some time sample, the Current-from-Voltage transfer function can be derived using a frequency domain Least Mean Squares method. The result using a Gaussian noise stimulus is depicted in FIG. 11. However, the Current-from-Voltage transfer function, $H_{IV}(\omega)$ can be determined using any suitable method. For example, Voltage samples from a loudspeaker can be denoted as $V_1, V_2, V_3 \ldots$ each taken a time, τ, apart. Similarly for $V_1, V_2, V_3 \ldots$, corresponding currents $I_1$ $I_2, I_3 \ldots$ are measured. A current impulse response (h) of the loudspeaker can be defined as:

$$I_i = \sum_{j=0}^{N} h_j V_{i-j}$$

which can alternatively be written as (i.e. using linear algebra and/or matrix methods):

$$\begin{bmatrix} I_1 \\ I_2 \\ \vdots \end{bmatrix} = [h_1 \;\; h_2 \;\; \ldots] \begin{bmatrix} V_1 \\ V_2 \\ \vdots \end{bmatrix}$$

The current impulse response, h, represents the effect of the voltage history on an instantaneous current of the voice coil. Furthermore, the Current-from-Voltage transfer function, $H_{IV}(\omega)$ comprises the Fourier Transform of the impulse response, h.

The values of $h_1, h_2, h_3 \ldots$ can be determined by filling in the measured currents and voltages into the equation above and solving it for h. When a next time sample of current and voltage is measured, each of the currents and voltages in the equation above are "bumped" one down and the current impulse response, h, is again determined. In "ideal" systems, the current impulse response, h, is constant and the matrix can be solved once. However, in the real world, noise and the like affects the current impulse response, h, and hence is determined periodically and/or continuously in present implementations.

Furthermore, the Least Mean Squares derivation of the current impulse response, h, can be used to find a best fit from the measured currents and voltages, which can be done in either a frequency domain or a time domain, however other methods of finding a "best" fit are within the scope of present implementations, for example, using methods associated with adaptive filters.

In any event, once the current impulse response, h, is determined, the current-from-voltage transfer function, $H_{IV}(\omega)$, is determined by taking the Fourier Transform of the current impulse response, h. If the determination is done in the frequency domain, $H_{IV}(\omega)$ can be usually determined directly.

6.3 Determination of the Excursion-from-Voltage Transfer Function

Figure 12:
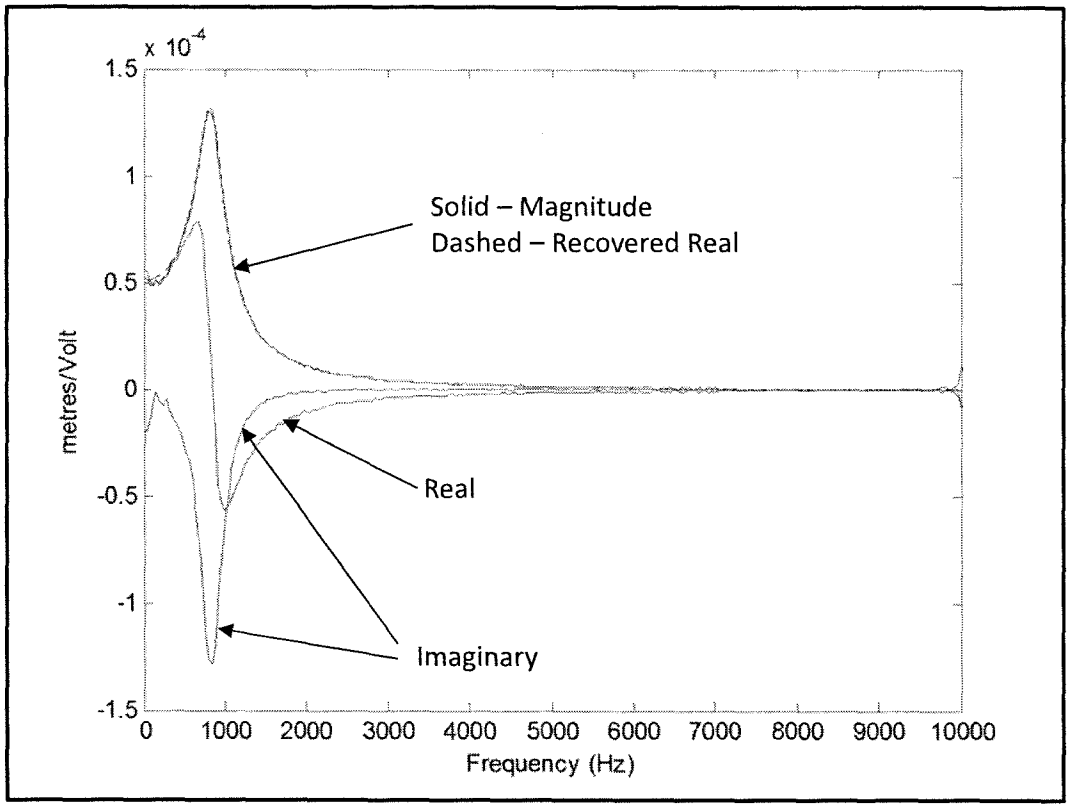
FIG. 12 depicts a recovered excursion-from-voltage transfer function, according to non-limiting implementations.

The recovered excursion-from-voltage transfer function can now be determined by Equation (13) which uses $R_{vc}$, $L_{vc}$, and the Bl product as inputs. $R_{vc}$ and $L_{vc}$ can be determined by the probe tone method described above (and indeed the value of $R_{vc}$ can be crucial in determining the temperature) and a manufacturer Bl product can be used as an input to the algorithm, and/or a laboratory derived Bl product and/or a heuristically derived Bl product. Alternatively, one or more of $R_{vc}$ and $L_{vc}$ can be manufacturer values, and/or stored in a memory of device, along with the Bl product. Regardless of how $R_{vc}$, $L_{vc}$, and Bl are derived, excursion-from-voltage transfer function can be determined using Equation (13). The result of this formula is depicted in FIG. 12. In other words, FIG. 12 depicts excursion as a function of frequency using the data in FIG. 11 as an input into Equation (13).

6.3.1 at Low Frequencies

The process of obtaining the excursion transfer function involves dividing by jω which becomes indeterminate at ω=0 and can give inaccurate results when the frequency is close to zero as compared to the signal bandwidth. However accurate values for either the current or the excursion transfer function below about 350 Hz are not necessarily needed as there tends to be relatively small and/or no signal power in this range. The extraction of the transfer functions can hence be optimized for the frequency range of about 350 Hz to about 3.5 kHz. Values at low frequencies can be approximated, for example, by extrapolating to their DC values.

The DC value of the current transfer function comprises $1/R_{vc}$. The DC value of the imaginary part of the excursion transfer function is zero. The DC value of the real part can be determined using calculations, as described hereafter.

Figure 13:
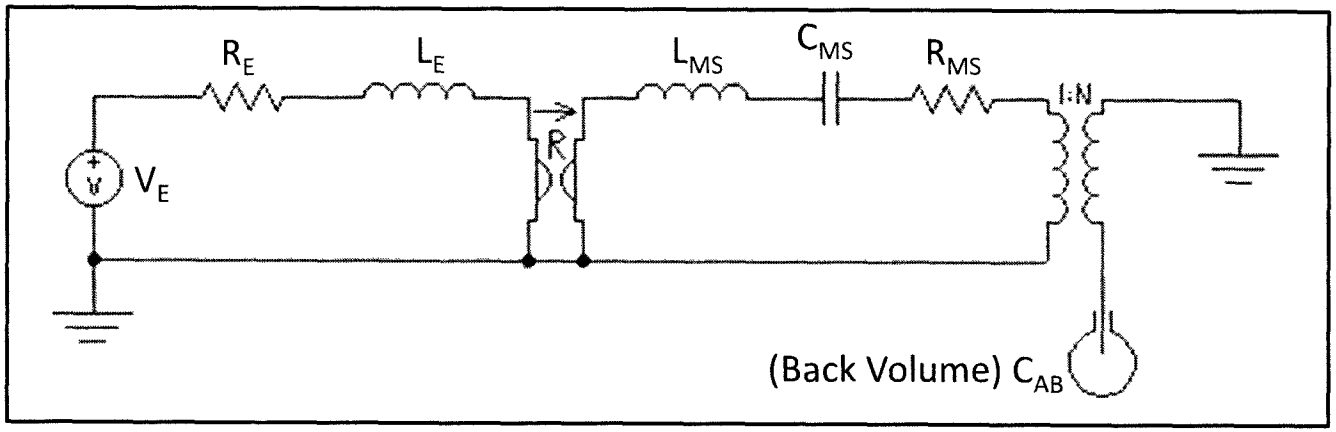
FIG. 13 depicts an electro/mechanical/acoustical circuit of an idealized loudspeaker, according to non-limiting implementations.

The electro/mechanical/acoustical circuit of a given loudspeaker is depicted in FIG. 13. In the configuration in FIG. 13, the components are as follows:

$R_E$—The electrical resistance of the voice coil.

$L_E$—the electrical inductance of the voice coil.

$R_{vc}$—gyration resistance Bl.

$L_{MS}$—The mass of the diaphragm.

$C_{MS}$—The compliance of the diaphragm.

$R_{MS}$—The mechanical resistance of the diaphragm.

$S_d$—Transformer with turns ratio as the inverse of the diaphragm surface area.

backvol—An acoustic capacitance due to the back cavity volume.

Figure 14:
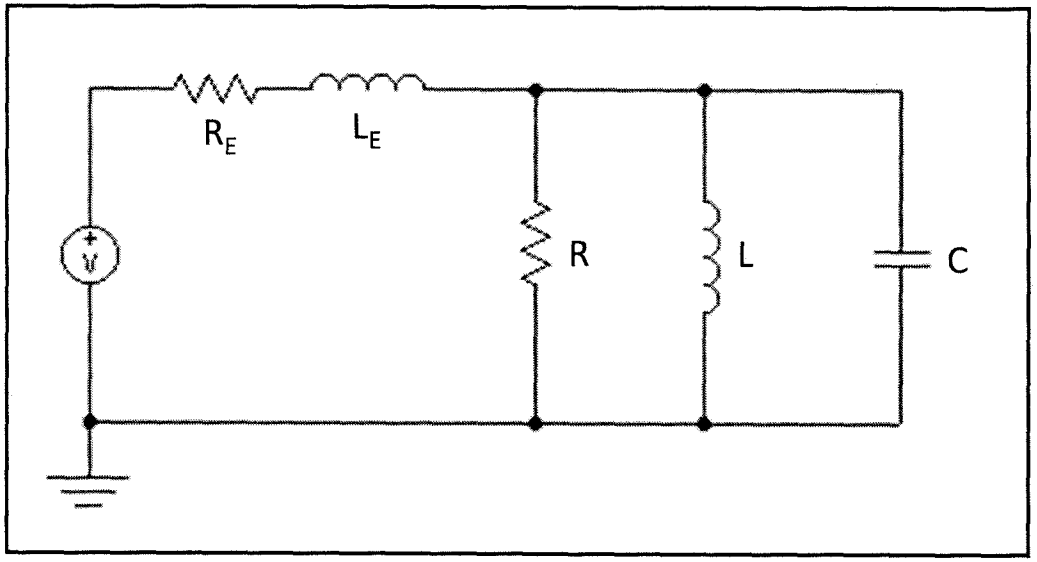
FIG. 14 depicts an alternative electro/mechanical/acoustical circuit of the idealized loudspeaker of FIG. 13, according to non-limiting implementations.

This loudspeaker circuit can be rewritten as depicted in FIG. 14 where:

$$R = \frac{B^2 l^2}{R_{MS}} \tag{14}$$

$$L = B^2 l^2 \frac{C_{MS} C_{AB}}{S_d^2 C_{MS} + C_{MA}} \tag{15}$$

$$C_{AB} = \frac{V_{backvol}}{\rho c^2} \tag{16}$$

$$C = \frac{L_{MS}}{B^2 l^2} \tag{17}$$

The impedance of the RLC network is:

$$Z_{RLC} = \frac{R}{1 + jQ\left(\frac{\omega}{\omega_0} - \frac{\omega_0}{\omega}\right)} \tag{18}$$

where:

$$\omega_0 = \frac{1}{\sqrt{LC}} \tag{19}$$

and $$Q = \omega_0 CR = \frac{R}{\omega_0 L} \tag{20}$$

As can be seen in FIG. 14, the loudspeaker impedance is the sum of the impedance of this RLC network and the electrical impedances of the voice coil:

$$Z = R_{vc} + j\omega L_{vc} + \frac{R}{1 + jQ\left(\frac{\omega}{\omega_0} - \frac{\omega_0}{\omega}\right)} \tag{21}$$

Equation (13) can hence be rewritten as:

$$H_{XV}(\omega) = \frac{1}{Bl}\left[\frac{1 - R_{vc}/Z}{j\omega} - L_{vc}/Z\right] \tag{22}$$

Taking the limit of small ω in (21) leaves only $R_{vc}$. Substituting $Z=R_{vc}$ into (22) is indeterminate. Therefore the entire expression (21) is substituted into (22) and simplified. The first term within the square brackets in Equation (22) can be written as:

$$\frac{1 - R_{vc}/Z}{j\omega} = \frac{-L_{vc}R\omega^2 + LL_{vc}\omega\omega_0^2 j + L_{vc}R\omega_0^2 + LR\omega_0^2}{R_{vc}R\omega_0^2 - R_{vc}R\omega^2 + LR_{vc}\omega\omega_0^2 j - LL_{vc}\omega^2\omega_0^2 + LR\omega\omega_0^2 j - L_{vc}R\omega^3 j + L_{vc}R\omega\omega_0^2 j} \tag{23}$$

When the limit of Equation (23) is taken as $\omega \to 0$:

$$\frac{1 - R_{vc}/Z}{j\omega} = \frac{L_{vc}R + LR}{R_{vc}R} \tag{24}$$

Adding in the other term within the square brackets in Equation (22):

$$H_{XV}(0) = \frac{1}{Bl}\left[\frac{L_{vc}R + LR}{R_{vc}R} - \frac{L_{vc}}{R_{vc}}\right] = \frac{L}{R_{vc}Bl} \tag{25}$$

Substituting the values for L:

$$H_{XV}(0) = \frac{Bl}{R_{vc}} \frac{C_{MS} C_{AB}}{S_d^2 C_{MS} + C_{AB}} \tag{26}$$

When there are leaks in all the acoustic cavities, the DC excursion reduces to:

$$H_{XV}(0) = Bl\frac{C_{MS}}{R_{vc}} \tag{27}$$

This last result can also be derived by equating the magnetic force on the voice coil (BlI) to the restoring force from the mechanical compliance of the membrane ($Vx(0)/C_{MS}$). Writing I as $V/R_{vc}$, $BlV/R_{vc}=VH_{XV}(0)/C_{MS}$ is obtained, which yields the same result as (27).

The DC value hence depends on the combined compliance of the loudspeaker diaphragm ($C_{MS}$) and sealed back cavity ($C_{AB}$), the Bl product and the DC resistance of the voice coil. These values are not generally available and/or known so the DC value of the excursion transfer function is also not generally available and/or known a priori. The extrapolation to zero can be done by replacing all the values below about 350 Hz to the value at about 350 Hz or a weighted average of values around about 350 Hz.

6.3.2 The Excursion-from-Voltage FIR Filter

In order to facilitate real time processing in the excursion domain, an FIR (finite impulse response) filter can be formed giving the diaphragm excursion from the applied voltage. The tap weights are determined from the inverse Fourier Transform of the excursion-from-voltage transfer function. This result is depicted in FIG. 15.

Figure 15:
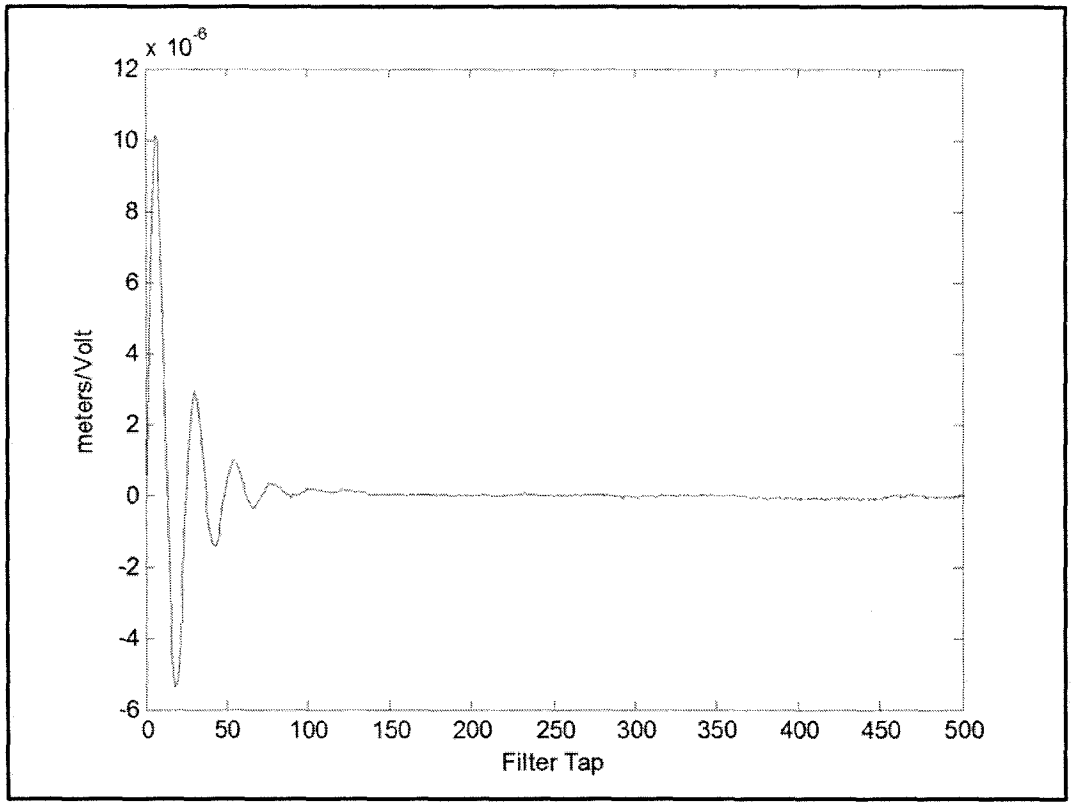
FIG. 15 depicts recovered excursion filter coefficients, according to non-limiting implementations.
Figure 16:
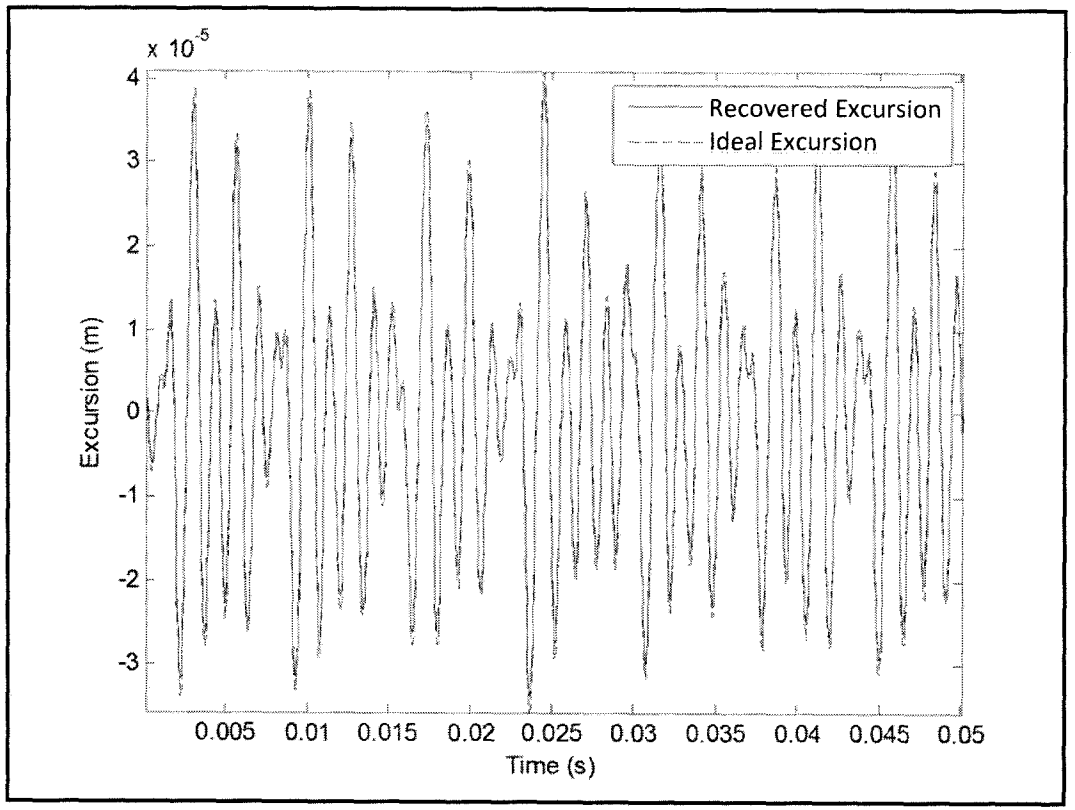
FIG. 16 depicts recovered and ideal excursion as a function of time, of a given input signal, according to non-limiting implementations.

Applying the filter depicted in FIG. 15 to the input voltage results in the excursion depicted in FIG. 16. FIG. 16 also depicts the expected excursion for the loudspeaker based on the Acoustic Circuit model.

6.4 Limiting the Excursion

Limits on the excursion of a loudspeaker will now be described. A simple form of soft limiting can be used as follows:

$$x_l(t) = x_{max}\tanh\left(\frac{x(t)}{x_{max}}\right) \tag{28}$$

The term "soft" as used herein with regard to "soft" limiting, refers to the behaviour of functions such as the tan h function in (28). These functions never reach one (i.e. "1"), but get closer as their argument grows larger. This is in contrast to a "hard limiter" or "clipping" limiter that outputs one whenever the argument is greater or equal to one.

Figure 17:
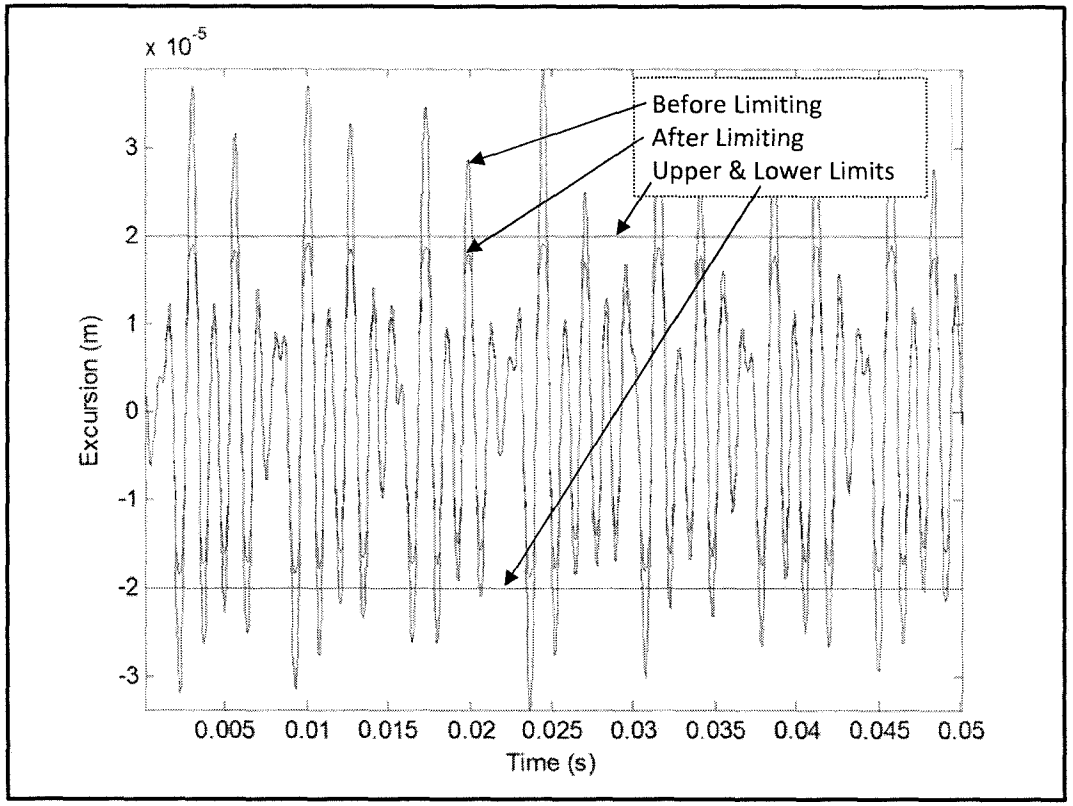
FIG. 17 depicts excursion as a function of time, of a given input signal, before and after excursion limiting, according to non-limiting implementations.

Choosing a quite aggressive $x_{max}=2\times10^{-5}$ the results of this limiting function are depicted FIG. 17.

6.5 Derivation of the Voltage-from-Excursion Transfer Function

Construction of a voltage signal which when applied to the loudspeaker, would produce this compressed excursion is now described. In other words, the excursion-from-voltage transfer function depicted in FIG. 12 is inverted. Before starting this discussion, however a review of an ideal excursion from the theory of loudspeakers is provided hereafter.

From the theory of loudspeakers, the amplitude of the ideal excursion is given by (29):

$$x \propto \frac{1}{F\sqrt{1+Q^2\left(F-\frac{1}{F}\right)^2}} \tag{29}$$

Where:

$$F = \frac{\omega}{\omega_0}$$

is the normalized frequency $$Q = \frac{\omega_0 M_{AS}}{R}$$

$$\omega_0 = \frac{1}{\sqrt{M_{AS}C_{AS}}}$$

is the resonant angular frequency of the loudspeaker $M_{AS}$ is the acoustic mass of the loudspeaker diaphragm $C_{AS}$ is the acoustic compliance of the loudspeaker suspension R is the acoustic resistance due to the electrical and mechanical resistance Hence, for the ideal excursion curve in (29), the excursion-from-voltage transfer function is approximately inversely proportional to frequency above resonance:

$$x = \frac{x_0}{F^2} \text{ for } F >> 1 \tag{30}$$

Inverting this transfer function will result in unrealizable gain applied at frequencies much higher than resonance. Given the limited signal-to-noise and numerical precision of present implementations, this inversion is expected to fail at high frequencies. However, in present implementations, the transfer function that reduces the amplitude of components at these frequencies also reduces their impact on the excursion. Hence, frequencies high enough that the impact on the excursion is negligible can be filtered out of the voltage-from-excursion transfer function. This frequency limit $f_1$ is determined below. When the inversion process is complete for the lower frequencies, the higher frequencies can be added in by high-pass filtering the input signal (because components at these high frequencies do not significantly affect excursion).

The calculated excursion-from-voltage transfer function, as described above, can be used as a starting point, and it can be represented as amplitude and phase angle.

Determining of a frequency $f_1>>f_0$ can occur above which it is not expected to find any signal which would significantly affect the excursion. Such a frequency comprises a dovetail frequency (i.e. a frequency above which it is not expected to find any signal which would significantly affect the excursion). This value will be approximately where the transfer function first drops to 12 dB below its DC value. Alternatively values lower than about 12 dB, including, but not limited to, about 8 dB, or values higher than about 12 dB, including, but not limited to about 16 dB to about 18 dB or more can be more suitable for particular implementations.

Figure 18:
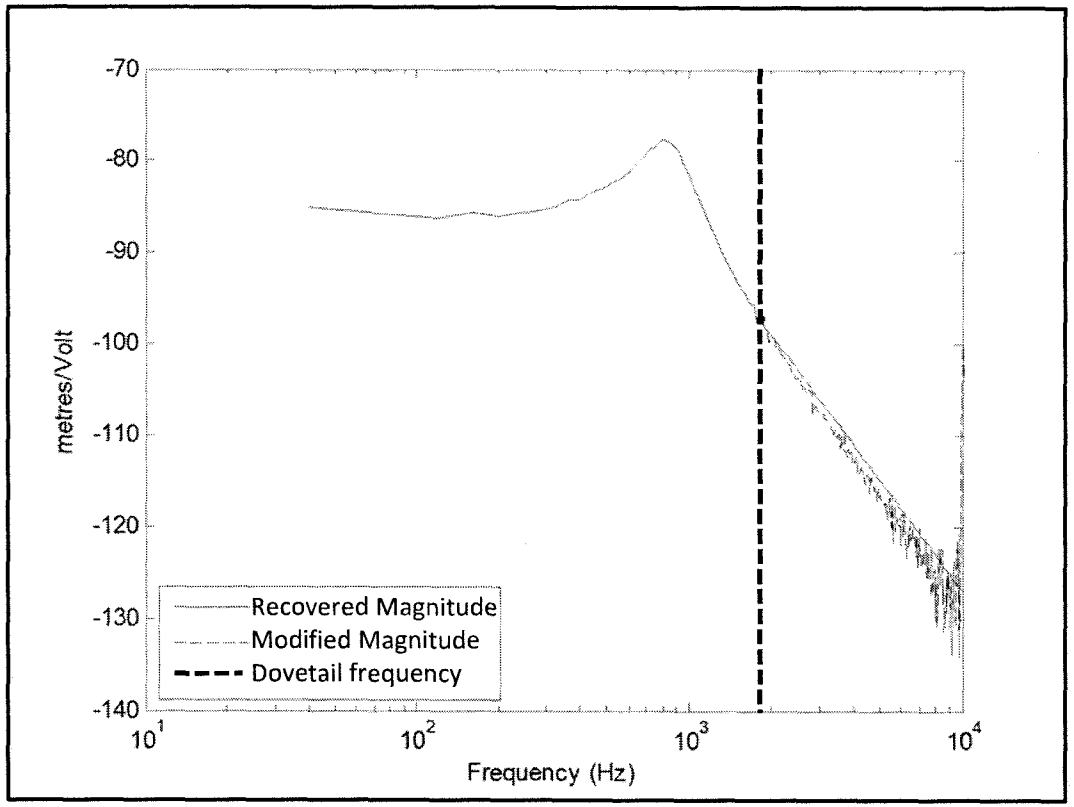
FIG. 18 depicts an ideal $x \propto 1/f^2$ response dovetailed onto the transfer function at a frequency, $f_1$, according to non-limiting implementations.

Discarding of the portion of the transfer function amplitude above $f_1$ can occur. Dovetailing of an ideal $x\propto1/f^2$ response onto the transfer function can occur at $f_1$ as depicted in FIG. 18. This procedure ensures that there are no zeros in the transfer function due to noise and/or precision errors.

Figure 19:
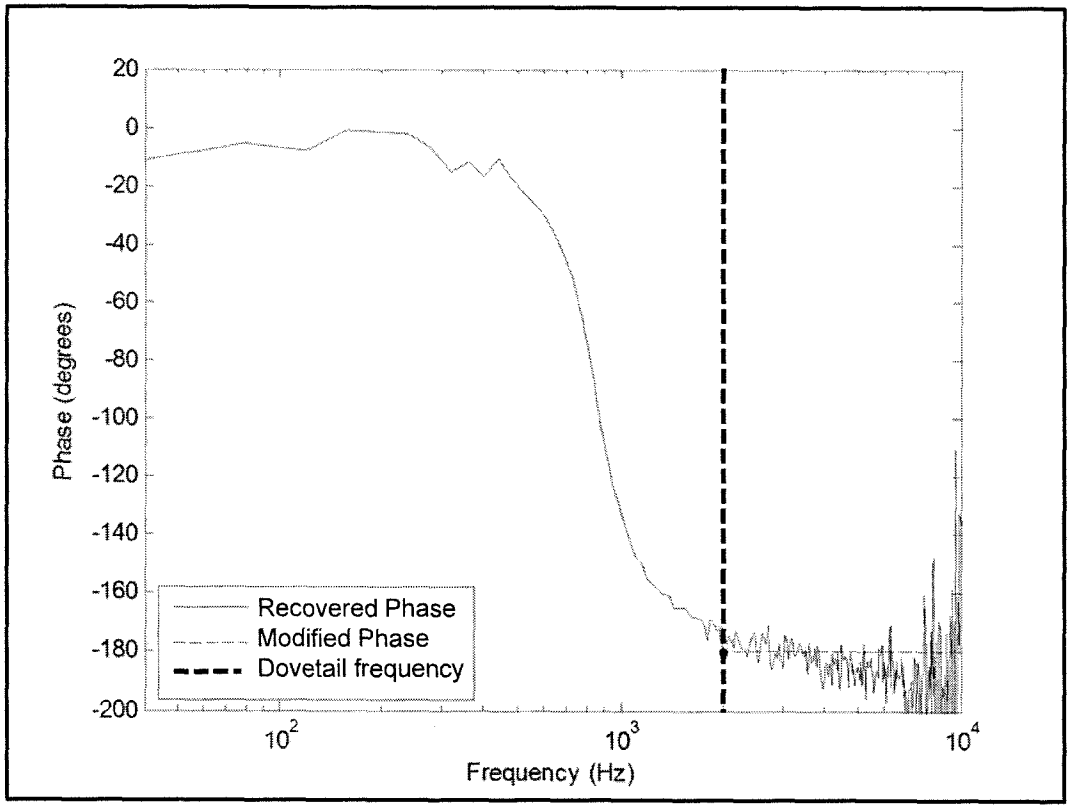
FIG. 19 depicts a portion of the transfer function phase above $f_1$ replaced with the value $-\pi$ (its asymptotic value from the theory), according to non-limiting implementations.

Replacing the portion of the transfer function phase above $f_1$ with the value $\pi$ (its asymptotic value from the theory), can occur, as depicted in FIG. 19.

Figure 20:
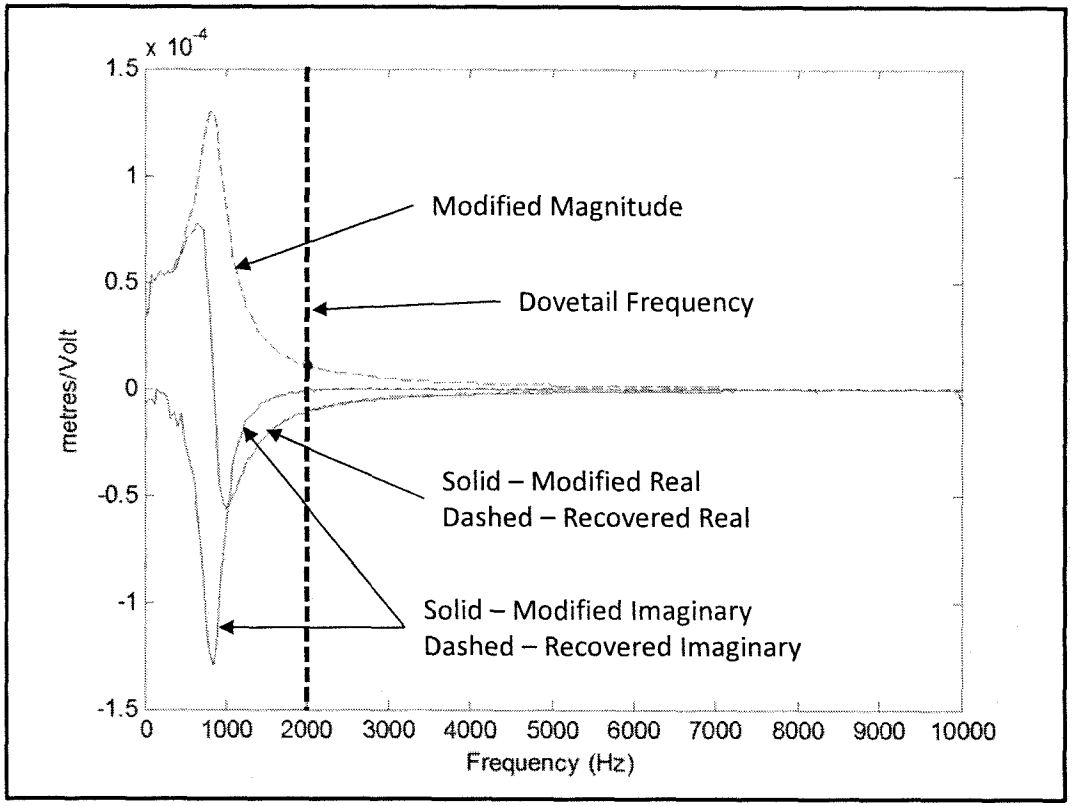
FIG. 20 depicts a modified excursion-from-voltage transfer function produced by converting an amplitude/phase representation of the transfer function to a complex number representation, according to non-limiting implementations.

Converting the amplitude/phase representation of the transfer function back to the complex number representation can occur. This can result in a "modified excursion-from-voltage transfer function" as depicted in FIG. 20.

The presently described scheme multiplies the inverse transfer function with a "bounding function" to keep it bounded at high frequencies. A complementary filter to the described "bounding function" can then be constructed to reconstitute these high frequencies from the original content (since these do not contribute to the excursion).

In general, most and/or all signals which significantly affect the excursion are below $f_1$. The "bounding function" can therefore be unity below $f_1$. Above $f_1$, the inverse transfer function rises proportional to $f^2$. To ensure the inverse transfer function is bounded, the "bounding function" can therefore decrease faster than this. It was found that the following "bounding function" worked well:

$$G(f) = \begin{cases} 1 & \text{for } f \le f_1 \\ \left(\frac{f_1}{f}\right)^6 & \text{for } f > f_1 \end{cases} \tag{31}$$

Figure 21:
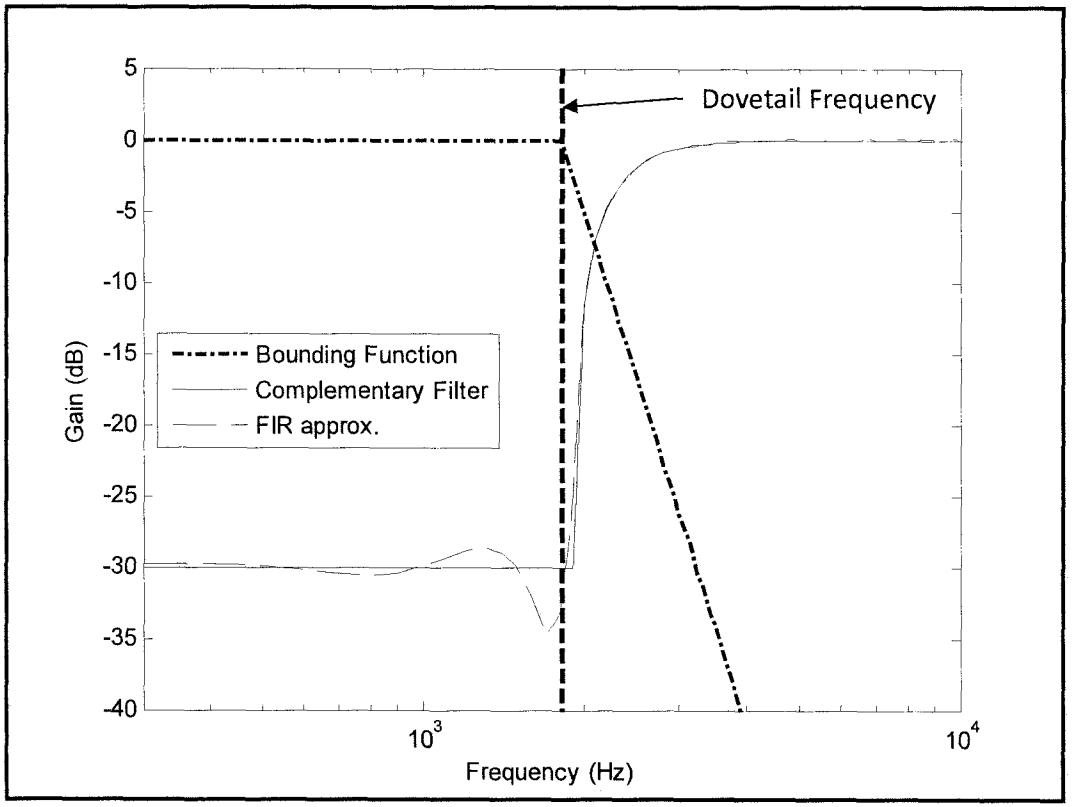
FIG. 21 depicts a bounding function ($G(f)$), a limited complementary filter ($1-G(f)$) and an FIR approximation, according to non-limiting implementations.

A complementary filter to reinstitute the high frequencies can be used. The tap weights for an FIR version of this filter can be calculated from the inverse Fourier transform of (1−G(f)). The lower bound of (1−G(f)) was limited to −30 dB in order to get a better overall FIR approximation. The bounding function (G(f)), the limited complementary filter (1−G(f)) and the FIR approximation are depicted in FIG. 21.

The voltage-from-excursion transfer function can then be obtained by dividing the bounding function by the modified excursion-from-voltage transfer function. Any zero crossings from noise will be eliminated by the dovetailed ideal modification and the bounding function will keep the inversion bounded. The result is depicted in FIG. 22.

Figure 22:
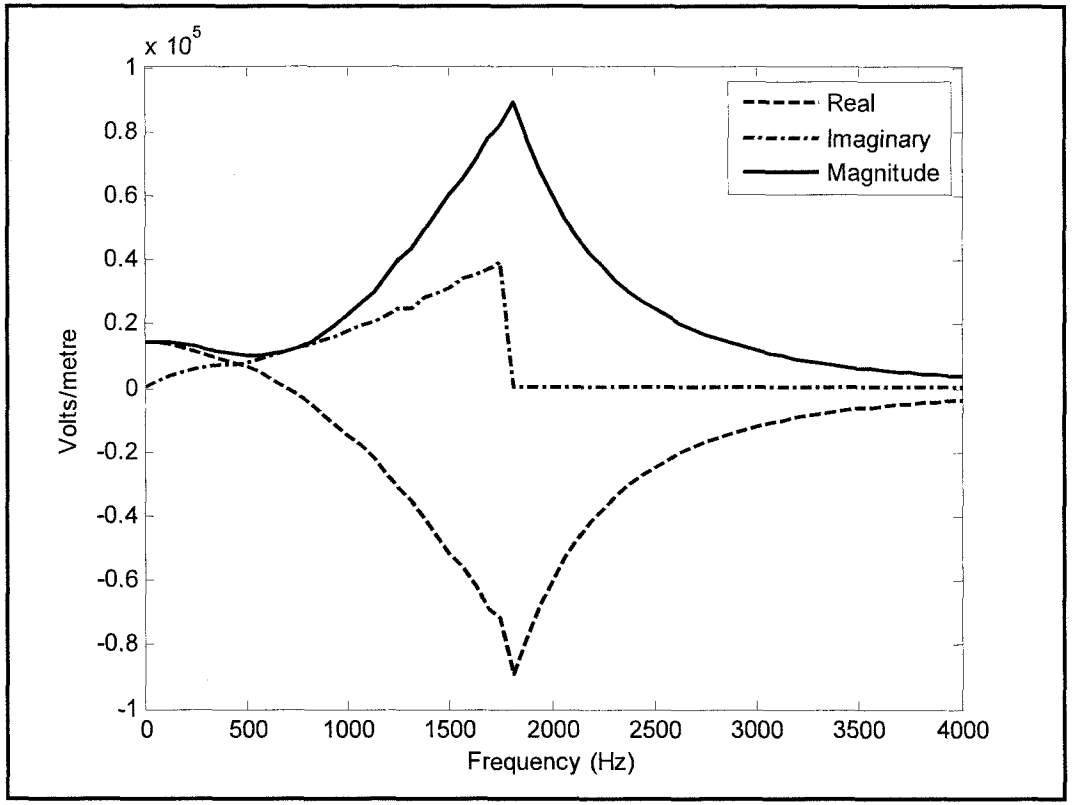
FIG. 22 depicts a voltage-from-excursion transfer function, according to non-limiting implementations.
Figure 23:
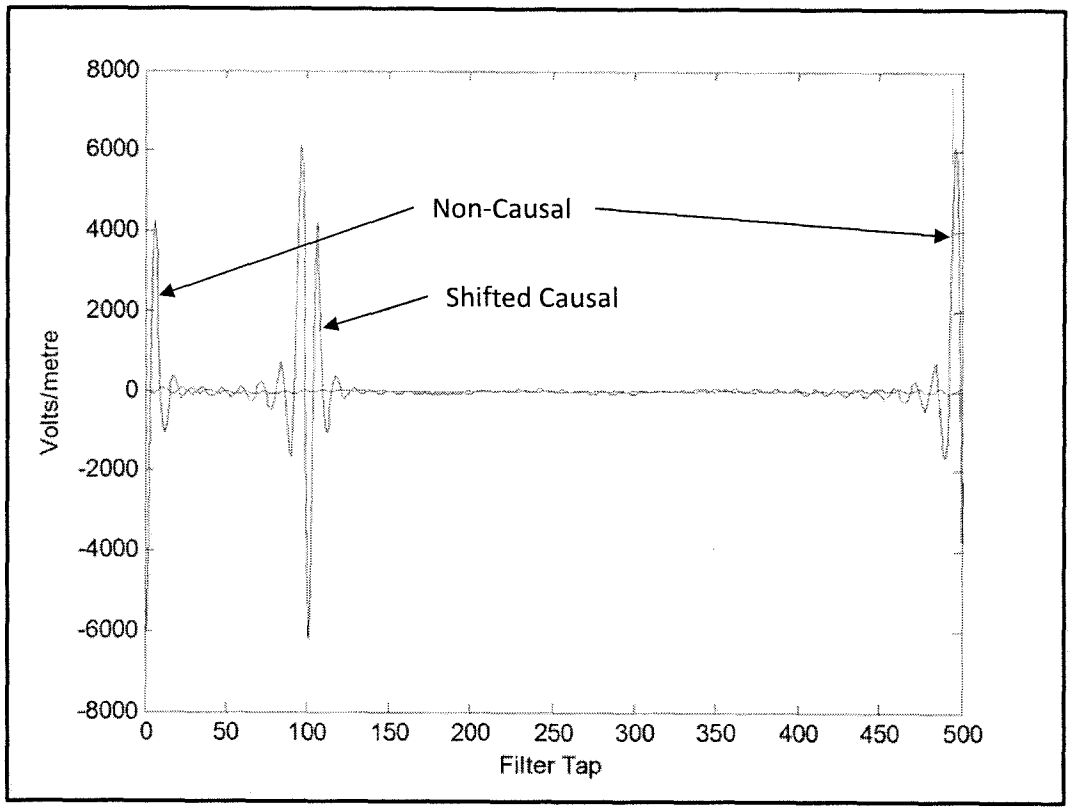
FIG. 23 depicts filter coefficients derived from an inverse Fourier transform of the transfer function of FIG. 22, as well as a delayed version of the filter coefficients, according to non-limiting implementations.

Generating an FIR filter can then occur, that will apply the voltage-from-excursion transfer function depicted in FIG. 22. The coefficients are given by the inverse Fourier transform of the transfer function. This filter is, in general not causal and the output is generally delayed in order to provide a working filter. The coefficients and the delayed version are both depicted in FIG. 23.

Application of a low pass filter onto the voltage-from-excursion transfer function can occur in order to keep it bounded upon inversion. However, there are generally no components in the frequency band above $f_1$ which will significantly change the excursion; hence, application of the high pass filter (depicted in FIG. 21, labelled "Complementary Filter") to the original voltage signal can occur and it can be added it to the output of the voltage-from-excursion transfer function to reconstitute the high frequency band. Before adding, however, the output of the filter can be delayed by the same amount as a delay of the voltage-from-excursion filter.

Figure 24:
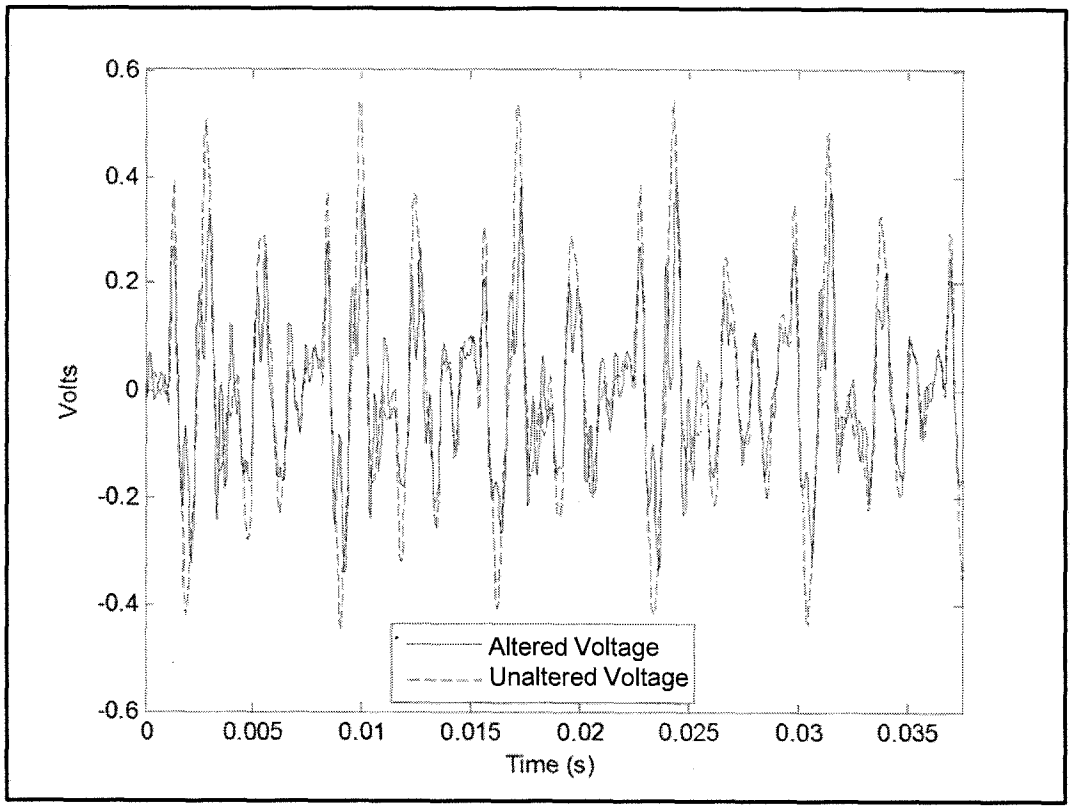
FIG. 24 depicts a sample of an unfiltered voltage signal and a filtered voltage signal, according to non-limiting implementations.

6.6 Verification of the Voltage-from-Excursion Transfer Function 6.6.1 Voltage Drive Requirements A sample of the resulting voltage signal is depicted in FIG. 24. It can be seen from FIG. 24 that the voltage signal used to produce the compressed excursion curve is not much different in RMS (root mean square) or peak level from the original voltage signal. In other words, the output amplifier is not be tasked to obtain higher values due to the excursion compression.

Figure 25:
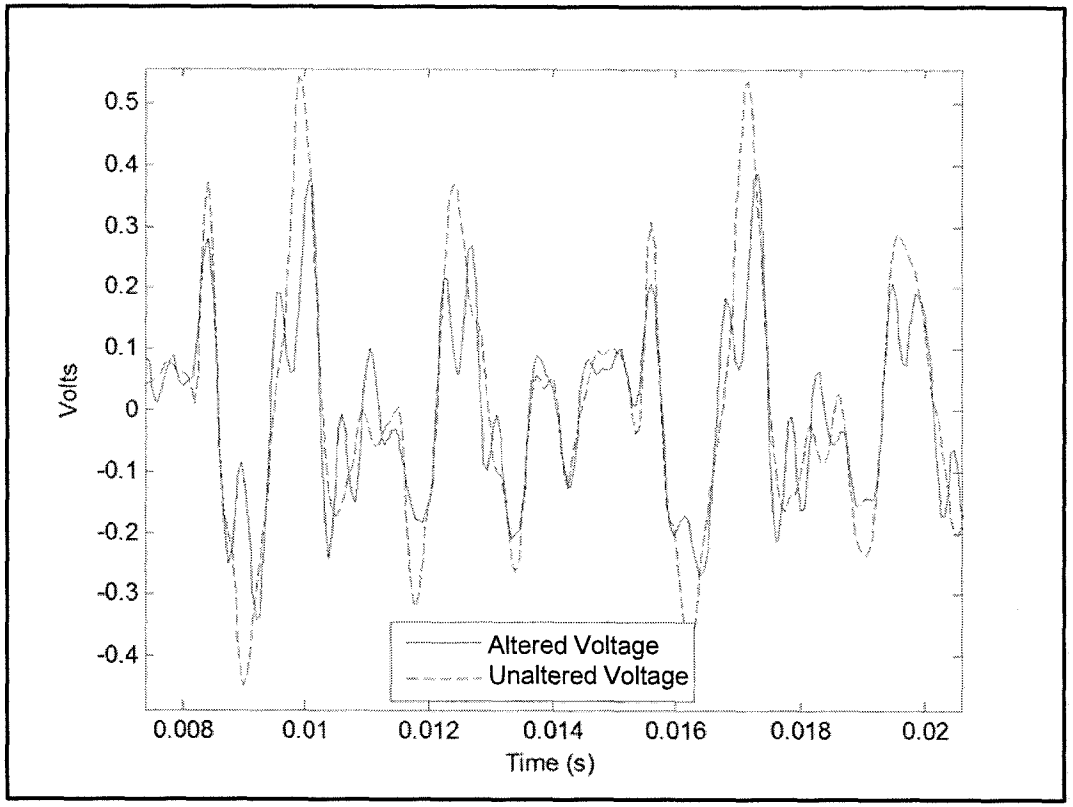
FIG. 25 depicts a magnified sample of the voltage signal used to produce compressed excursion, according to non-limiting implementations.

A magnified sample of the voltage signal used to produce compressed excursion is depicted in FIG. 25, which depicts that the compressed excursion signal can reverse direction at the peaks, slowing down the motion of the diaphragm.

6.6.2 Verification of Excursion Limiting

Figure 26:
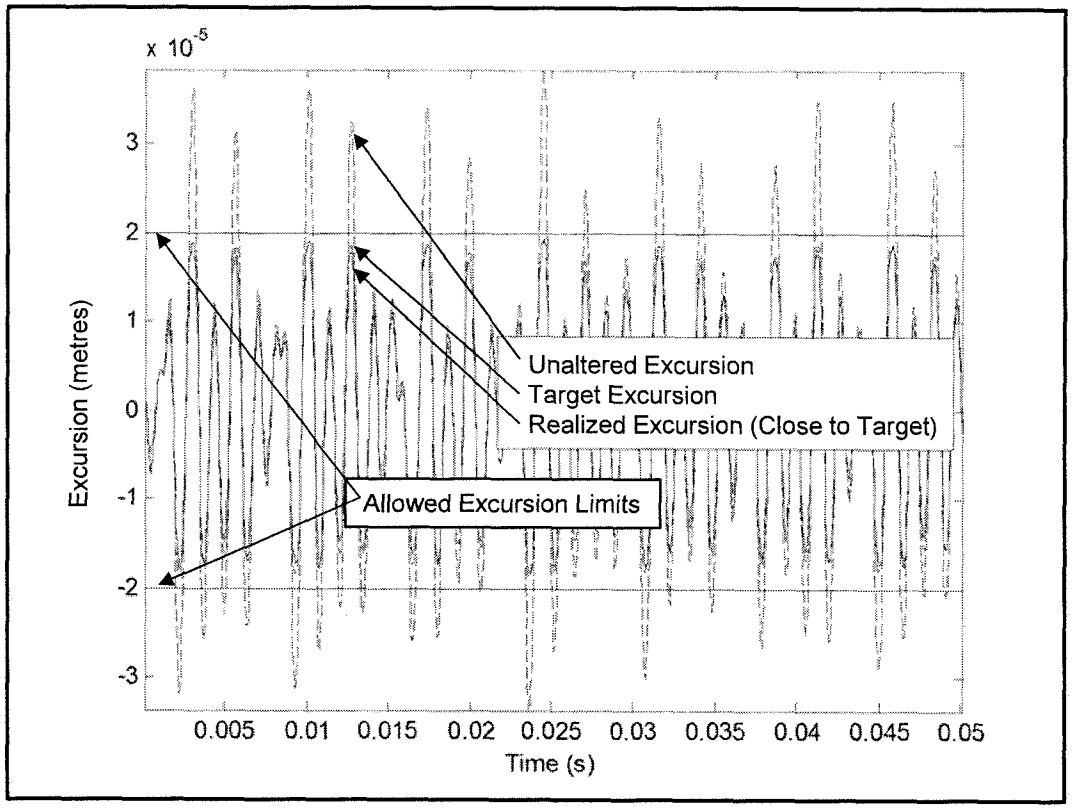
FIG. 26 depicts an excursion produced by applying the voltage depicted in FIG. 25 to a loudspeaker (using the transfer function from an Acoustic Circuit Model), according to non-limiting implementations.

Applying the voltage depicted in FIG. 25 to the loudspeaker (using the transfer function from the Acoustic Circuit Model) results in the excursion depicted in FIG. 26. Compressed excursion is depicted for comparison. Hence, the voltage-from-excursion transfer function derivation process is appreciated to be effective.

6.6.3 Listening Tests

Several audio files were played through the algorithm in a successful prototype to ensure there were no deleterious artifacts generated by the algorithm.

It was found that when the input signal contained components at low frequencies as well as high, the low frequency components modulated the higher frequencies back and forth over the compression line. The compression algorithm is then applied periodically to the high frequencies. This produced an annoying "distorted ringing" artifact. However, when the low frequencies are filtered out in a way consistent with the response of a "typical microspeaker" (for example, using $4^{th}$ order Butterworth high pass at 400 Hz) the artifact essentially disappears and the algorithm gives only the distortions one would expect from compressed audio. With minimal distortions, it delivers an increase of over 10 dB in the SPL (sound pressure level) while still holding the excursion below the specified limit.

The results of the listening tests are provided in Table 1:

TABLE 1

Distortion Artifact Dependence

| High Pass Freq (Hz) | Impression at 6 dB Compression | Impression at 12 dB Compression |
|---|---|---|
| 50 | annoying | annoying |
| 100 | noticeable | annoying |
| 200 | barely noticeable | noticeable |
| 300 | not noticeable | noticeable |
| 400 | not noticeable | not noticeable |

In some implementations, when this algorithm is used with low and high frequency content, the band could be split again and independent compression could be performed for the high amplitude frequencies below the approximately 400 Hz mentioned above.

7 Off-Line Processing Loudspeaker Implementation

In lieu of a DSP (digital signal processor), verification of the algorithms described herein can be performed using off-line processing of measurements of a real loudspeaker on a lab bench.

7.1 Calibration Procedure

Figure 27:
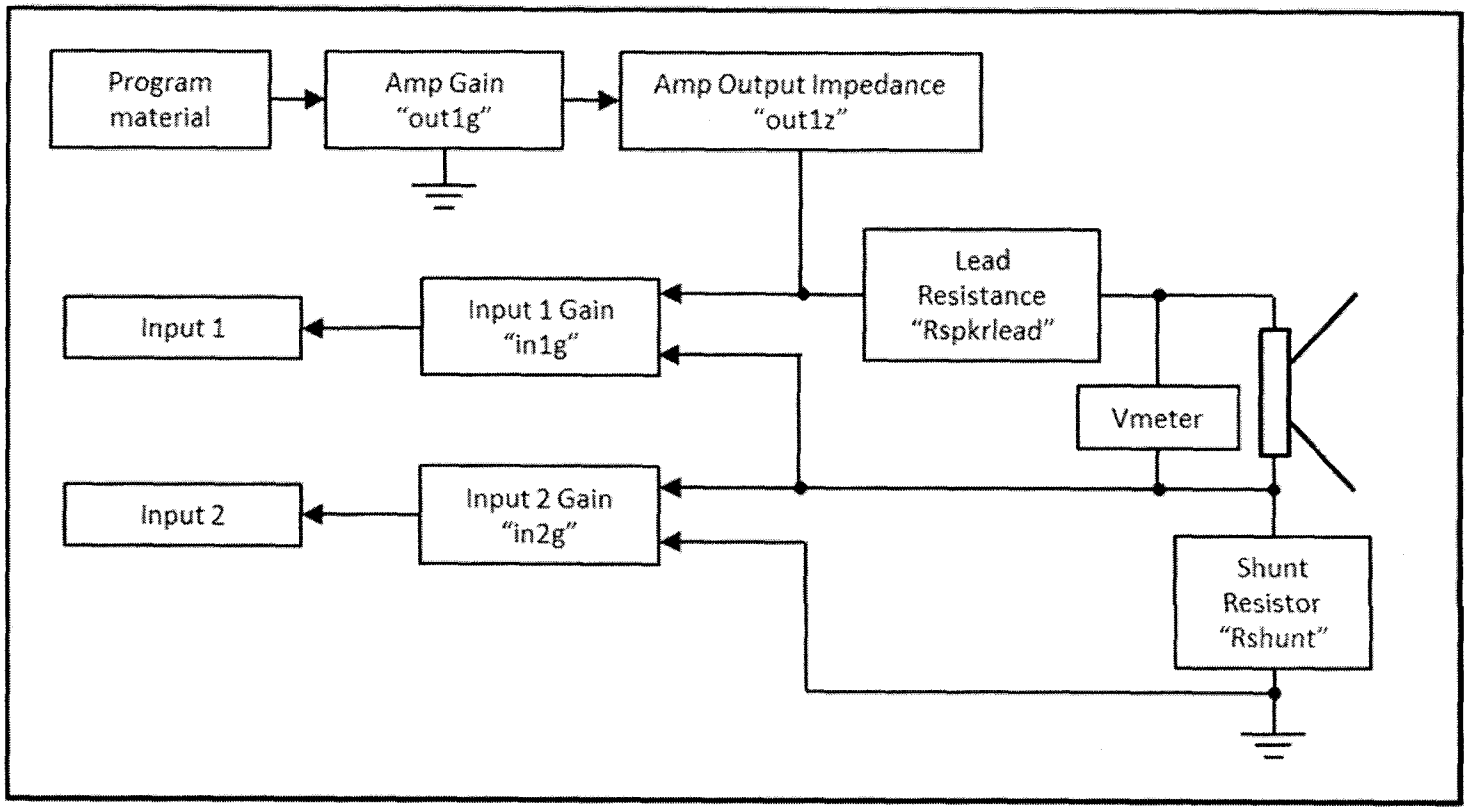
FIG. 27 depicts an experimental setup used to test algorithms described herein, according to non-limiting implementations.

Specifically, the setup depicted in FIG. 27 as be used to verify the algorithms described herein, and has several parameters to be determined before the loudspeaker voltages and currents can be derived. These calibration parameters were determined from measurements using an external AC (alternating current) voltmeter and a calibrated resistor. Calibration measurements are performed at a frequency of 300 Hz and 1 kHz.

In the calculations below,

Output1=RMS value of numbers in the software output vector sine wave

Input1=RMS value of numbers in the software read from input 1

Input2=RMS value of numbers in the software read from input 2

Vmeter1=RMS reading from the external voltmeter in step 1

Vmeter2=RMS reading from the external voltmeter in step 2

Vmeter3=RMS reading from the external voltmeter in step 3

Rcal=resistance of calibrated resistor (~22Ω)

Parameters used were:

Rshunt=Shunt resistance (~1Ω)

roughdelay=Estimate of delay between the start of the recording and the application of the stimulus (~0.44 sec). This estimate is hence selected to be too large.

out1g=Output gain: ratio of the open circuit voltage to Output1 (~0.87)

in1g=Input 1 gain: ratio of Input1 to Vmeter1 (~0.09)

in2g=Input 2 gain: ratio of Vmeter2 to Vmeter2 (~0.90) (external amp used)

out1z=Effective output impedance of the amplifier including connection lead (~0.21Ω)

Rspkrlead=Resistance of the connection between the VI box and the loudspeaker (~0.11Ω)

Step 1: Connect the open circuit loudspeaker leads to the voltmeter and apply a stimulus voltage. Then:

$$\text{out1}g = \frac{V\text{meter1}}{\text{Output1}} \tag{32}$$

and $$\text{in1}g = \frac{\text{Input1}}{V\text{meter1}} \tag{33}$$

Step 2: Temporarily switch input 2 and input 1 and repeat the measurement. Then:

$$\text{in2}g = \frac{\text{Input2}}{V\text{meter2}} \tag{34}$$

Step 3: Input 2 and input 1 are switched back and reconnected to the voltmeter and across a calibrated resistor Rcal (currently 22.06Ω). When another measurement is taken, $$Rshunt = \frac{\text{Input2}/\text{in2}g}{\text{Current}} \tag{35}$$

where $$\text{Current} = \frac{V\text{meter3}}{Rcal} \tag{36}$$

and assuming for that the output impedance is resistive:

$$\text{out1}z = \left(\frac{V\text{meter1} - V\text{meter3}}{\text{Current}}\right) - Rspkrlead - Rshunt \tag{37}$$

7.2 Taking Measurements

When taking measurements, the calibration factors account for the measurement setup depicted in FIG. 27. In order to determine the electrical current-from-voltage transfer function of the loudspeaker, the voltage across it ($V_{spkr}$) and the current through it ($I_{spkr}$) are determined.

From FIG. 27 it is apparent that:

$$I_{spkr} = \frac{\text{Input2}}{\text{in2}g \cdot R_{shunt}} \tag{38}$$

and $$V_{spkr} = \frac{\text{Input1}}{\text{in1}g} - I_{spkr}R_{lead} \tag{39}$$

7.3 Loudspeaker Stimulus

Figure 28:
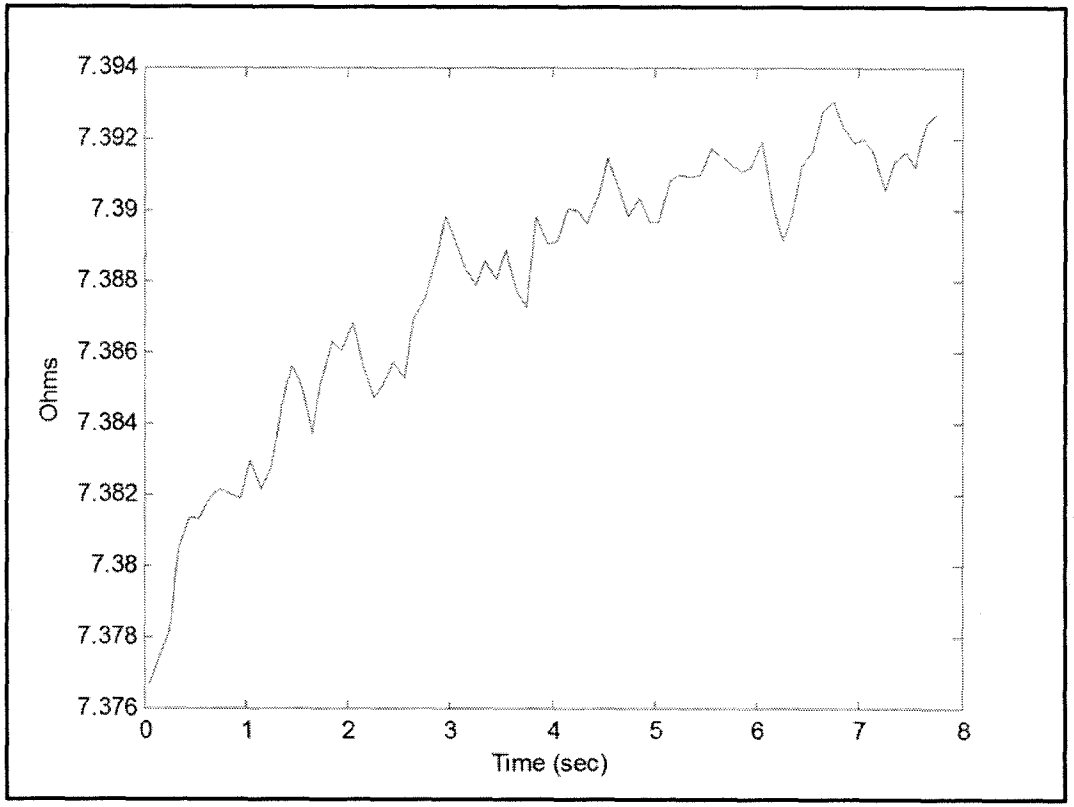
FIG. 28 depicts resistance of a voice coil as a function of time, according to non-limiting implementations.
Figure 29:
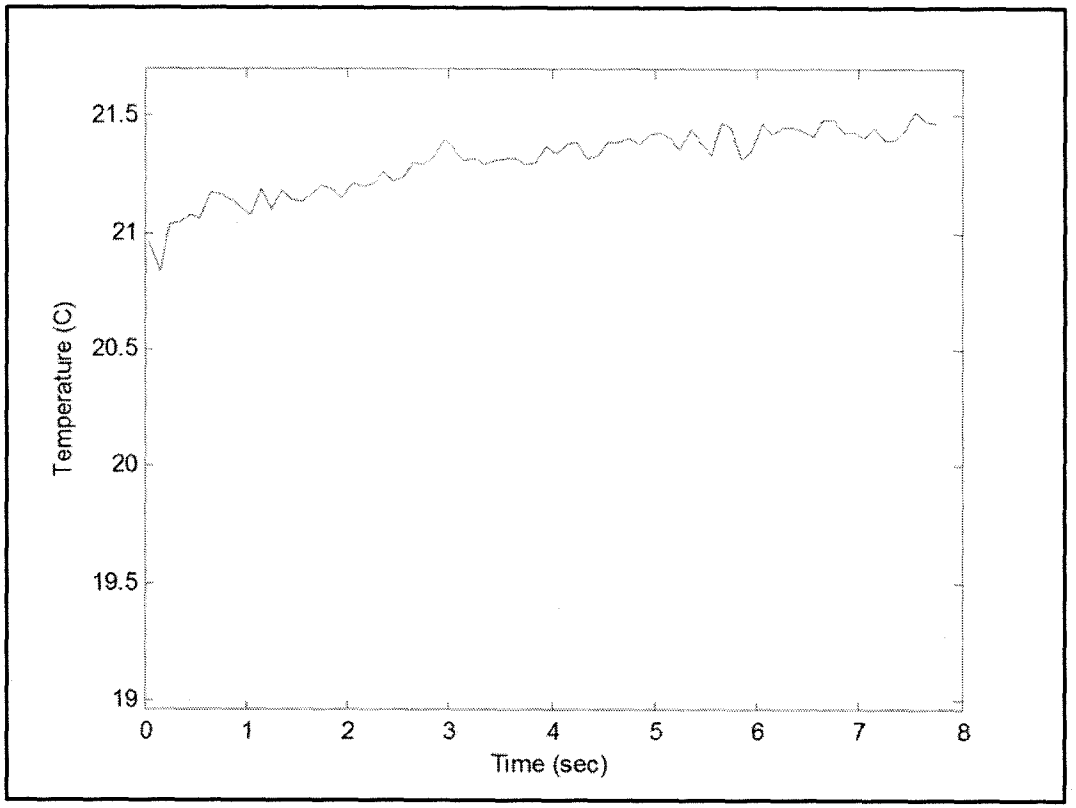
FIG. 29 depicts temperature corresponding to the resistances of the voice coil of FIG. 28 as a function of time, according to non-limiting implementations.

In a prototype of a loudspeaker, corresponding to the setup depicted in FIG. 27. A Gaussian white noise stimulus was used to stimulate and/or operate the loudspeaker in the setup of FIG. 27. Because the analysis occurred off-line, the stimulus amplitude was kept low enough so that the change in the voice coil resistance due to heating did not appreciably affect the results. In particular, the stimulus amplitude was kept low enough to keep the resistance from changing more than 0.05Ω over the stimulus, so the resistance could be treated as a constant. As can be seen in FIG. 28, a 0.4 Vrms source increased the voice coil resistance approximately 0.02Ω over an 8 second stimulus. The corresponding temperature rise is depicted in FIG. 29.

7.4 Results for Loudspeaker on a Lab Bench

The corresponding graphs for a loudspeaker on a lab bench were then measured and calculated. The results were similar to those calculated from the virtual loudspeaker transfer functions.

7.5 Applying the Excursion Compressed Signal

The algorithm described herein calculates the voltage which should appear at the loudspeaker in order for proper excursion compression. However, as can be seen in FIG. 27 the program material signal is not the loudspeaker voltage. Hence, we must account for the amplifier gain ($A_{amp}$), the amplifier output impedance ($Z_{amp}$), including the resistance of the connecting cable, the loudspeaker lead resistance ($R_{lead}$), and the shunt resistor ($R_{shunt}$).

Indeed, all these factors were accounted for when program material from loudspeaker voltage transfer function ($H_{PL}$) was processed and/or analyzed. Application of this transfer function to the calculated loudspeaker voltage can occur and it can be provide a "pre-distorted" signal so that when applied as program material, the calculated voltage would appear at the loudspeaker. One way (which can also be quite comprehensive) to derive this is to use Frequency Domain LMS (least means square) (the same methodology used to derive the electrical current-from-voltage transfer function). However, it can be easier and sufficient to approximate the transfer function from the known parameters and a few assumptions.

Specifically, it can be assumed that the amplifier output impedance ($Z_{amp}$), the lead impedance ($R_{lead}$) and the shunt resistance ($R_{shunt}$) are all resistive When so, they can all be determined using a calibration procedure and/or measured in-situ. In some implementations, they can be constant and can be programmed into a device using the methods and/or algorithms described herein at manufacturing time and/or during a provisioning procedure. Loudspeaker voltage can hence be expressed as:

$$V_{spkr}=A_{amp}V_{pm}-I_{spkr}(Z_{amp}+R_{lead}+R_{shunt}) \tag{40}$$

Further, the electrical current-from-voltage transfer function of the loudspeaker ($H_{IV}$) can be determined, hence the loudspeaker current can be expressed as as $I_{spkr}=V_{spkr}H_{IV}$, giving approximate program material from loudspeaker voltage transfer function as:

$$H_{PL} = V_{spkr}\frac{(1 + H_{IV}(Z_{amp} + R_{lead} + R_{shunt}))}{A_{amp}} \tag{41}$$

In practice, $H_{IV}$ may be known up to a frequency used for the excursion calculation. However, by definition, this is well past the resonant frequency of the loudspeaker and can be approximated as:

$$H_{IV} \approx \frac{1}{R_{vc} + i\omega L_{vc}} \tag{42}$$

In implementation described herein, this crossover frequency was determined to be about 8 kHz.

In general, $H_{IV}$ can be dependent on the loudspeaker acoustic environment, thermal environment and the power applied to it. In the lab bench experiment, these are all considered constant.

Figure 30:
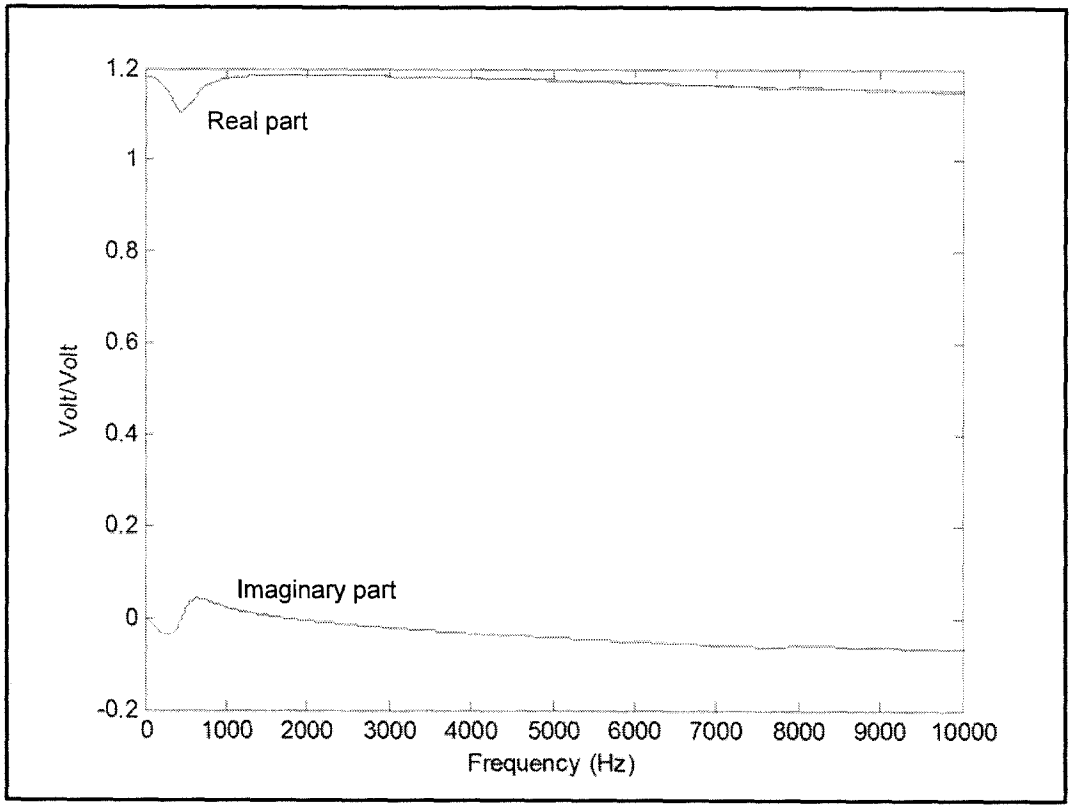
FIG. 30 depicts a correction for external components, according to non-limiting implementations.

It can be expected that the real part of $H_{PL}$ would be close to one and the imaginary part close to zero. A typical $H_{PL}$ is depicted in FIG. 30.

Figure 31:
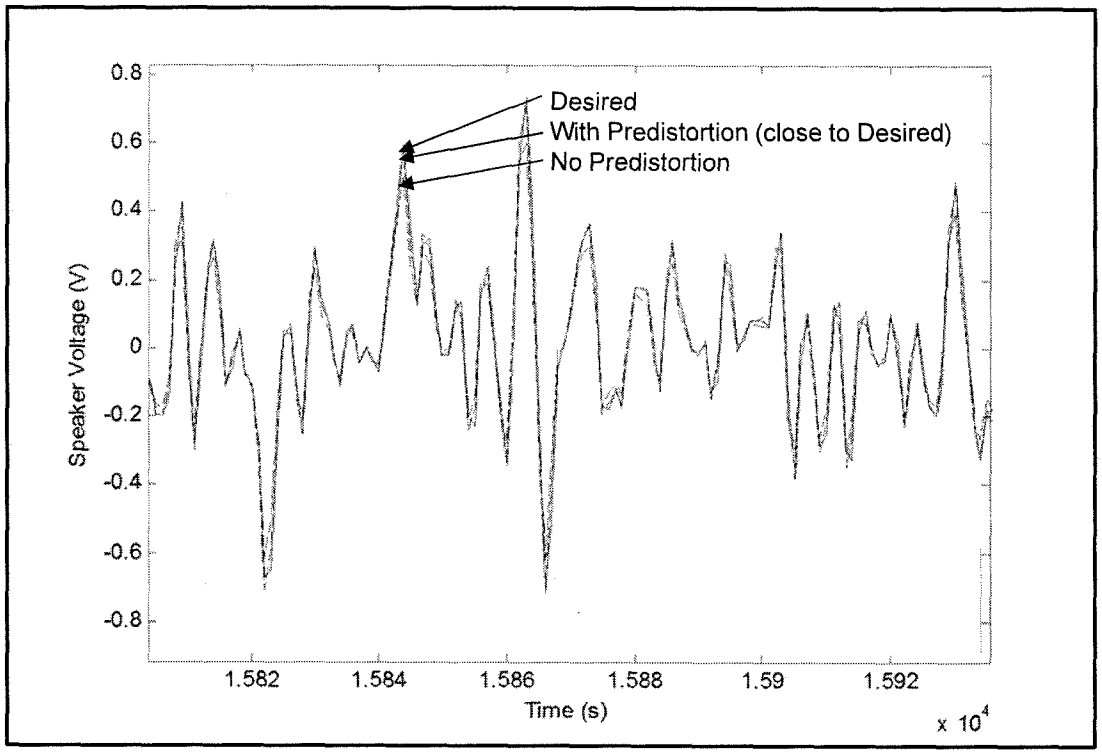
FIG. 31 depicts a loudspeaker voltage before and after correcting for external components, according to non-limiting implementations.

A noise stimulus was played with and without the pre-distortion. The applied voltage on the loudspeaker was measured both times. The results are depicted in FIG. 31. It is apparent from FIG. 31 that the pre-distorted applied voltage resulted in a closer match to the desired voltage on the loudspeaker. The more important changes occur at frequencies where excursions are being limited and it can be important to properly apply the calculated voltage, however this is not readily evident in FIG. 31 because of the presence of large amplitude content at all frequencies. Still FIG. 31 serves to depict the effect of pre-distortion.

8 Implementation Details 8.1 Decimation

For a practical implementation, the bandwidth of the calculation need not be determined by the inherent sample rate. For example, the loudspeaker voltage and current can be available at a sample rate of about 48 kS/s. The bandwidth of the calculation hence can be carried out to about 4 kHz, so the input signal can be decimated by a factor of about 6.

Figure 32:
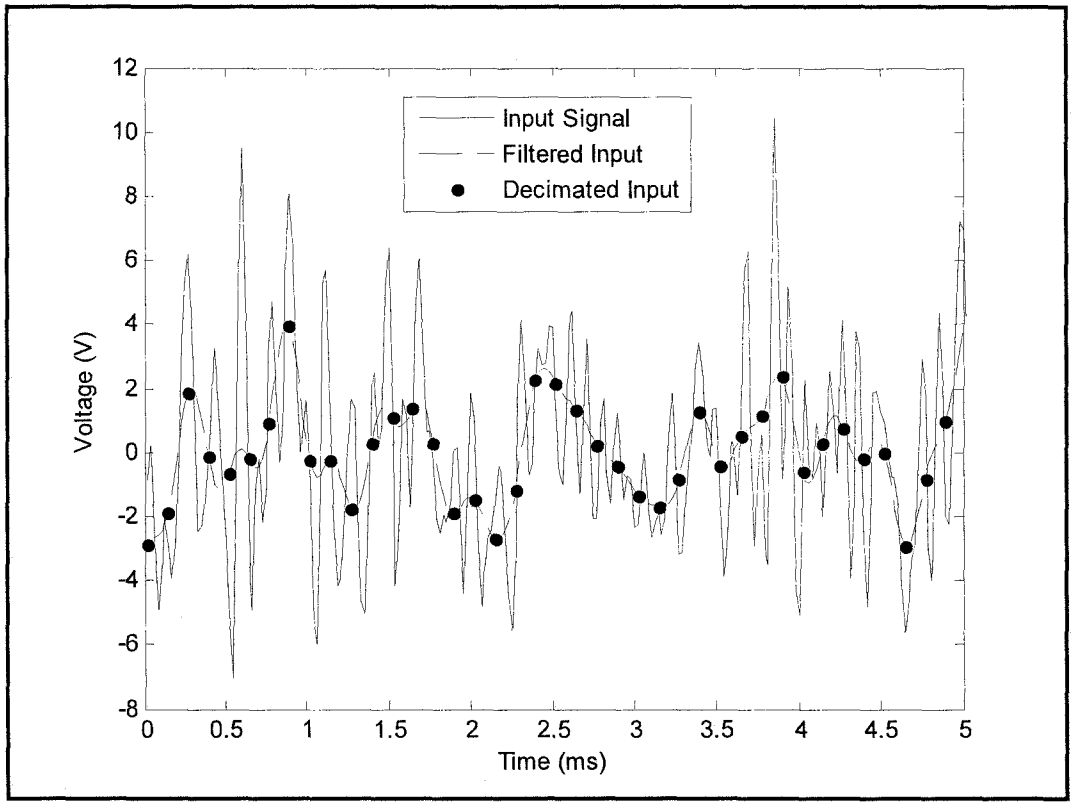
FIG. 32 depicts a decimation process, according to non-limiting implementations.

A $60^{th}$ order low pass decimation filter at the sampling frequency was designed using MATLAB™ "fir1" routine. The filter coefficients were then used to construct a Direct-Form II tap delay filter. After the filter, every $6^{th}$ sample was taken to form the decimated signal as depicted in FIG. 32. The time difference between decimated samples is 1.25e−4 s corresponding to a sampling frequency of 8 kS/s. This decimation operation was carried out for the electrical current samples as well as the voltage samples.

9 Independent Monitoring and Checks

Excursion and temperature limiting can result in electrical power applied to the loudspeaker significantly larger than traditional limits allow. This is because the algorithm described herein can tell that those larger power levels will not cause the loudspeaker to extend beyond its maximum excursion or temperature. However, when errors occur in the algorithm, or when conditions change on a time scale faster than the algorithm can respond to, loudspeaker damage can result.

Hence, this section describes some independent checks on the signals that can be referred to as "Sentinels", which can be implemented as hardware, software and/or a combination. When any sentinel detects that the algorithm is not capable of reliably predicting the excursion, the system (i.e. a DSP and/or a loudspeaker control system processing the algorithm) can switch over to a "Fallback Arm" which can limit the voltage to the loudspeaker as specified by a manufacturers' specified voltage limiting. Larger signals can be applied once a sentinel determines that data is consistent with what is expected by the algorithm, and hence there is assurance that the algorithm is responding in a proper way. This is depicted in the Block diagram of FIG. 64, described below.

9.1 Unconverged Electrical Current Transfer Function

The Electrical Current-from-Voltage transfer function can be determined by a frequency domain LMS (Least Mean Square) algorithm. The transfer function can be determined roughly every 8 ms or so. The algorithm can determine the transfer function at a particular frequency bin only when the stimulus contains frequency components within that frequency bin. To stop the algorithm from analyzing noise, the algorithm senses a minimum power in a particular frequency bin before it will alter the last determination of the transfer function at that bin.

When the algorithm begins, it is not necessarily known when the transfer function has sufficiently converged at each frequency bin. This is complicated by non-linearities in the amplifier (or other analog in-line components) which generate signals in bins even when there is no content there from the program material. This problem is especially acute when the program material begins with a spectrally sparse signal.

A sentinel can be provided that determines when the Electrical Current Transfer Function has sufficiently converged.

One method is to count, for each frequency bin, the number of times the power has exceeded the minimum value.

9.2 Loudspeaker Transfer Function Sentinel

In some implementations, a loudspeaker can respond to a change in loudspeaker transfer function faster than about 10 ms. An example is when a user blocks a loudspeaker output port with a finger. In this example, the effective back cavity volume is significantly reduced, the resonant frequency increases and the power required to obtain the same excursion goes up significantly. A dangerous situation can arise when the finger is quickly removed. For about the next 10 ms or so, the algorithm can use the transfer function of the smaller back cavity and accordingly apply low frequency signals large enough to damage the loudspeaker. This problem can arise when acoustic conditions on the loudspeaker change faster than the algorithm can respond.

One way to quickly identify changes in the loudspeaker conditions is to monitor the current to the loudspeaker and ensure that the electrical current-from-voltage transfer function models it correctly. This can be done by building an FIR filter from the electrical current transfer function and applying the voltage to it. When the actual current is sufficiently different that that modeled by that filter, the algorithm can determine that there must have been a change in conditions. This method is implemented so that changes are identified in a time comparable to the response of the filter, for example on the order of about 1 ms. In many implementations can be other delays, for example, delays due to buffering input and/or output data. Such delays can add a delay to the sentinel's ability to recognize a problem and/or can add a delay to the system's ability to respond to the sentinel. Hence sentinels are generally configured to react in a manner that takes into account such delays.

9.3 Unprocessable Excursion Transfer Function Sentinels

Particular features in the measured excursion transfer functions can signal loudspeaker pathology. The algorithm can be configured to not boost the signal over traditional limits when these situations are sensed.

Situations which signal these pathological excursion transfer functions include, but are not limited to:

1. The loudspeaker diaphragm being restricted from motion by poking holding or jamming it.
2. The loudspeaker being exposed to water or other liquid.
3. The device being underwater.
4. The loudspeaker port being clogged or plugged with dirt, gum, gel, or other such gooey and/or sticky stuff, and the like.
5. The smartphone undergoing large vibrations.
6. The barometric pressure being low enough to reduce the back cavity compliance to a level which would increase the excursion past the limit for a given signal These conditions can be detected by checking one or more of:

1. Stability and reproducibility of the excursion transfer function.
2. Absolute value of the excursion transfer function at low frequencies.
3. Maximum value of the excursion transfer function.
4. Frequency of the maximum value of the excursion transfer function
5. $x \propto 1/\omega^2$ dependence for $\omega >> \omega_0$.

10 Modelling a Changing Loudspeaker

In developing a real-time loudspeaker protection algorithm with thermal limiting, a stationary lumped element model of the loudspeaker cannot be used as the resistance of the voice coil can change as a function of the power applied to it. In order to model a loudspeaker with a changing transfer function, a time step model of the loudspeaker can be constructed. Such a time step model would also use modelling of nonlinearities in the loudspeaker components.

10.1 Time Modelling of a Capacitor

Approximating the voltage can occur at a time suing a Taylor series about a past time:

$$V_n = V_{n-1} + h\frac{dV}{dt}\Big]_{n-1} \tag{43}$$

This is the "Forward Euler" (also called "Explicit Euler) method. The "Backward Euler" (or "Implicit Euler") method is the same except that the derivative is evaluated at time n rather than n−1. The "Trapezoidal method" (which is presently used) is an average of the two with the derivative evaluated at n−½.

Note that the "Backward Euler" (or "Implicit Euler") method is often more complicated to code, and converges no faster (and/or slower) than the forward Euler method. The only advantage is that it does not oscillate when the time step is large. Sufficiently small time steps were used in simulations herein, hence the Forward Euler was used, as described hereafter.

For a capacitor, $$I = C\frac{dV}{dt} \tag{44}$$

This equation can be solved over discrete time steps separated by an interval (h). Equation (44) can hence be written as a Forward Euler approximation for the next time step as:

$$V_n = V_{n-1} + h\frac{I_n}{C} \tag{45}$$

Figure 33:
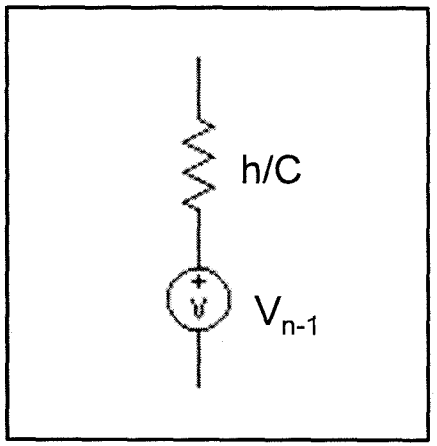
FIG. 33 depicts a discrete time model of a capacitor, according to non-limiting implementations.

The capacitor can be replaced with an approximation of time independent elements that will hold over the time h, as depicted in FIG. 33.

Figure 34:
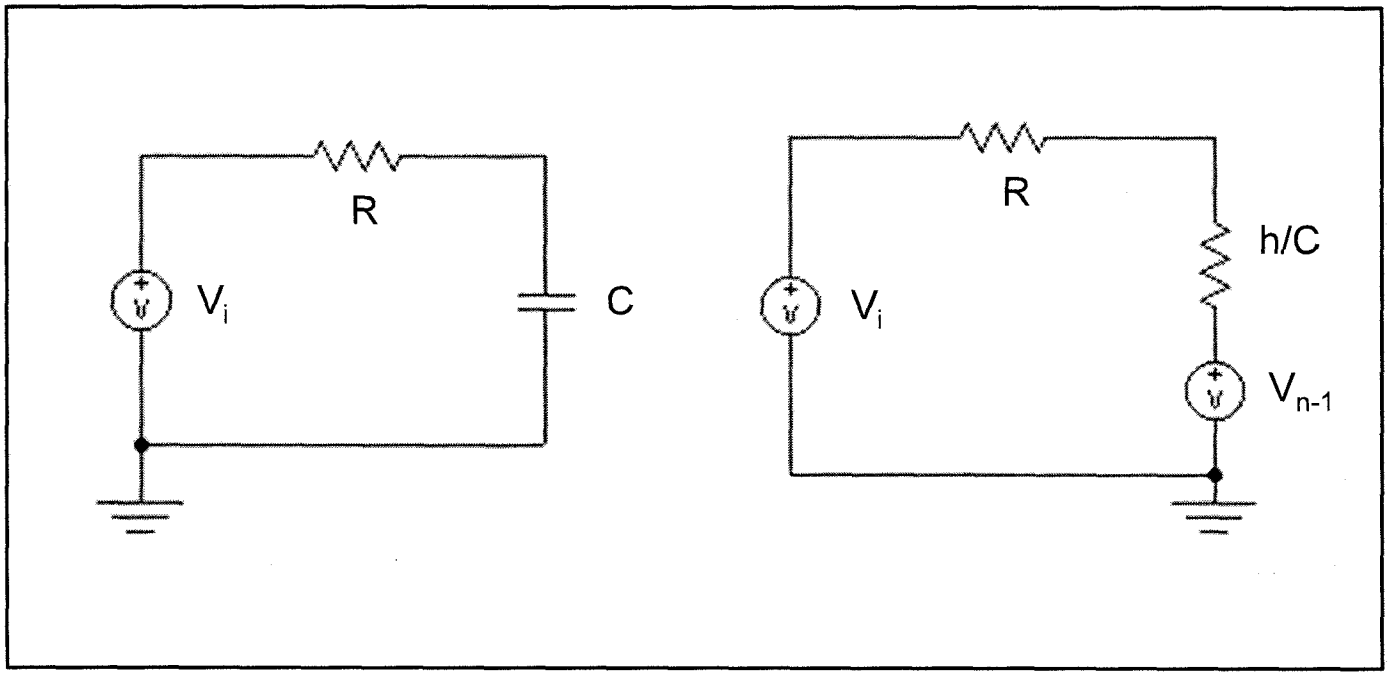
FIG. 34 depicts a discrete time model of a series RC circuit, according to non-limiting implementations.

As an example, a simple series RC filter can be constructed and transient analysis can be performed. The discrete time model can then become as depicted in FIG. 34.

As can occur in nodal network solvers, the voltages and currents in the circuit can be solved, for the next time interval. The process can be repeated until a specified and/or given time is complete. In one example implementation, the input parameters were set as follows:

R=100 kΩ;

C=1 μf; i.e. RC time constant=0.1 s.

The capacitor was initially charged to 1 V

Vin—set to a 1 Hz square wave, P-P amplitude of 2 Volts.

The time step h was set to 0.01 s

The length of the simulation was set to 5 s.

Figure 35:
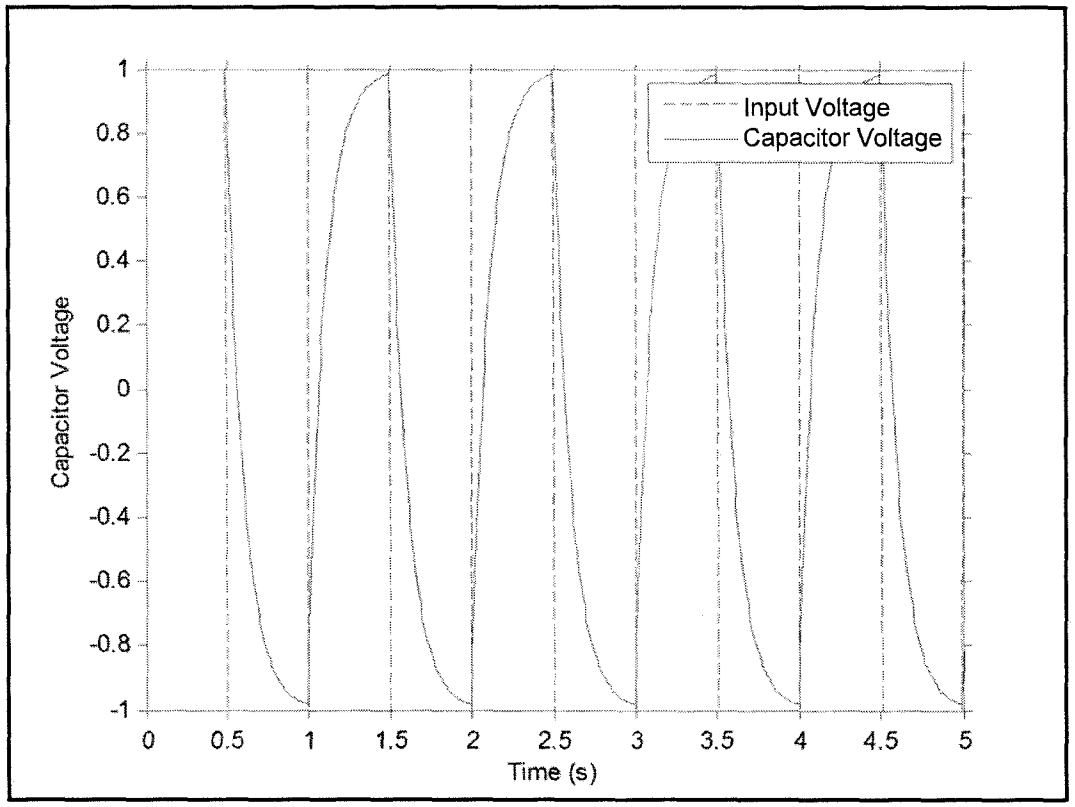
FIG. 35 depicts a response of a discrete time model of a series RC circuit to an input voltage, according to non-limiting implementations.

The result is depicted in FIG. 35, which depicts that the time constant of the capacitor voltage measured as when the voltage reaches 1/e of its ultimate value is 0.1 s.

Reducing the time step by a factor of 10 did not change the result by enough to notice on FIG. 35.

10.2 Time Modelling of a Inductor

Similar to the capacitor, an inductor is now considered, where L is inductance:

$$V = L\frac{dI}{dt} \tag{46}$$

The Forward Euler approximation for the next time step is:

$$I_n = I_{n-1} + h\frac{V_{n-1}}{L} \tag{47}$$

Figure 36:
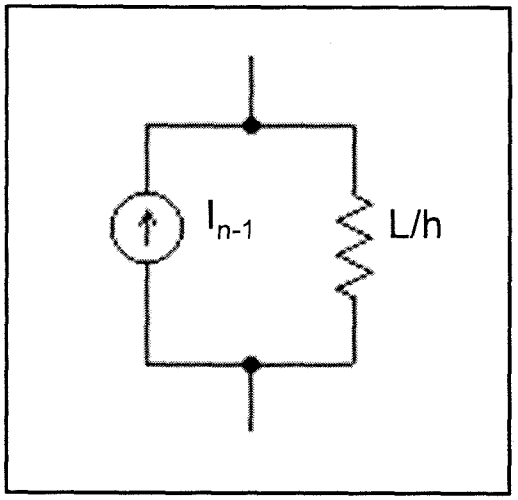
FIG. 36 depicts a discrete time model of an inductor, according to non-limiting implementations.

The inductor can hence be replaced with the discrete time model depicted in FIG. 36.

Figure 37:
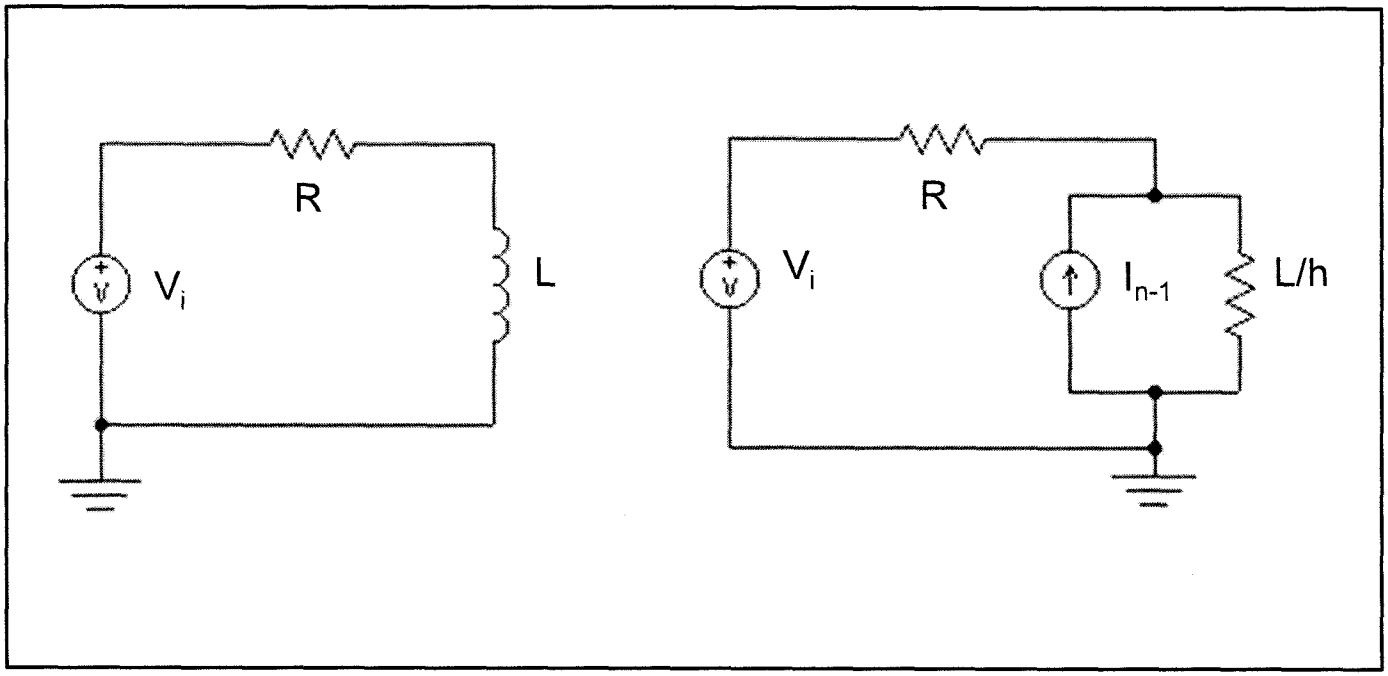
FIG. 37 depicts a discrete time model of a Series RL circuit, according to non-limiting implementations.

Again constructing a simple example series RL circuit, the discrete time model becomes as depicted in FIG. 37.

Figure 38:
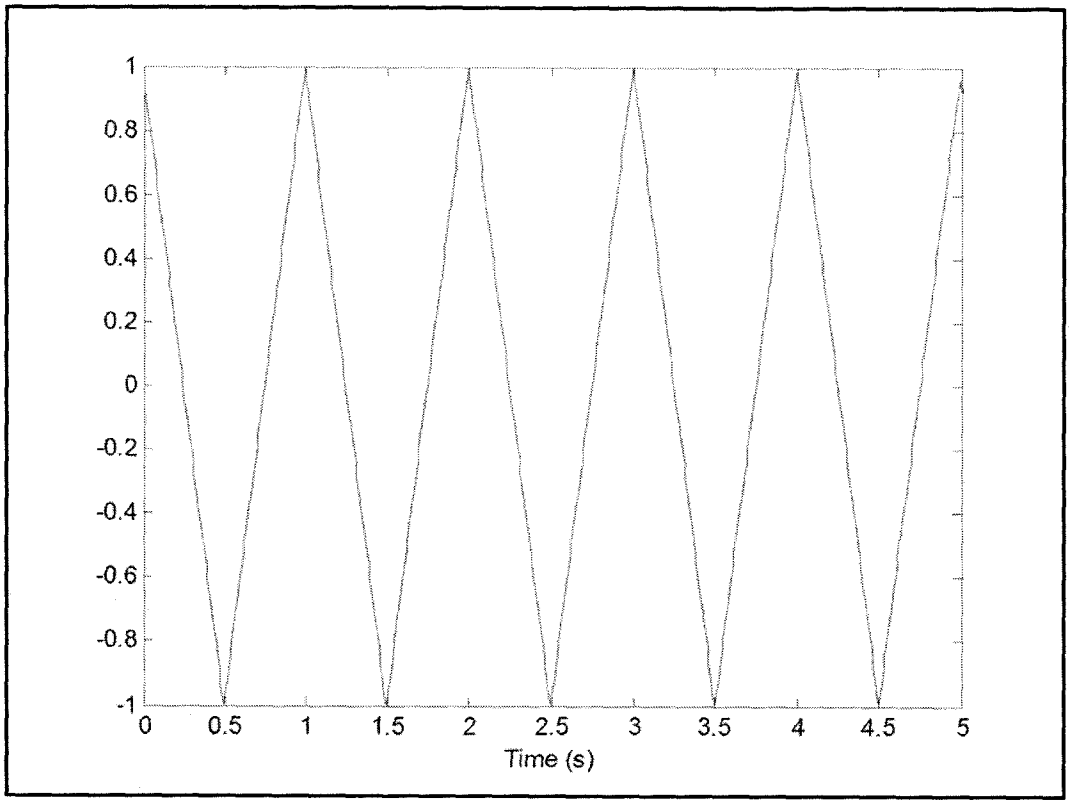
FIG. 38 depicts an input voltage for a series RL circuit, according to non-limiting implementations.

Again, the voltages and currents in the circuit can be solved, for the specified time intervals. In one implementation, the input parameters were set as follows:

R=1 Ω;

L=1 μH;

Vin—set to a 1 Hz triangular wave depicted in FIG. 38

P-P amplitude of 2 Volts

The time step h was set to 0.01 s

The length of the simulation was set to 5 s.

Figure 39:
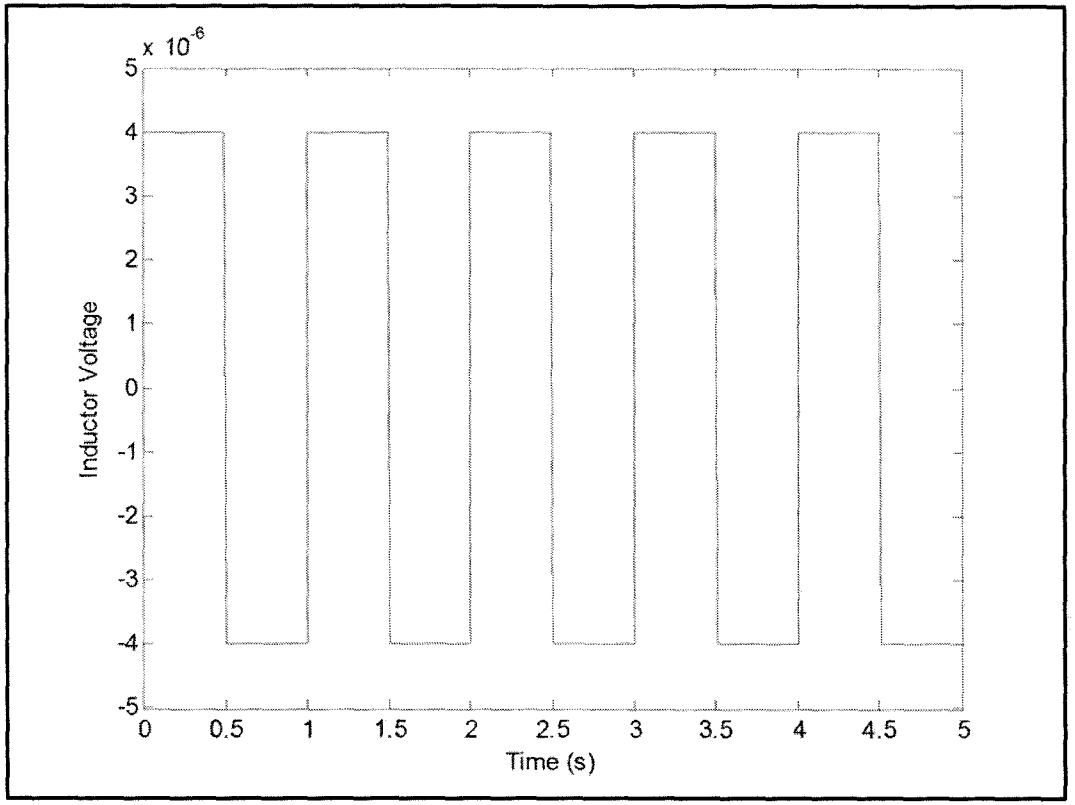
FIG. 39 depicts a voltage on an inductor due to a discrete time model, according to non-limiting implementations.

On the ramps of our triangular input voltage signal, the voltage across the inductor was changing at 4 V/s, which should result in a square wave with amplitude of 4 μV. This expected result is depicted in FIG. 39. Again, reducing the time step by a factor of 10 did not change the result by enough to notice on in FIG. 39.

10.3 Time Modelling of a Diode Circuit

As well as allowing for a changing transfer function, time step modelling also allows for nonlinear elements. Consider a diode; the Shockley diode equation gives the current as a function of the voltage:

$$I=I_S(e^{V/V_T}-1) \tag{48}$$

Where:

V is the Voltage across the diode.

I is the current through the diode.

$I_S$ the reverse bias saturation current (or scale current).

$V_D$ is the voltage across the diode.

$V_T$ is the thermal voltage.

n is the "ideality factor", also known as the "quality factor" or sometimes "emission coefficient".

Figure 40:
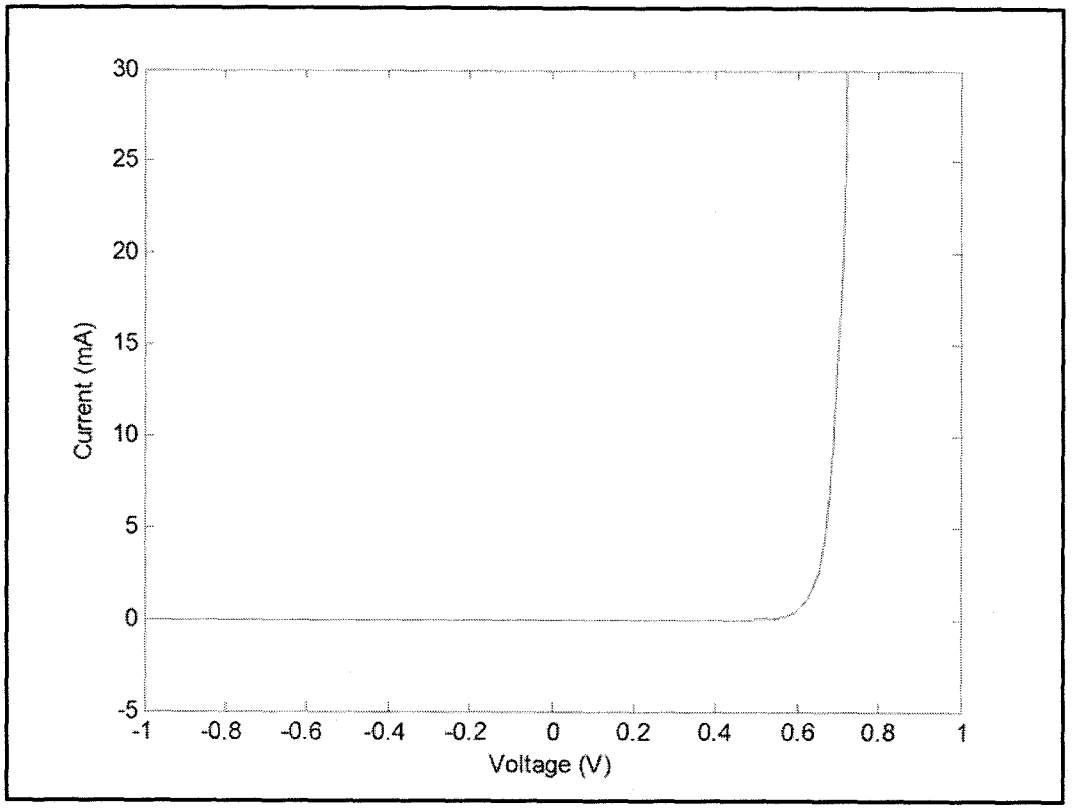
FIG. 40 depicts an I-V characteristic of an ideal diode, according to non-limiting implementations.

These I-V characteristics are plotted in FIG. 40 for $nV_T$=0.03 V and $I_S$=1e−12 A (values are typical for a silicon diode).

As before, the diode current is approximated at the $(n+1)^{th}$ step as a function of the currents and voltages at the $n^{th}$ step:

$$V_{n+1} = V_n + dI\frac{dV}{dt}\Big]_n = V_n + R_d dI \tag{49}$$

Figure 41:
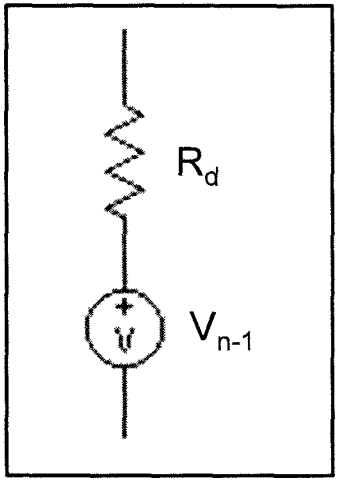
FIG. 41 depicts a discrete time model of a diode, according to non-limiting implementations.

The diode can hence be replaced with a discrete time model of an inductor as depicted in FIG. 41, where $I_{n-1}$ is the voltage across the diode at time step n−1 and $R_d$ is the small signal resistance of the diode at quiescent voltage $V_n$.

Figure 42:
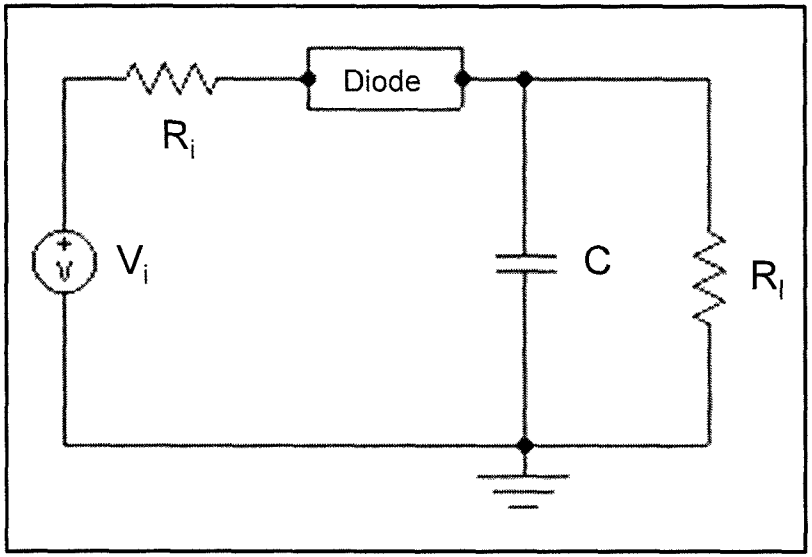
FIG. 42 depicts a simple power supply circuit, according to non-limiting implementations.
Figure 43:
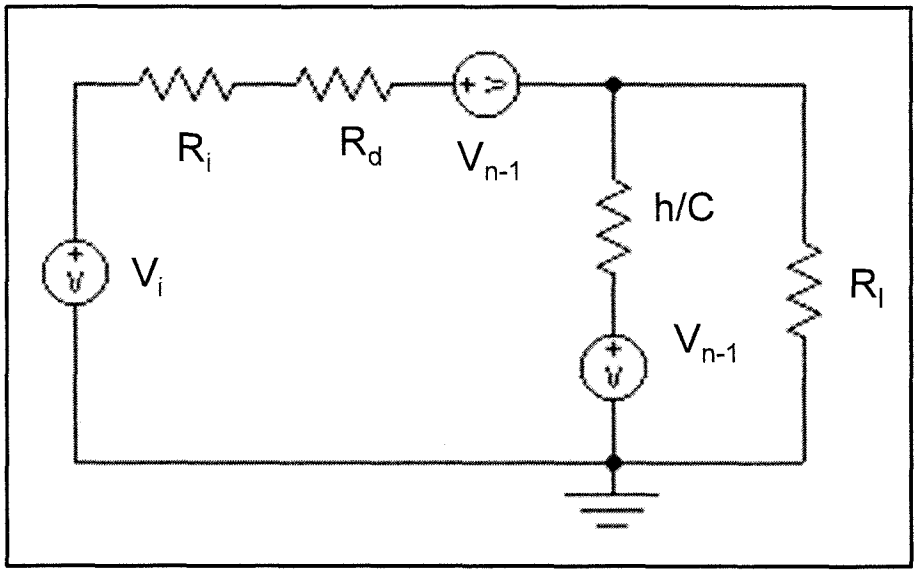
FIG. 43 depicts a discrete time model of a simple power supply circuit, according to non-limiting implementations.

As an example circuit using a diode, a simple power supply circuit depicted in FIG. 42 is provided and the discrete time model depicted in FIG. 43.

Figure 44:
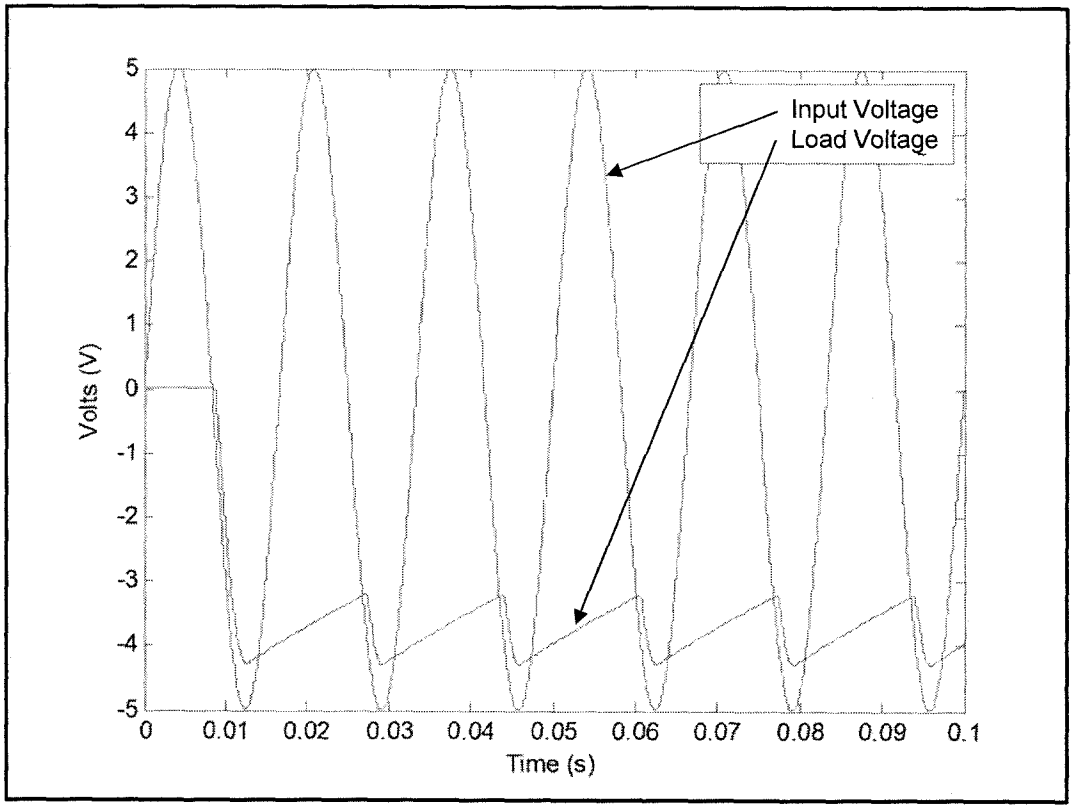
FIG. 44 depicts a response of a simple power supply circuit, according to non-limiting implementations.
Figure 45:
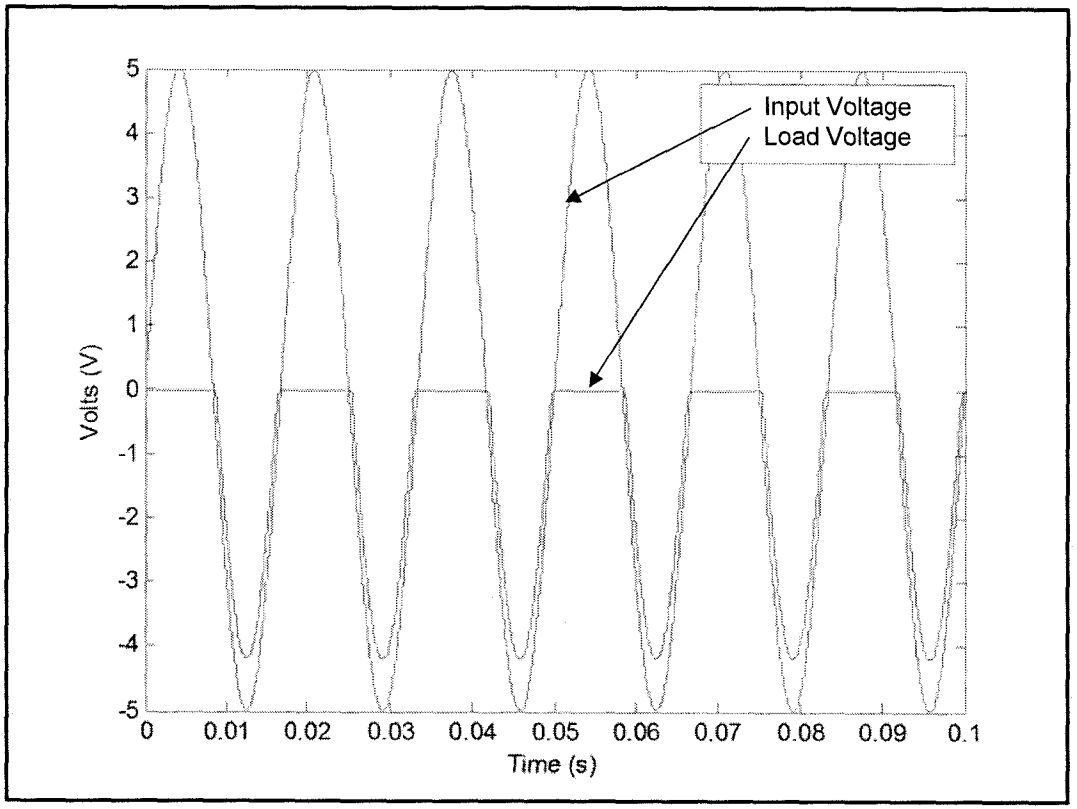
FIG. 45 depicts a response of a simple power supply circuit with a different set of parameters, according to non-limiting implementations.
Figure 46:
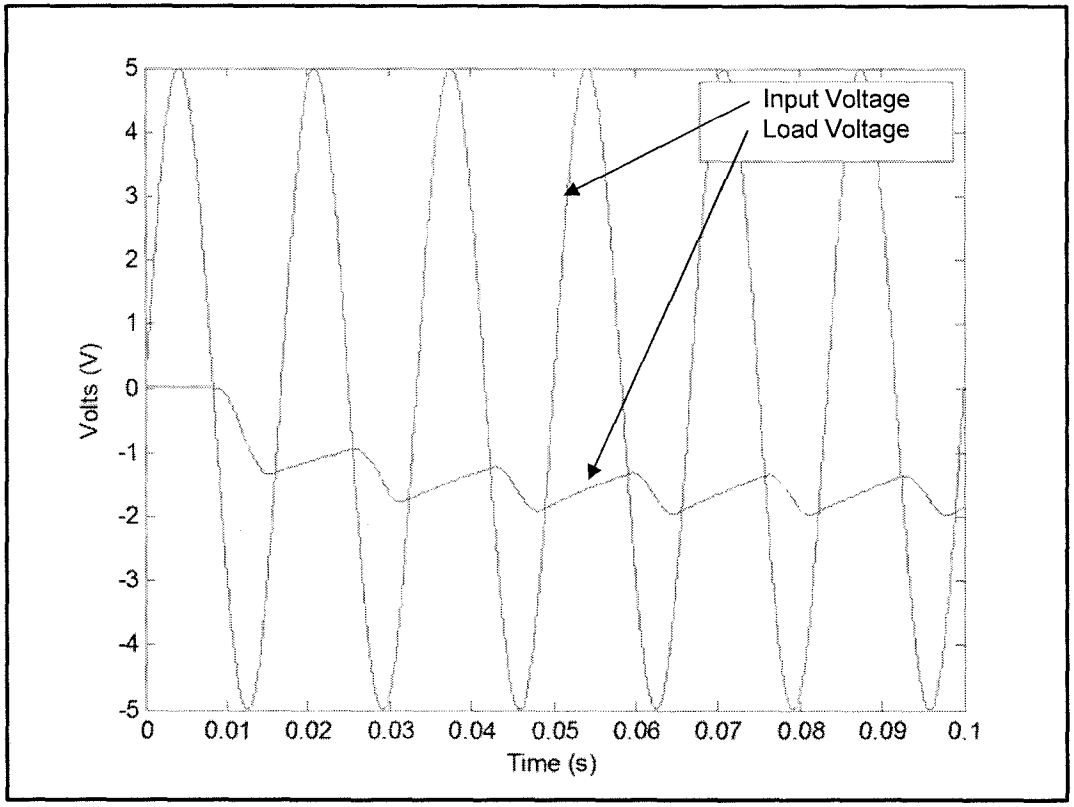
FIG. 46 depicts a response of a simple power supply circuit with a different set of parameters, according to non-limiting implementations.

The capacitor voltage is plotted for a number of different scenarios in FIGS. 44, 45 and 46.

Figure 47:
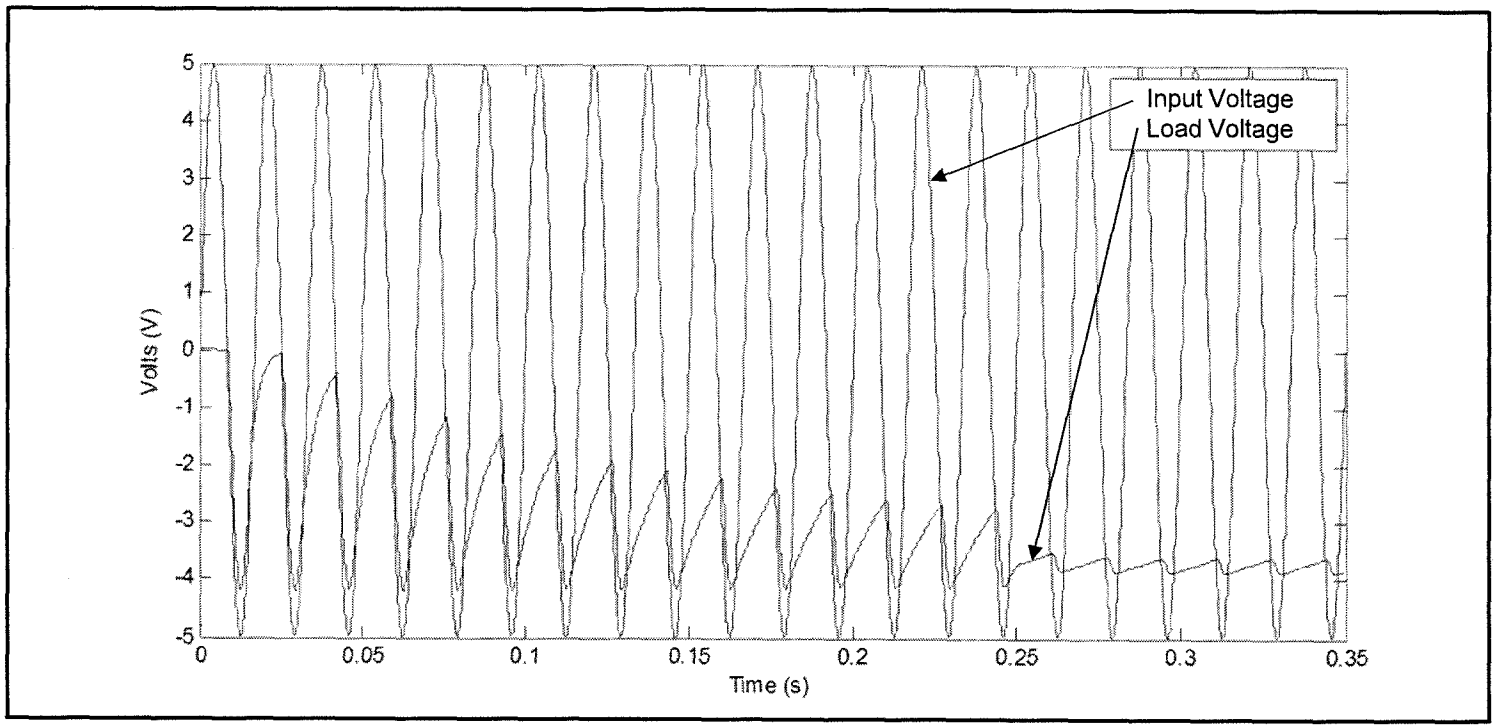
FIG. 47 depicts a response of a simple power supply circuit with different set of parameters, according to non-limiting implementations.

To demonstrate the capability of changing parameters as a function of time, the capacitance was set to change linearly from 1 μF to 500 μF for the first 0.25 seconds. The capacitance was then discontinuously changed to 2000 μF. Ri was set to 1, R1 was set to 100. The result is depicted in FIG. 47.

10.4 Time Modelling of a Loudspeaker Circuit

Figure 48:
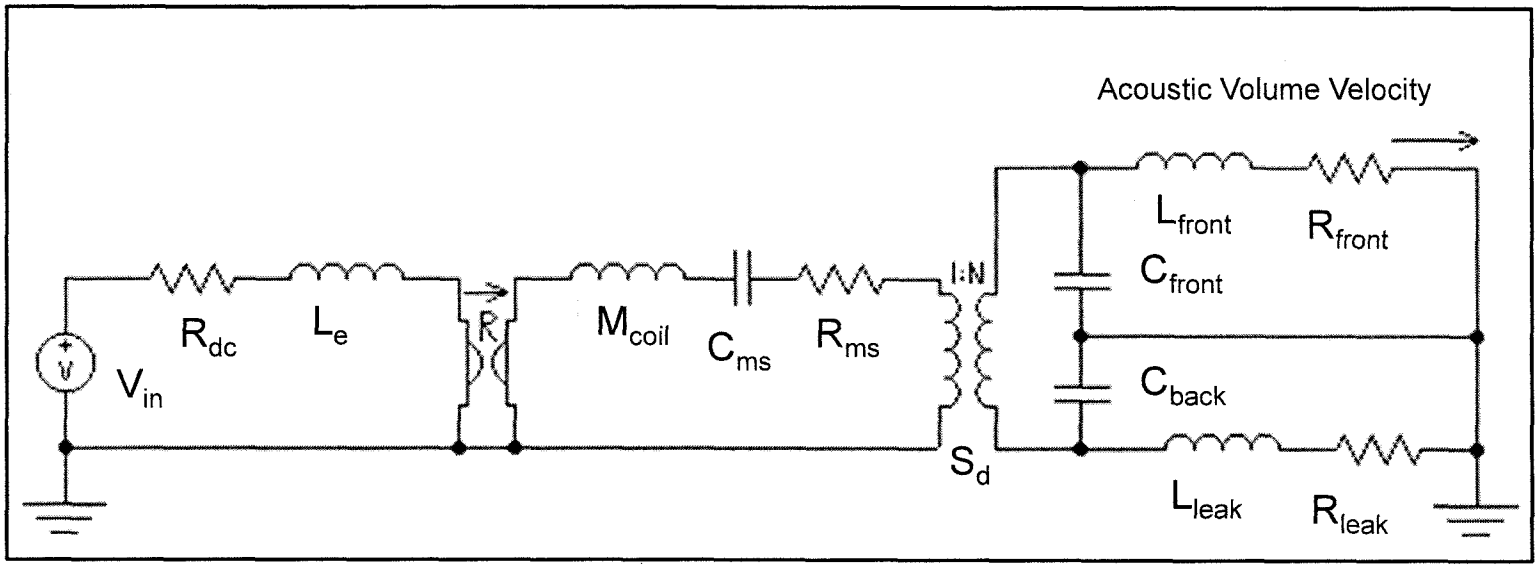
FIG. 48 depicts a frequency domain loudspeaker circuit for conversion to a time step model, according to non-limiting implementations.

In time modelling of loudspeaker circuit a fairly comprehensive loudspeaker circuit model with a back cavity, back leak and front resonator was used, as depicted in FIG. 48.

Figure 49:
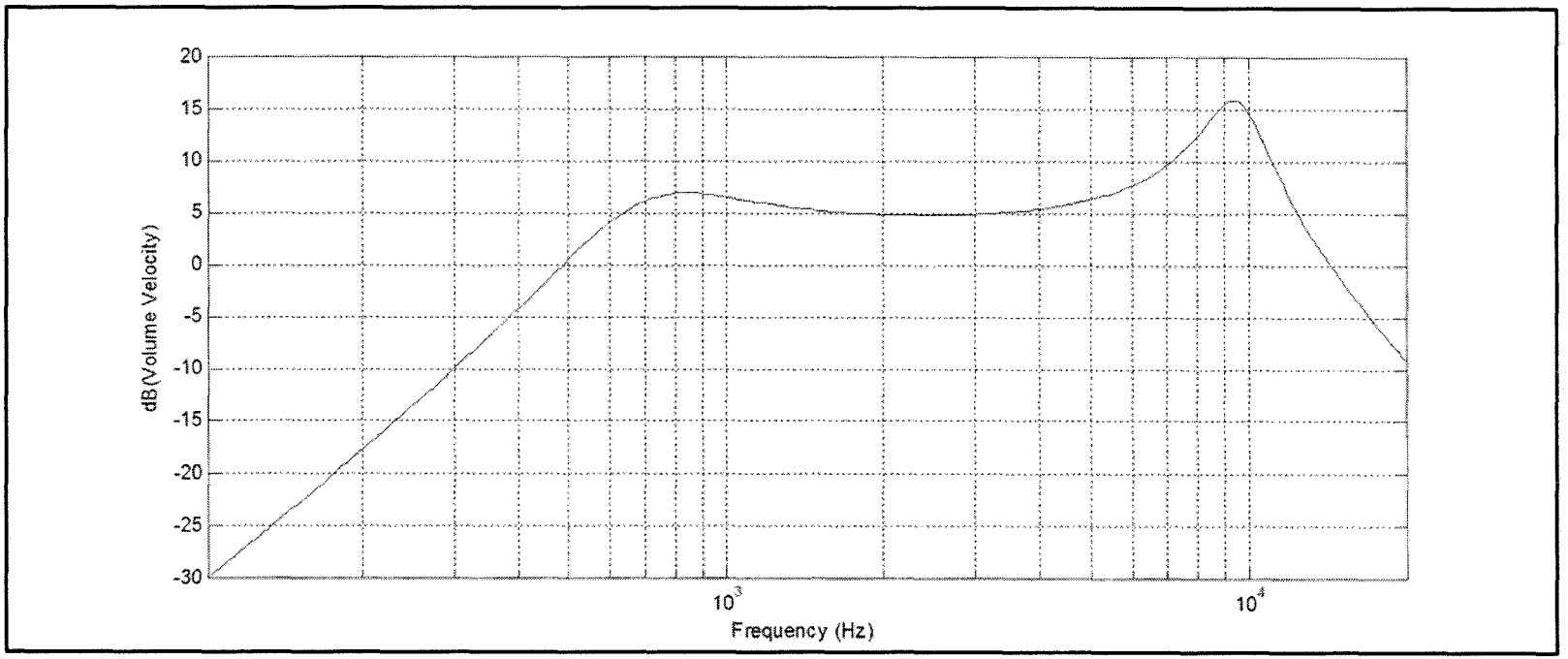
FIG. 49 depicts a frequency response of the loudspeaker circuit of FIG. 48, according to non-limiting implementations.

The frequency response of the loudspeaker implementation radiating into open space at a distance r is given by:

$$p = \frac{i\omega\rho}{4\pi}\frac{u_0}{r}e^{i(\omega t-kr)} \tag{50}$$

where ρ is the density of air, ω is the angular frequency and $u_0$ is the acoustic volume velocity. This frequency response is depicted in FIG. 49.

Figure 50:
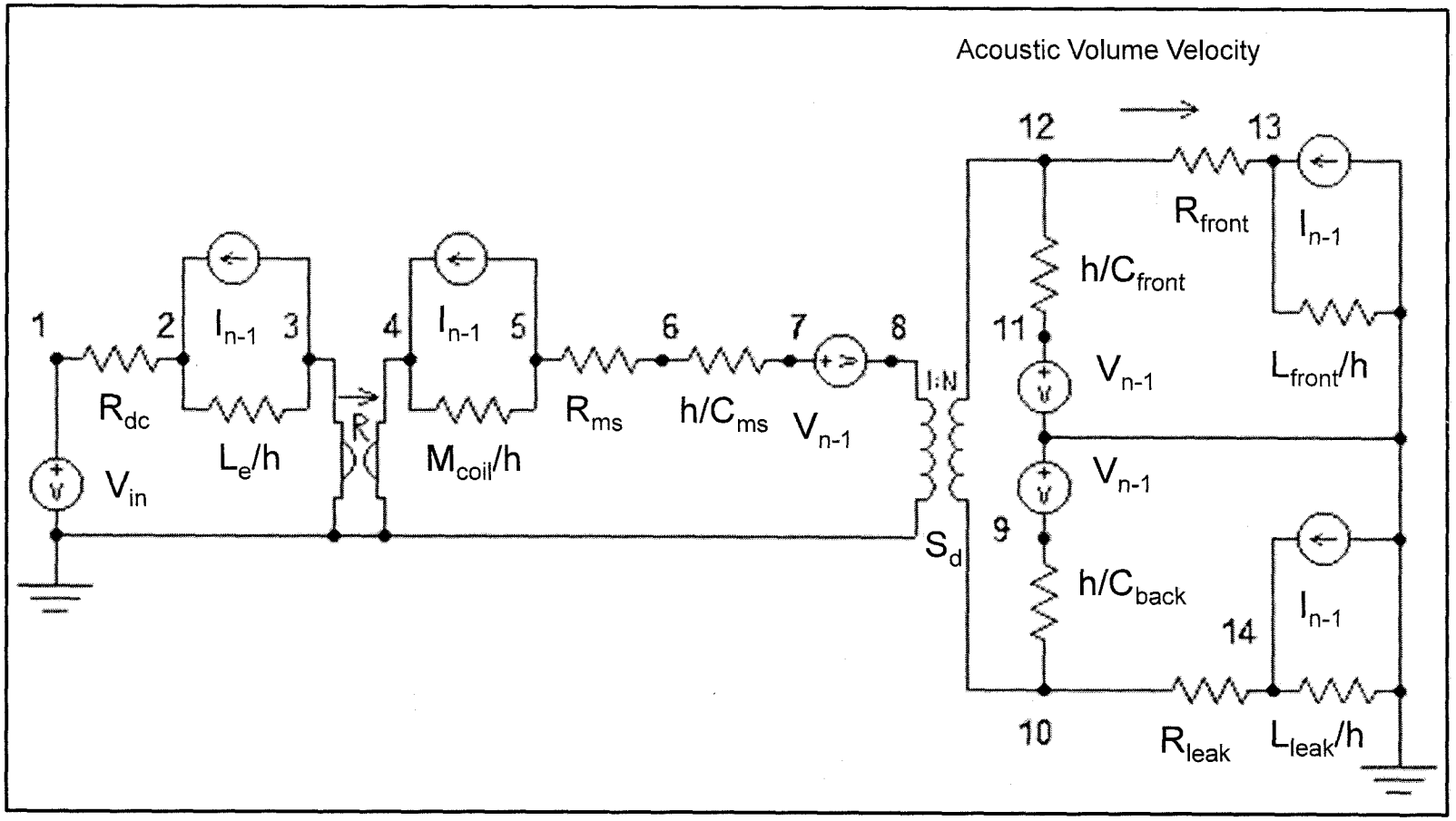
FIG. 50 depicts a time step model of the loudspeaker circuit of FIG. 48, according to non-limiting implementations.

The time step model of the loudspeaker implementation is depicted in FIG. 50, with the value of each component of FIG. 50 shown in Table 2.

TABLE 2

Time Step Model Component Values

| Component | Value | Units |
|---|---|---|
| Vin | 1 | RMS Volts |
| Rdc | 7.2 | Ω |
| Le | 46.0 | μH |
| Bl | 0.89 | T-m |
| Mcoil | 79 | $\mu H_M$ |
| Cms | 1.3 | $mF_M$ |
| Rms | 78 | $m\Omega_M$ |
| Sd | 111 | mm 2 |
| Cfront | 0.6 | $pF_A$ |
| Lfront | 500 | $H_A$ |
| Rfront | 7.4 | $m\Omega_A$ |
| Cback | 14 | $pF_A$ |
| Lleak | 70 | $kH_A$ |
| Rleak | 3.0 | $G\Omega_A$ |

Figure 51:
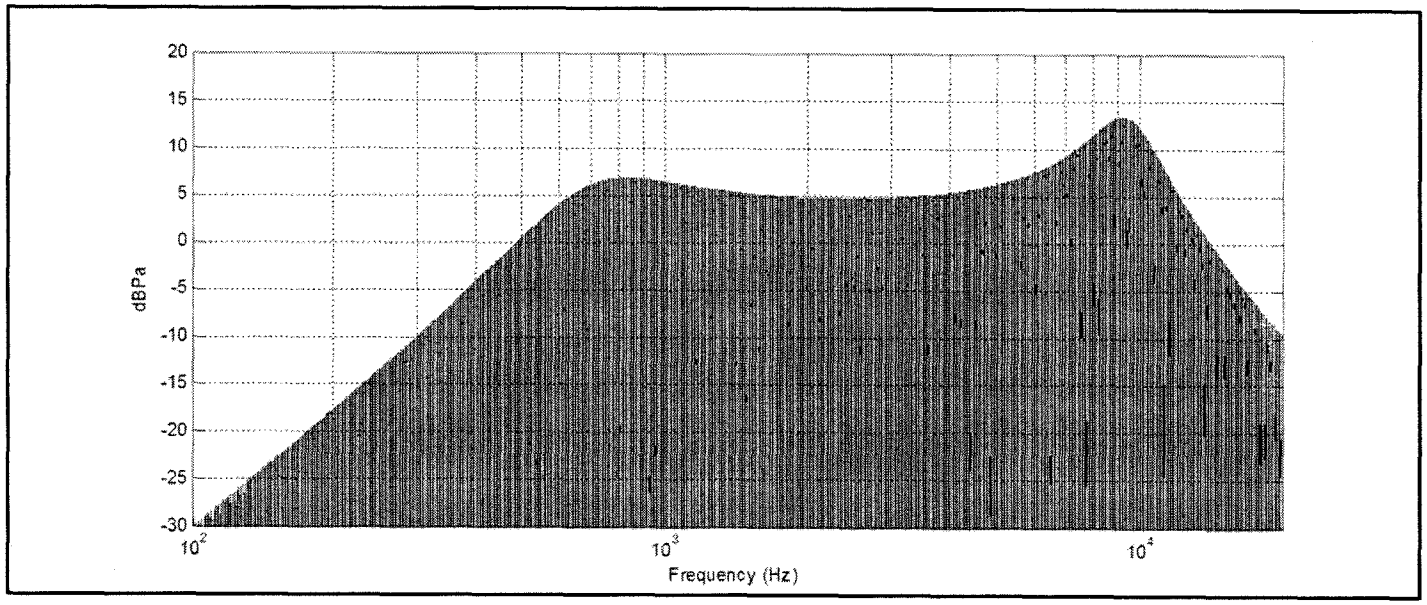
FIG. 51 depicts the response of the time step model of FIG. 50 to a logarithmic chirp signal, according to non-limiting implementations.

The frequency response of the time step model can be derived by applying a swept sinusoid as the input. The output would then also be sinusoidal at the same frequency but with an amplitude corresponding to the frequency response at that frequency (provided the sweep is slow enough as to not matter and the step size is small enough as to not matter.). This is depicted in FIG. 51.

Figure 52:
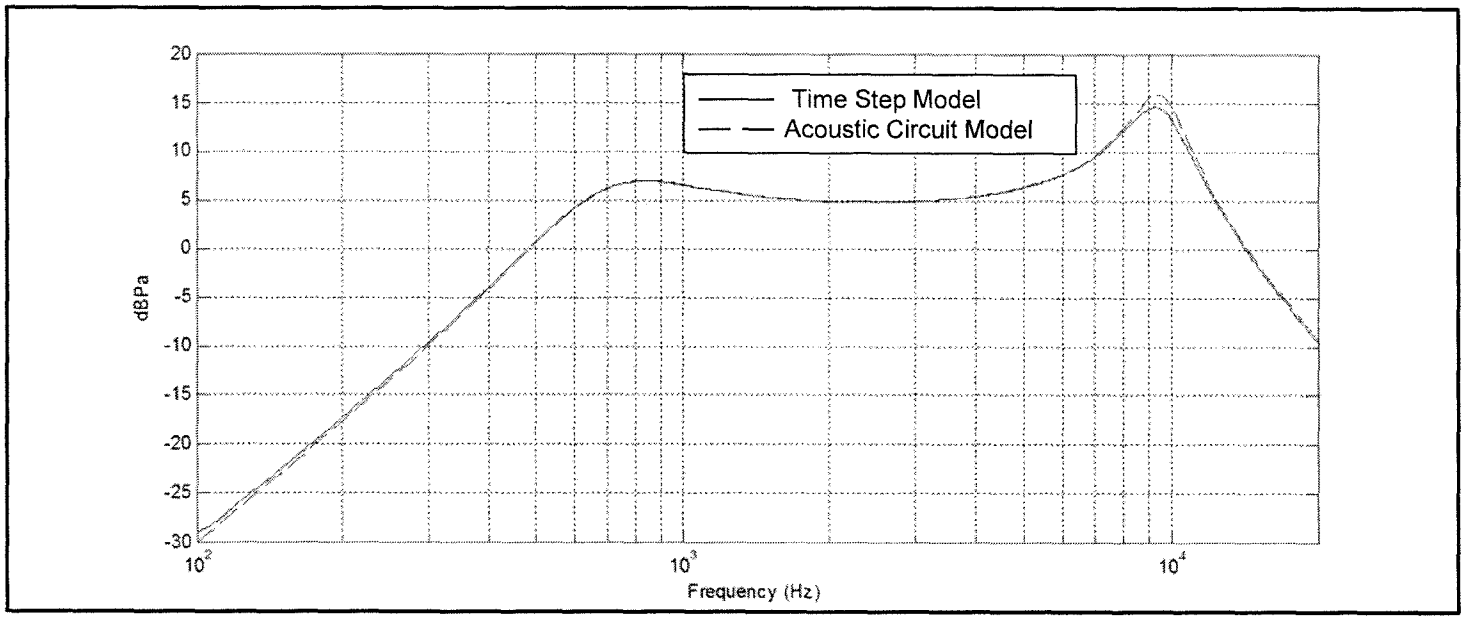
FIG. 52 depicts a comparison between the frequency response of a frequency domain model and a time step model of a loudspeaker, according to non-limiting implementations.

The frequency response is then obtained by taking the RMS value of this signal over a short time window as in FIG. 52. This result is also compared with the Acoustic Circuit Model in FIG. 52.

Figure 53:
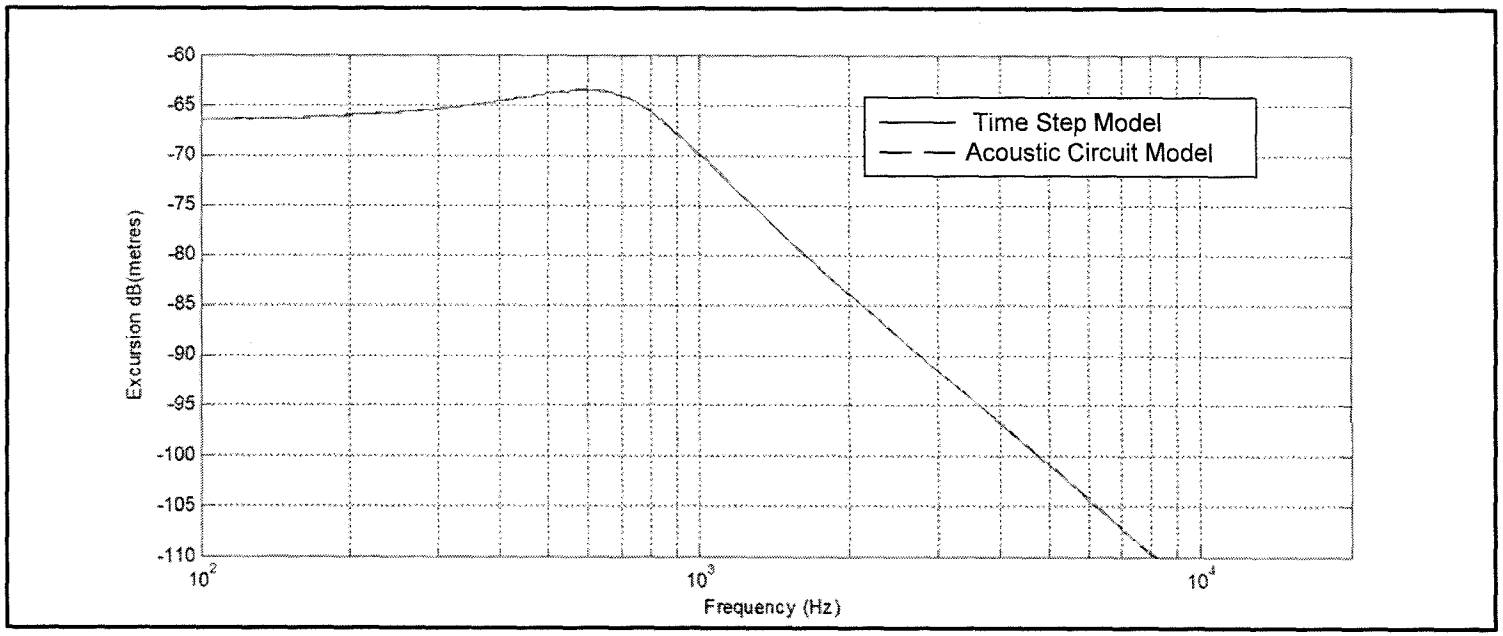
FIG. 53 depicts an excursion response derived from the time step model of FIG. 50, according to non-limiting implementations.

The excursion was calculated in a similar way and the result is compared with the Acoustic Circuit Model in FIG. 53.

Figure 54:
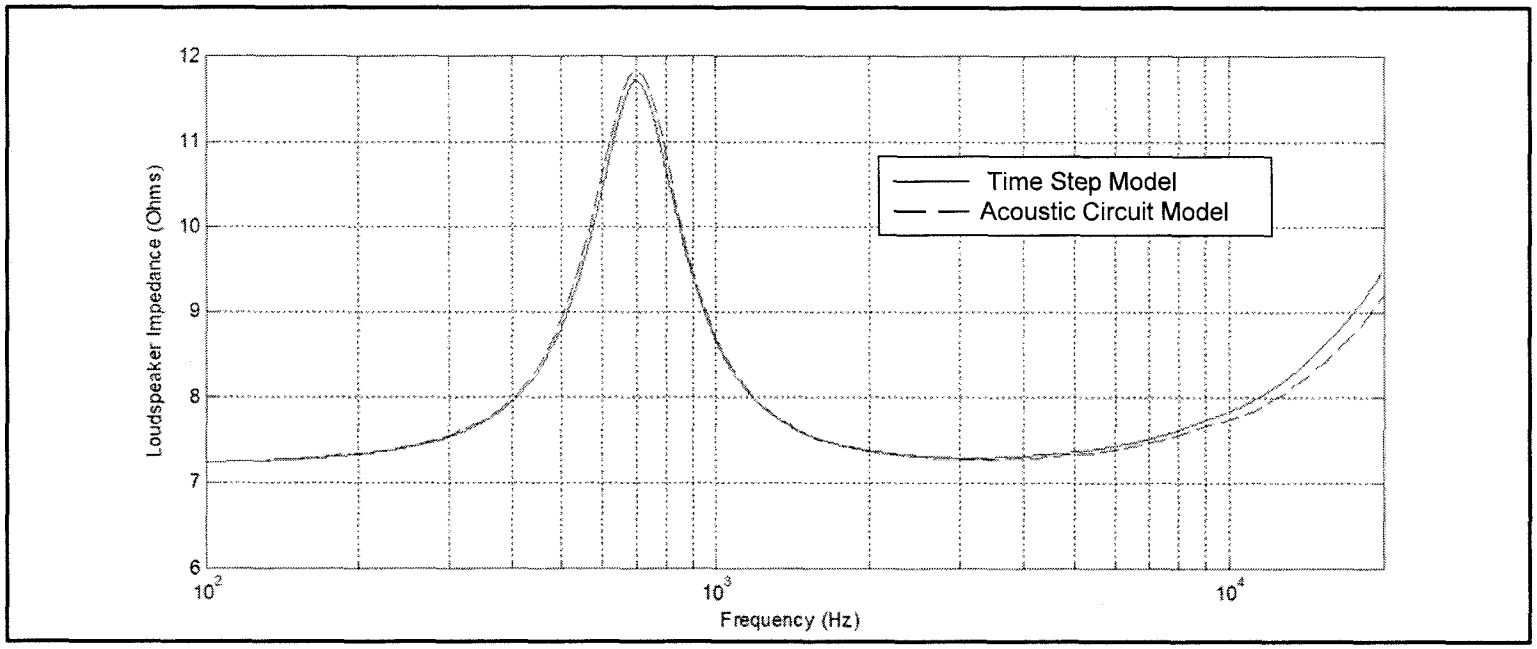
FIG. 54 depicts an electrical impedance derived from the time step model of FIG. 50, according to non-limiting implementations.

The electrical impedance was calculated in a similar way and the result is compared with the Acoustic Circuit Model in FIG. 54.

10.5 Nonlinear Effects

The two main nonlinearities in the loudspeaker are 1) the excursion dependence of the diaphragm compliance and 2) the excursion dependence of the Bl product.

10.5.1 Excursion DC Offset

Whenever the nonlinear components are asymmetric the motion of the diaphragm will no longer be centered on the no-signal equilibrium position. In models used herein, the diaphragm velocity was derived and the excursion was obtained by temporal integration. This integration accumulates errors in the DC offset and hence other ways can be used to determine it.

The DC excursion offset is defined as the difference between a long term time average of the excursion and the no signal equilibrium position. When the force on the diaphragm is denoted by $f$, and the mass of the diaphragm by in, the acceleration of the diaphragm can be determined by integrating twice to get the position:

$$f=m\ddot{x} \tag{51}$$

The force is a function of the applied signal, the Bl product and the restoring force. Both of these components are functions of position:

$$\ddot{x} = \frac{Bl(x)I(t) - k(x)x}{m} \tag{52}$$

Taking the long term average of the left side is generally zero because the DC excursion offset is generally constant for a particular signal. This leads to a criterion that can be used in the model to ensure that the DC offset is consistent with the AC motion of the diaphragm. Long term averages in some loudspeakers for smartphones and/or mobile devices is of the order of about 100 ms. The calculation can be carried out below this at every time step and the DC offset of the excursion can be corrected over a time constant of about 100 ms or so to keep Equation (53) satisfied, which represents a dc offset correction:

$$\frac{Bl(x)I(t) - k(x)x}{m}(\Delta t)^2 = 0 \tag{53}$$

10.5.2 Nonlinear Compliance

Figure 55:
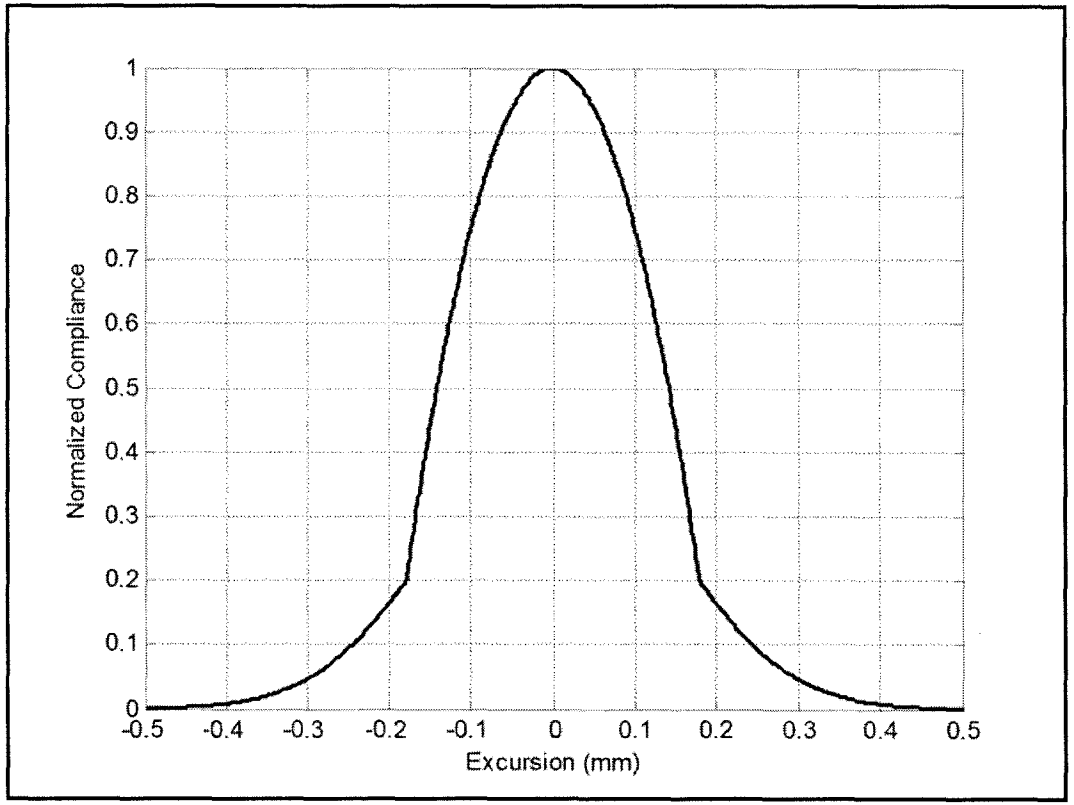
FIG. 55 depicts a relative compliance of a loudspeaker diaphragm taking into account a non-linear effect, according to non-limiting implementations.

In this section, it is assumed that the Bl product is constant and the diaphragm compliance varies with excursion. Further, the dependence depicted in FIG. 55 will be used.

Figure 56:
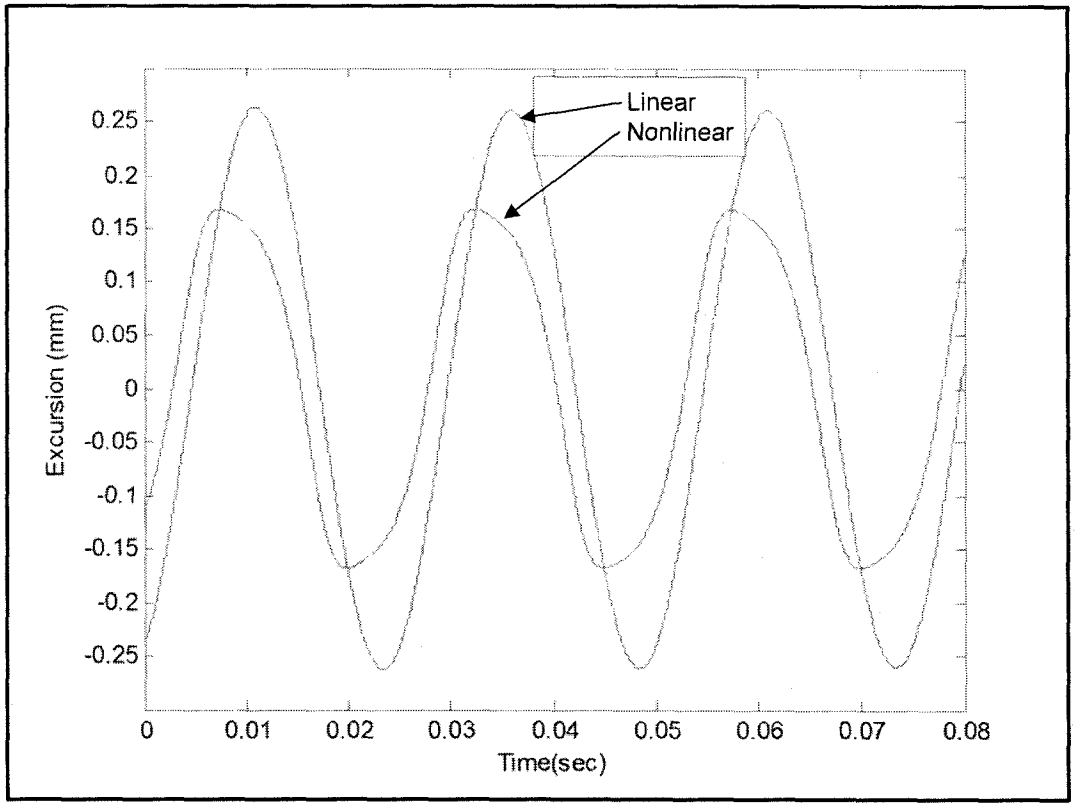
FIG. 56 depicts an excursion for a nonlinear compliance for a sinusoidal stimulus, according to non-limiting implementations.

Applying a sinusoidal signal at a frequency below the resonant frequency to a loudspeaker with this compliance results in a flattening of the input signal as depicted in FIG. 56.

10.6 The Thermal Time Step Model

In each time step (n), the instantaneous thermal power $P_n$ dissipated in the voice coil can be calculated as the square of the voltage across the voice coil resistor divided by the resistance. Using the thermal model provided in Equation (2), the time derivative of the temperature can be calculated at this time step. The temperature can then be determined at the next time step as:

$$T_{n+1} = T_n + h\frac{dT}{dt} \tag{54}$$

Where h is the length of the time step. Rearranging Equation (1), the resistance of the voice coil can be calculated using:

$$R=R_0[1+\alpha(T-T_0)] \tag{55}$$

Using values:

$T_a$=23.6° C.

$C_p$=0.0410 Joule/C.°

$\kappa$=0.0193 Watt/C.°

Figure 57:
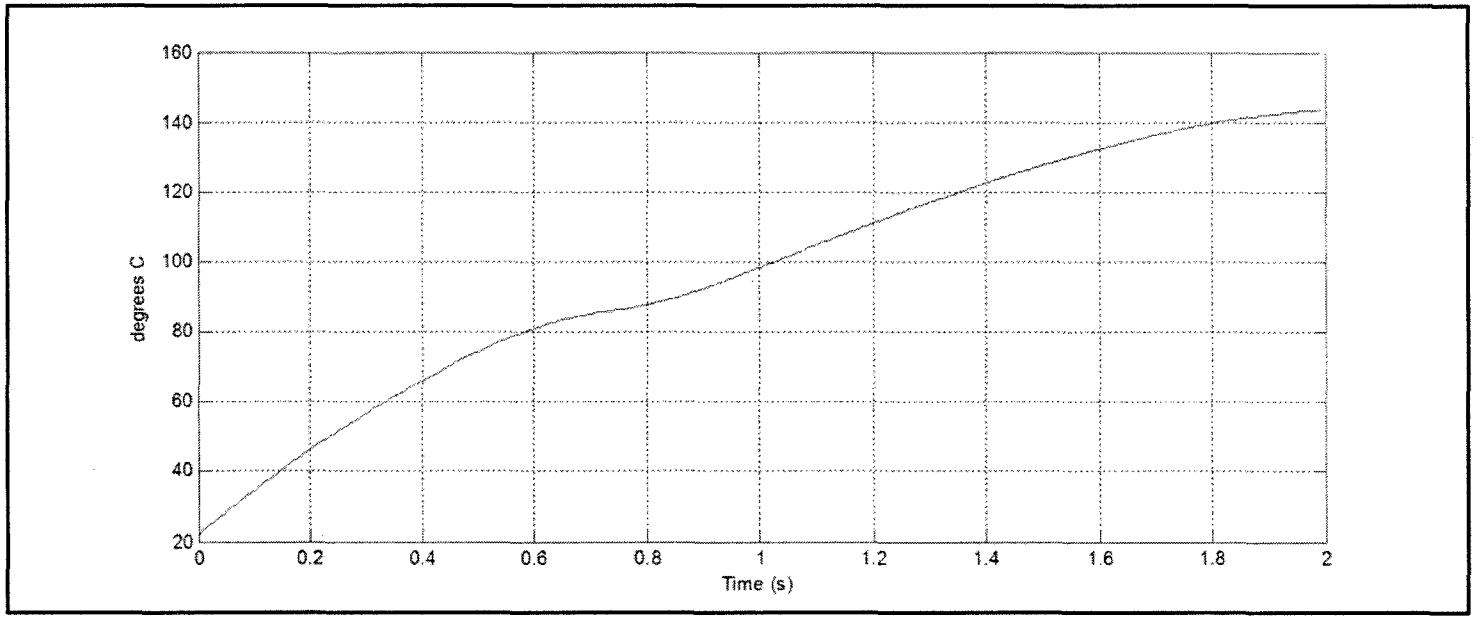
FIG. 57 depicts a voice coil temperature for a particular input voltage signal, according to non-limiting implementations.
Figure 58:
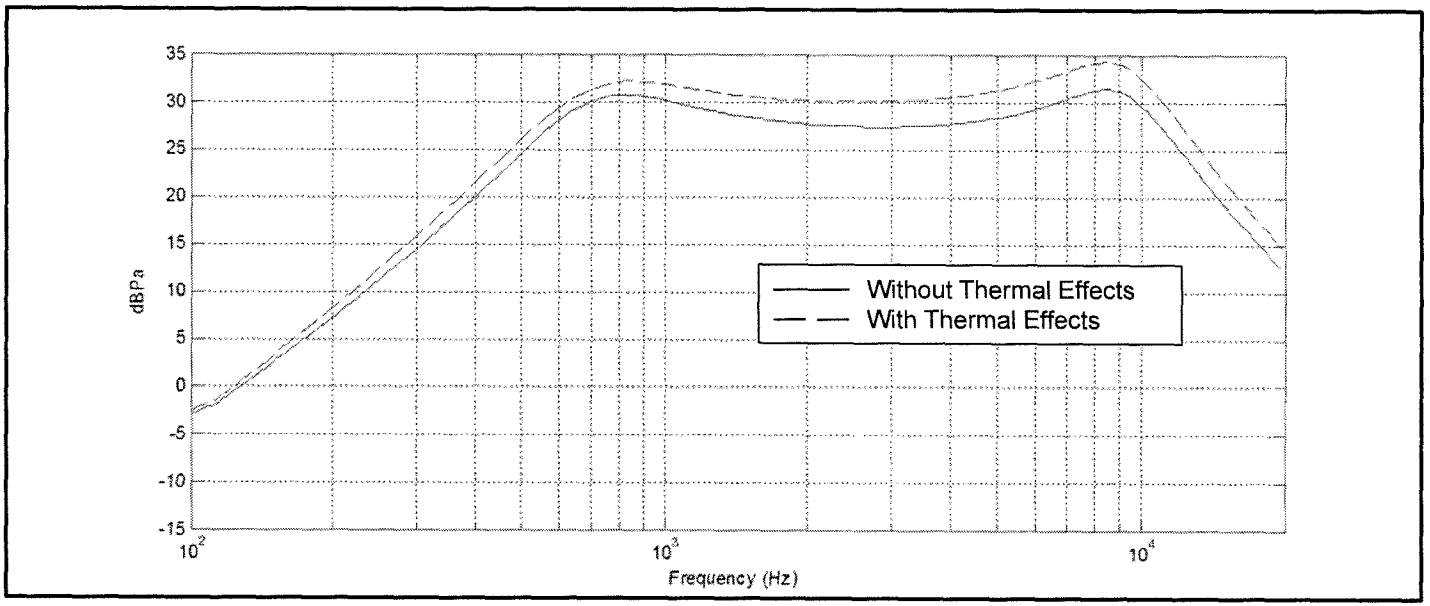
FIG. 58 depicts a loudspeaker frequency response with and without the thermal effects, according to non-limiting implementations.

$T_0=T_a$ $R_0=R_{dc}$ and an input chirp power of 6 Watts, the temperature of the voice coil is depicted in FIG. 57 and the result of the chirp is depicted in FIG. 58. While the chirp power of 6 Watts is unrealistic, it can be used to demonstrate the model. Note in FIG. 57 that the sensitivity of the loudspeaker drops as the voice coil resistance increases. Note also in FIG. 57 that the temperature rise at 0.7 seconds is not as fast as the surrounding times as this is when the chirp is passing through resonance frequency. At this frequency the effective impedance of the loudspeaker increases, decreasing the thermal dissipation.

10.7 External Electrical Circuitry

Figure 59:
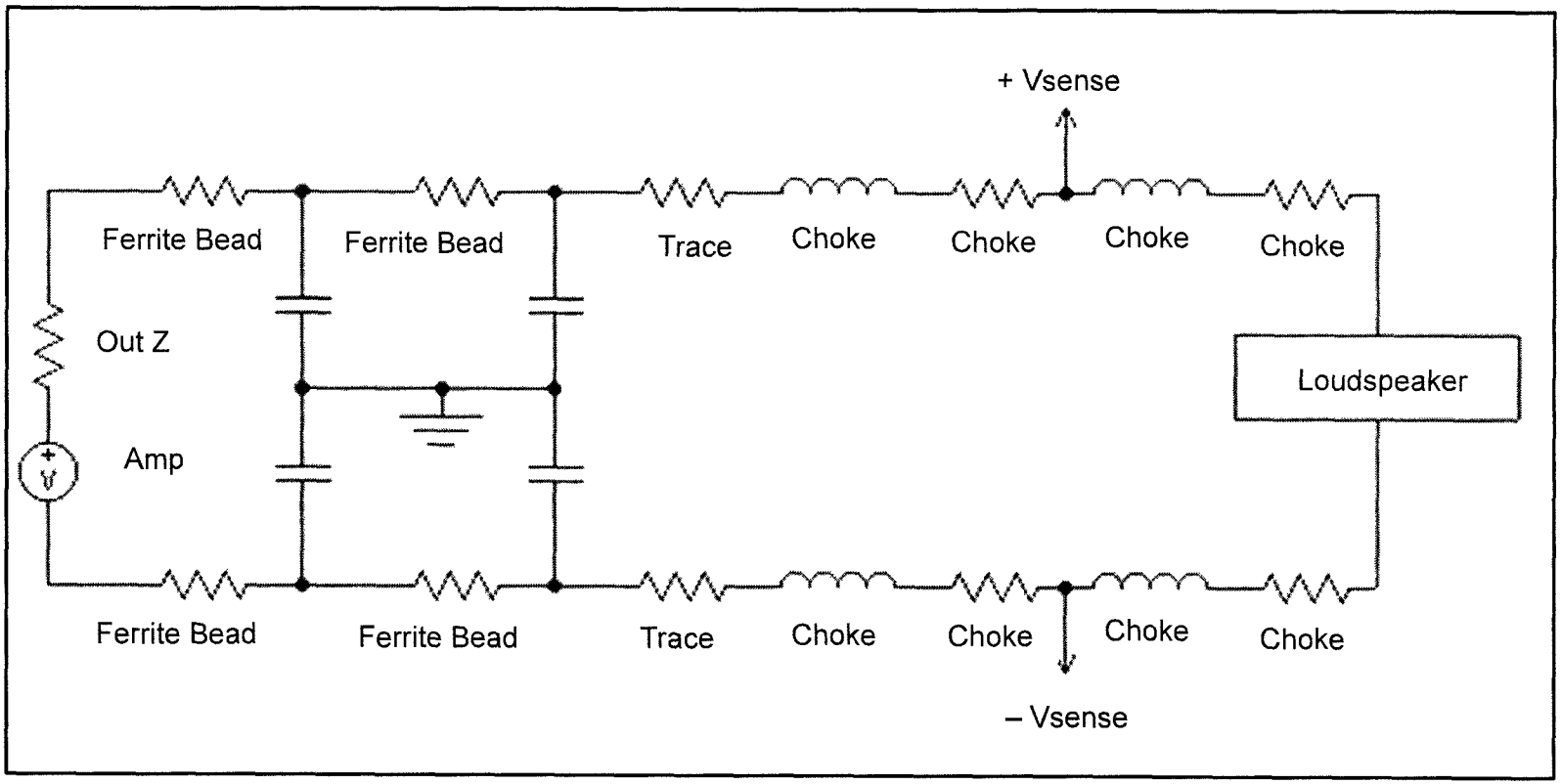
FIG. 59 depicts typical loudspeaker external circuitry, according to non-limiting implementations.

A non-limiting example loudspeaker's external circuitry, as can be used in a mobile device and/or smartphone, and the like, is depicted in FIG. 59, which can be taken into account by algorithms and methods described herein. The ferrite beads are specified as maximum resistance rather than tolerance. Rather than their stated maximum value of 950 mΩ, a value of about 800±150 mΩ is used. Similarly, the choke resistances were given as maximum values 330 mΩ and 40 mΩ, values of about 315±15 mΩ and about 35±5 mΩ respectively are used. The impedance of the 100 pF capacitors at about 20 kHz is about 80 kΩ. The largest impedance in the loudspeaker circuit will be about 12Ω, resulting in a change of about 0.02% in the loudspeaker impedance; hence these capacitors are ignored to simplify the circuit.

Further, the voice coil inductance is for example about 50 μH compared to the choke inductance of about 0.1 μH. This is smaller than the measurement accuracy of the voice coil inductance and therefore these inductors will be ignored as well.

Figure 60:
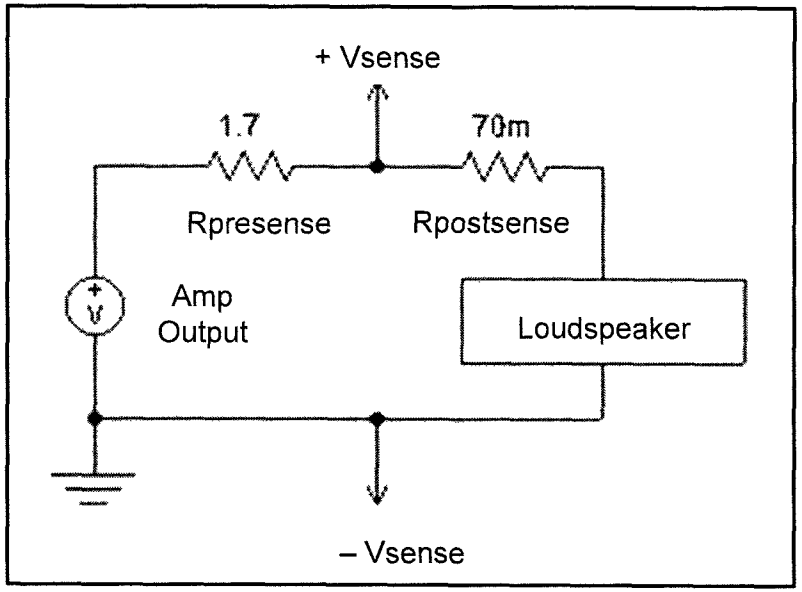
FIG. 60 depicts a simplified loudspeaker external circuitry, according to non-limiting implementations.

This results in the effective external circuitry depicted in FIG. 60. Simplifying this circuit obviously makes its mitigation simpler, but also will generalize the mitigation technique to all external circuitry that can be simplified to these two parameters (Rpresense and Rpostsense in FIG. 60). Hence, the algorithms and methods described herein can be implemented by adjusting the values of these two parameters.

Figure 61:
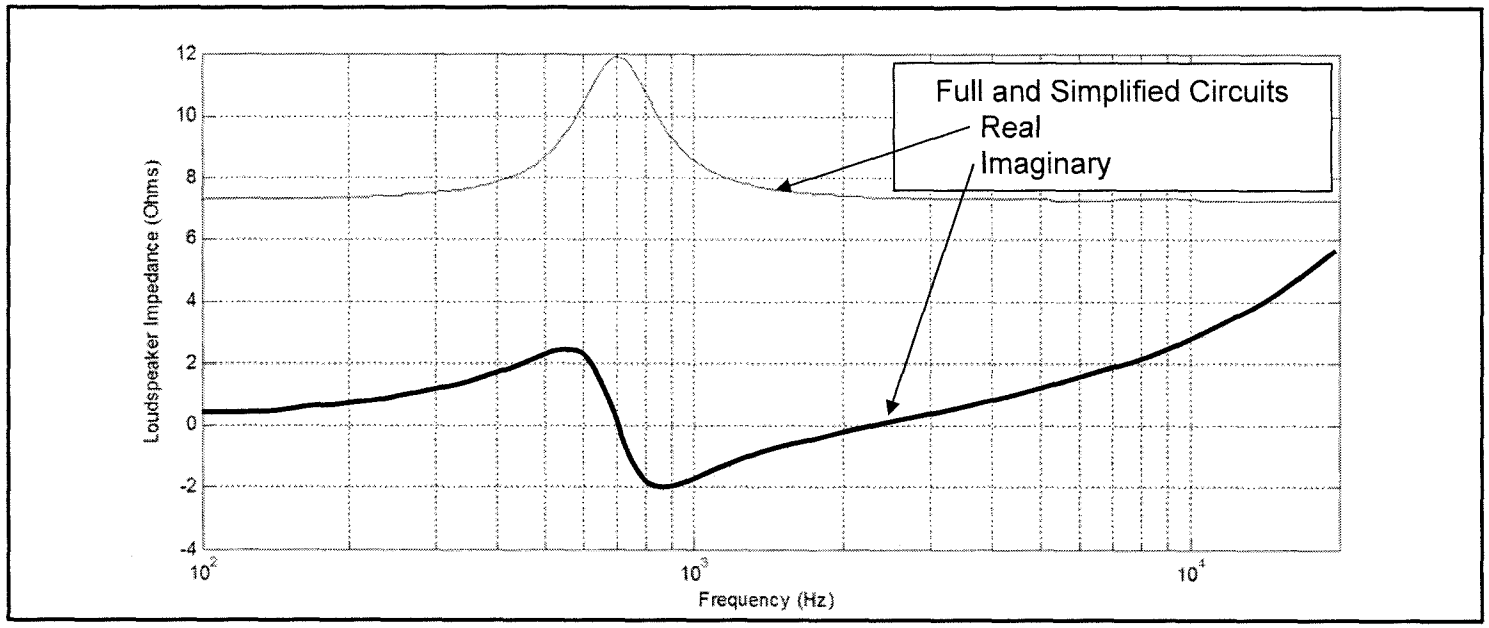
FIG. 61 depicts a difference in impedance of the loudspeaker when the circuits of FIG. 59 and FIG. 60 are placed in series, according to non-limiting implementations.

The Acoustic Circuit Modelling tool was used to simulate the effect of simplifying the external circuitry. The loudspeaker impedance was measured as it would be by the algorithm for both the Full (FIG. 59) and the Simplified (FIG. 60) circuits (Rpresense is more precisely about 1.724Ω). The result is depicted in FIG. 61. Quantitatively, the maximum difference between the curves is the full circuit and the simplified circuit is about 1.1+0.9 i mΩ anywhere and about 0.1+0.1 i mΩ below 4 kHz.

Figure 62:
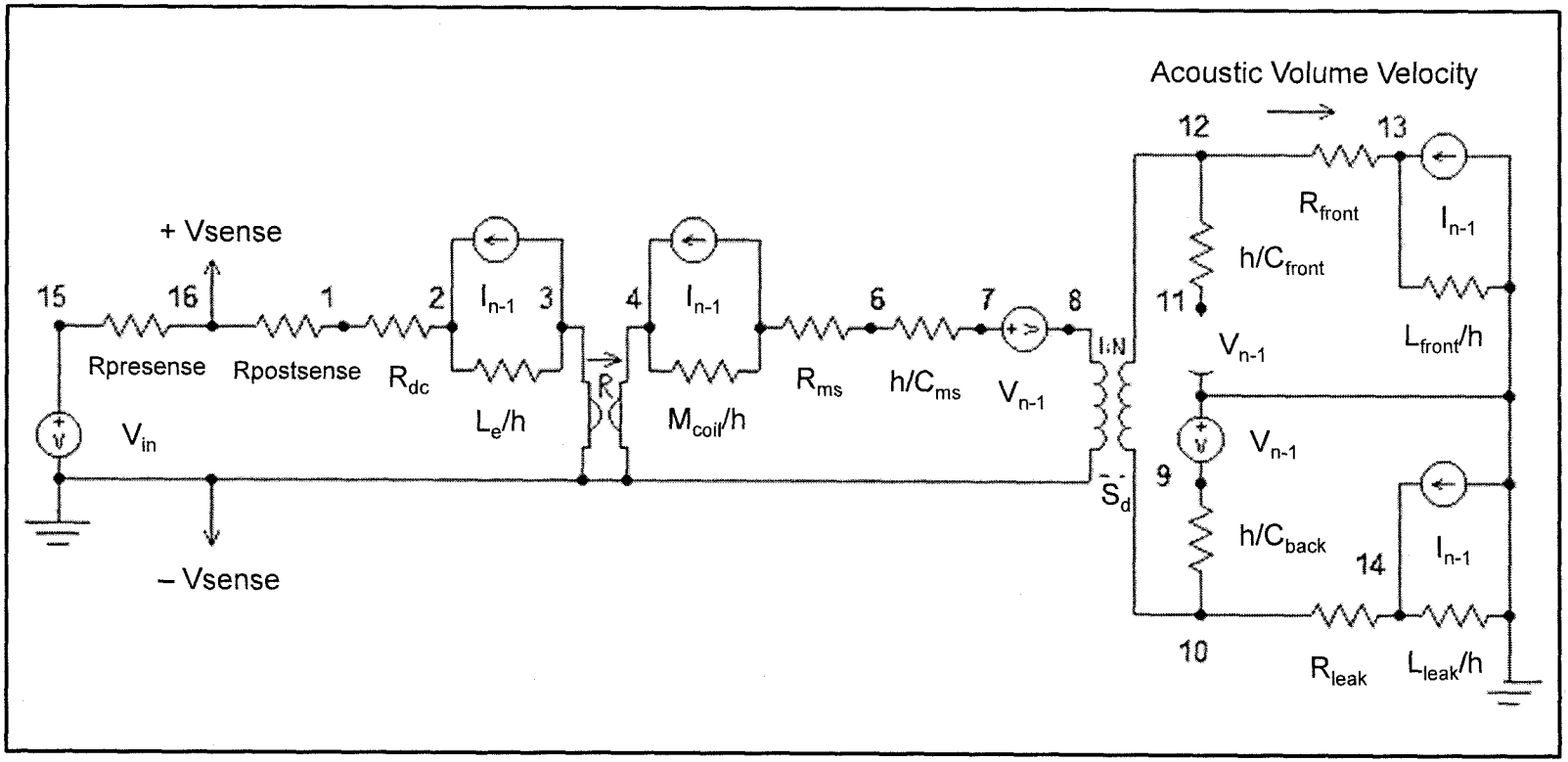
FIG. 62 depicts a time step loudspeaker model with external circuitry, according to non-limiting implementations.

With the external circuitry, the time step model in FIG. 50 becomes as depicted in FIG. 62.

10.8 Compensating for External Electrical Circuitry

The external circuitry depicted in FIG. 60 can also affect measurement of the loudspeaker voltage as there is a resistor ($R_{postsense}$) in series with the loudspeaker after the 4 wire measurement point. Further, the voltage at the output of the loudspeaker amplifier, will not be the same as the voltage across the loudspeaker. When a particular voltage is to appear across the loudspeaker, it can be pre-compensated for the external components before applying it to the loudspeaker amplifier, similar to the situation in Section [00309]; hence, similar techniques can be applied to the external circuitry depicted in FIG. 60.

10.8.1 Compensating the Input Voltage Measurement

Firstly, the effect $R_{postsense}$ has on the loudspeaker voltage measurement can be compensated for, as in Equation (39):

$$V_{Spkr}=(V_{+sense}-V_{+sense})-R_{postsense}I_{Spkr} \tag{56}$$

10.8.2 Compensating the Output Voltage

A voltage ($V_{Spkr}$) that is to be applied across the loudspeaker can be calculated, however, access to the loudspeaker terminals can be challenging, as $R_{presense}$ and $R_{postsense}$ are generally physically in the way as can be seen in FIG. 60. Hence, calculation of the amplifier-from-loudspeaker transfer function ($H_{AL}$) can occur. Applying $H_{AL}$ to $V_{Spkr}$ will transform it to the voltage ($V_{amp}$) used to apply to the amplifier in order to have $V_{Spkr}$ appear across the loudspeaker.

The most comprehensive way to derive $H_{AL}$ is to use Frequency Domain LMS. However, it will be easier and sufficient to approximate $H_{AL}$ from the known parameters and a few assumptions.

For example, it can be assumed that $R_{presense}$ and $R_{postsense}$ are both purely resistive and that their values are known. In one non-limiting implementation, they can be constant and can be programmed into a device at manufacturing time and/or during a provisioning step. $V_{Spkr}$ can be expressed as:

$$V_{spkr}=V_{amp}-I_{spkr}(R_{presense}+R_{postsense}) \tag{57}$$

Further, the electrical current-from-voltage transfer function of the loudspeaker ($H_{IV}$) can already be calculated and/or obtained using techniques described above. Therefore the loudspeaker current can be written as $I_{spkr}=V_{spkr}H_{IV}$, giving an approximate amplifier-from-loudspeaker transfer function ($H_{AL}$):

$$H_{AL}=1+H_{IV}(R_{presense}+R_{postsense}) \tag{58}$$

In practice, $H_{IV}$ is known up to the "dovetail frequency" ($f_1$). However, compensation of the loudspeaker can occur only below this frequency in order to effectively apply the excursion limited signal. Because the dovetail frequency is substantially above the loudspeaker resonance, a reasonable approximation to $H_{IV}$ above the dovetail frequency is:

$$H_{IV}]_{f>f_1} \approx \frac{1}{R_{vc}+i\omega L_{vc}} \tag{59}$$

This approximation can be dovetailed onto the $H_{IV}$ known at lower frequencies by setting:

$$H_{IV}]_{f>f_1} = H_{IV}(f_1)\frac{R_{vc}+2\pi i f_1 L_{vc}}{R_{vc}+2\pi i f L_{vc}} \tag{60}$$

Figure 63:
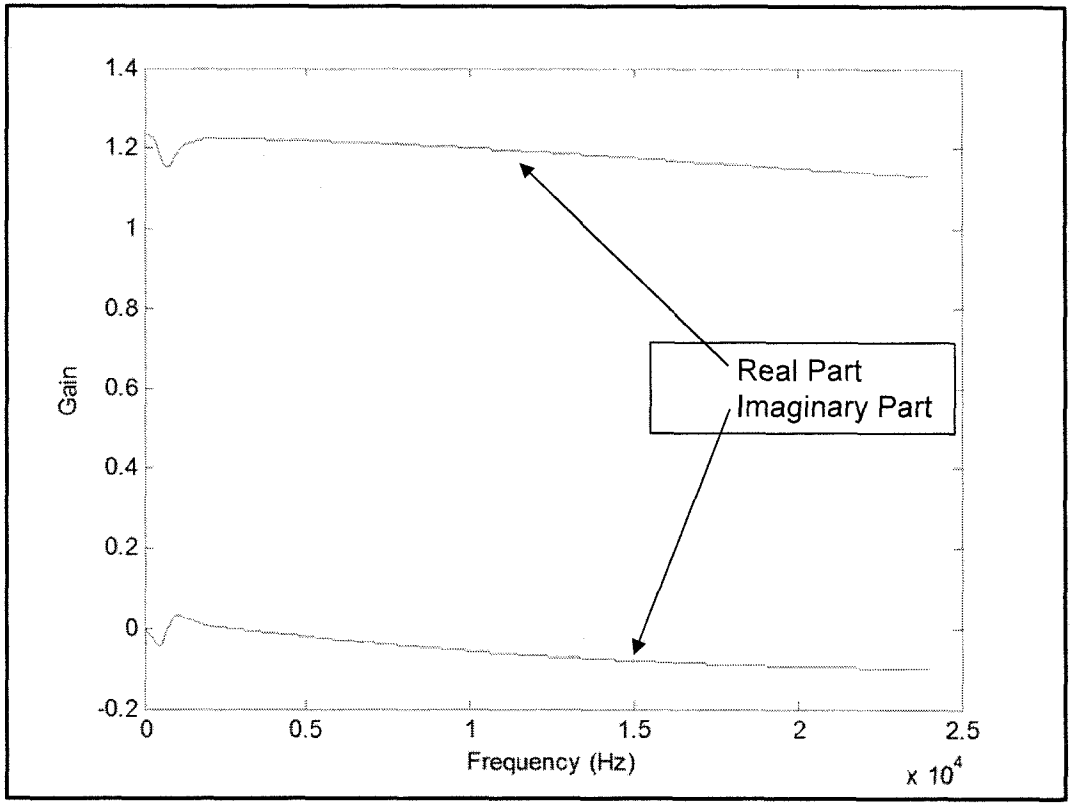
FIG. 63 depicts a transfer function that compensates the effects of external circuitry, according to non-limiting implementations.

It can be reasonably expected that the real part of $H_{AL}$ would be close to one and the imaginary part close to zero. One example implementation of $H_{AL}$ is depicted in FIG. 63.

11 System EQ/Compression/Limiting 11.1 System Scope

Figure 64:
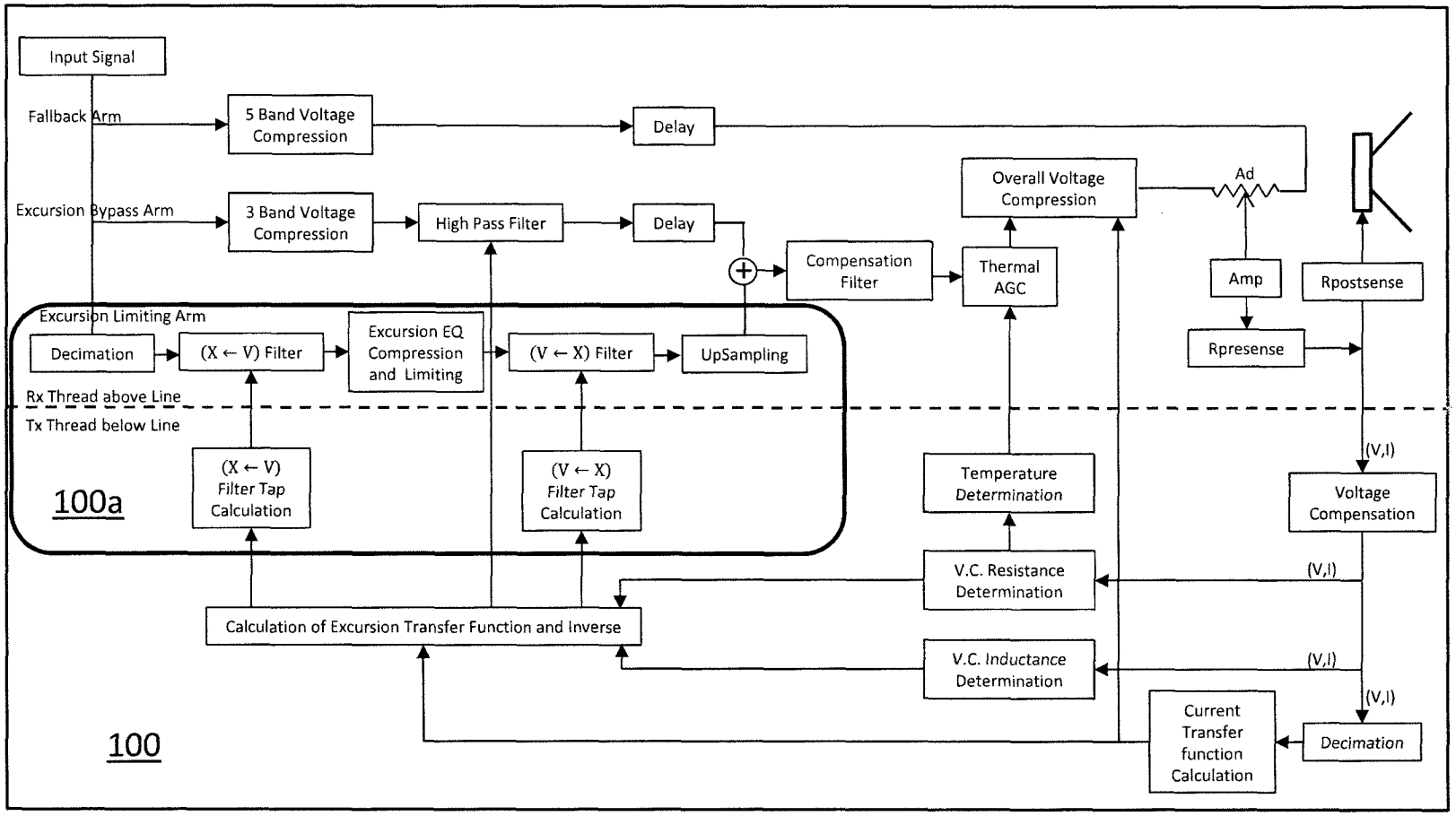
FIG. 64 depicts a Loudspeaker Control System, according to non-limiting implementations.

Attention is next directed to FIG. 64, which depicts a non-limiting implementation of a block diagram of a loudspeaker system 100 that can be provided in a device. Specifically, an input signal is processed by series of filters, delays, attenuators, etc., in order to drive a loudspeaker according to present implementations. The components of loudspeaker control system 100 depicted in FIG. 64 can be implemented as hardware and/or software, and can comprise one or more processors, digital signal processors (DSPs), and the like configured to implement algorithms and/or methods described herein. The heretofore described equalization, compression and limiting occur in at least four places in the example implementations depicted in FIG. 64:

1. At a temperature regulation portion (for example, thermal AGC; see Section [00169]).

2. At a fallback arm (which engages when the loudspeaker control system 100 of FIG. 64 determines that the input signal and/or other parameters are outside of given operating conditions: i.e. the fallback arm is utilized when the loudspeaker control system 100 cannot otherwise determine how to drive the loudspeaker).

3. At an excursion limiting arm

4. At an excursion bypass arm

In particular, FIG. 64 depicts a loudspeaker control system 100 that can be used to implement methods and/or algorithms described herein. The architecture of the loudspeaker control system 100 of FIG. 64 is adapted for a DSP in which processing occurs in two threads and/or in two cores of the DSP, the two threads labelled Rx and Tx in FIG. 64. In particular, the thread Rx is configured to apply filtering to an input signal received at an input of the loudspeaker control system, while the thread Tx is configured to determine the excursion-from-voltage transfer function, $H_{XV}(\omega)$, and an inverse voltage-from-excursion transfer function, as well as associated filter coefficients for each (i.e. filter tap coefficients).

For example, in FIG. 64 a Fallback Arm (top portion of loudspeaker control system 100 in FIG. 64) comprises: a 5 band voltage compressor and a delay device. When the loudspeaker control system 100 identifies that it cannot properly determine the excursion-from-voltage transfer function, the loudspeaker control system 100 switches to this default arm as depicted by the switch labelled "Ad" in FIG. 64.

An Excursion Bypass Arm comprises: a 3 band voltage compressor, a high pass filter (which can receive the excursion-from-voltage transfer function, $H_{XV}(\omega)$, and/or inverse voltage-from-excursion transfer function as an input from thread Tx), a delay device, an adding device configured to add an upsampled filtered output signal (as described below) to the input signal being processed by the Excursion Bypass Arm. The combined signal is received by a compensation filter, which is then received by an optional thermal auto-gain control (AGC) filter, as described above in Section 4.2. An overall voltage compressor, which provides a further compression to an output signal then applies the output signal to the switch Ad.

An Excursion Limiting Arm applies in the Rx thread and applies the filtering from the excursion-from-voltage transfer function, $H_{XV}(\omega)$, and an inverse voltage-from-excursion transfer function, which are calculated in the Tx thread. The +Vsense and −Vsense points, shown in detail in FIG. 59 can be used to determine voltages across the loudspeaker voice coil. The currents through the voice coil can be determined by a shunt resistor or other process such as corrected power supply currents. These voltage and current signals are received at a voltage compensator in the Tx thread which compensates the voltage for Rpostsense. Resistance and inductance of the voice coil can be determined using these voltage and current signals. A decimation portion receives the voltage and current from the voltage compensator, which provides an out to a portion that calculates the current-transfer function, as described above. Output from each of the resistance determination, the inductance determination and the current transfer function determination are input to a calculation of the excursion-from-voltage transfer function $H_{XV}(\omega)$, and the inverse using, for example Equation (13). Filter tap coefficients are then calculated, and received at an Excursion Limiting Arm of the Rx thread.

The Excursion Limiting Arm comprises a decimation portion, an excursion-from-voltage filter (X←V), which receives the excursion-from-voltage (X←V) tap coefficients from the Tx thread, an Excursion EQ compression and limiting portion, a voltage-from-excursion filter (V←X), which receives the voltage-from-excursion (X←V) tap coefficients from the Tx thread, and which outputs the resulting filtered signal to an upsampler, which in turn provides the upsampled filtered output signal to the Excursion Bypass Arm as described above.

In any event, it is appreciated that FIG. 64 shows both different types of filters and calculations which are performed by one or more of a processor, a DSP, a loudspeaker circuit and the like, and hence the functionality of the loudspeaker control system 100 of FIG. 64 is implemented using hardware configured to perform the various described functions. Furthermore, while the functionality of the loudspeaker control system 100 of FIG. 64 is implemented in two threads, in other implementations the functionality can be implemented in a single thread and/or in parallel and/or using any combination of processors, and the like, which can be configured to perform the functionality at digital signal processing rates. Various details of the loudspeaker control system 100 of FIG. 64 will be described hereafter.

When the excursion compression is engaged, low frequency compensation is applied in the excursion domain. This is a form of level dependent equalization described in below (see Section 11.8). Traditional voltage compression can also be applied to the reconstituted signal so that the applied signal does not drive the amplifier past full scale. This compression can be set to a significantly higher voltage than the fallback arm.

11.2 Use of Terms

In order to avoid ambiguity and overlap for the terms "equalization", "compression" and "limiting" as used herein, it is appreciated that the following term usage is applied herein:

Equalization, (a.k.a "EQ", "Filtering") can be defined as an electronic filter applied to the loudspeaker signal. It could be static or adaptive.

Compression, (a.k.a "Dynamic Range Compression", "DRC") can be defined as gain reduction in certain frequency bands based on the input signal level within those bands. Compression can be dormant while this input signal is below a threshold level. Once over the threshold, the gain can reduced up to a value called the "Ratio". The "attack time" can comprise a time constant of the gain reduction, once the input level has exceeded the threshold. The "release time" can comprise the time constant over which the gain returns to the uncompressed level once the input signal falls below the threshold. Generally, the attack time is shorter than the release time and often markedly so. Downward compression can reduce loud sounds over a certain threshold while quiet sounds remain unaffected. Upward compression can increase the loudness of sounds below a threshold while leaving louder passages unchanged.

Expansion, (a.k.a "Dynamic Range Expansion") can be defined as an opposite operation to compression. A "noise gate" is an example of Dynamic Range Expansion AGC (Automatic Gain Control) can comprise a form of compression applied to an entire frequency band. AGC can, for example, act slower than compression to set the general level of the signal.

Limiting can be defined as an instantaneous change in the gain based on level. Limiting can be similar to compression but is distinguished by very short attack and release times and the capability of drastic gain reduction. Limiting is generally used as a last resort.

11.3 Goal

The goal of algorithms and/or methods described herein is to apply these tools so that the resulting audio sounds pleasant to a user irrespective of the signal content. This is a subjective goal, so the tuning of the parameters defined above can performed by an audio specialist and/or by a user after listening to various audio files used as input signals to the loudspeaker control system of FIG. 64. However, the subjective goals generally aligns with the following objective goals:

1. Maximize musical bandwidth
2. Maximize loudness
3. Minimize noise
4. Minimize distortion Hence, at least initial values for the parameters of the loudspeaker control system 100 of FIG. 64 can be selected based on these goals, processors and the like selecting the parameters by comparing an output signal at the loudspeaker to one or more thresholds associated with the above objective goals (e.g. bandwidth thresholds, loudness thresholds, noise thresholds and distortion thresholds) and adjusting the output signal accordingly in a feedback loop. A user can provide further tuning thereafter.

11.4 Traditional Voltage EQ/Compression/Limiting Parameters

Present implementations lead to dynamic parameters for EQ/Compression/Limiting. However, such parameters can also be set to be constant, as is often done traditionally, for example using the fallback arm. The functionality of the fallback arm of the loudspeaker control system 100 of FIG. 64 is described hereafter.

11.4.1 Equalization

Above 2 kHz, the fallback arm can flatten the response by equalizing the peaks and trends in the response. Peaks can be removed with notch filters, but the Q is generally selected so as to not exceed ~$1/3^{rd}$ octave because component tolerances can shift the actual peak away from the filter notch resulting in non-flat response and "ringing sounds". It can be more deleterious to amplify notches in the response with band pass filters as a mismatch can result in instability and poor performance. Further, notches in the response may not be as audible as peaks so they can generally be left alone and/or only provided with minimal EQ.

Below 2 kHz, the fallback arm can flatten out the loudspeaker resonance and limit the diaphragm excursion. In addition to the notch filter used to flatten the loudspeaker resonance, a high pass filter can be added below resonance (~350 Hz) because the loudspeaker can't provide any meaningful acoustic response, and in this region here will limit the excursion at higher frequencies.

11.4.2 Compression

Compression can be provided in two bands above and below 1350 Hz. The objective in the lower band is to avoid distortion (and usually has a lower threshold than the upper band. The objective in the upper band is to reduce the crest factor to accommodate finite voltage rails.

A low compression band comprises the frequencies below, at and just above the resonant frequency of the loudspeaker, can be tuned first so that the upper frequency distortion harmonics are removed first. Then the upper compression band can be tuned to balance the lower band. Such tuning can occur using listening tests, and/or automatically.

11.4.3 Limiting

Some hard limiting of the loudspeaker voltage can be applied to avoid voltage clipping and/or digital overflows in the amplifier. A minimal amount of limiting can be used to optimize the compression, also because the harmonics generated can give the impression of an overall loudness increase.

11.5 Dynamic Voltage EQ/Compression/Limiting

The parameters for fixed EQ/Compression/Limiting in the fallback arm can be set at design time and do not change. However, algorithms and/or methods described herein can be used for dynamic EQ/Compression/Limiting; such dynamic EQ/Compression/Limiting can occur in a DSP and/or a processor and/or the loudspeaker control system 100 of FIG. 64, and furthermore such parameters can be optimized in real time Design parameters for some non-limiting implementations are described hereafter.

11.5.1 Compression Bands

There can be 4 Compression Bands plus one overall compression band after the sum. Compression is applied individually to these 4 bands. The results for all of these bands is then summed together and a $5^{th}$ compression is performed on this sum to provide the final output. Each band can be associated with an enable switch (for example to save MIPS (million instructions per second), when a band is not needed, the band can be disabled, and later enabled, using the associated enable switch).

11.5.2 Compression Gain

Furthermore, an instantaneous value of Compression Gain corresponding to each Compression Band can be provided. The signal in each band can be multiplied by the Compression Gain before being summed to the final output. The Compression Gain can comprise a linear gain value between 0 and 1.

11.5.3 Limiting

The instantaneous, absolute signal in the "overall band" can be hard-limited to a maximum number. However, the compression parameters can be set such that this hard limiting would hardly ever occur. The value of this number depends on which arm the compressor is on:

FallBack Arm: the maximum number used by the fallback arm can comprise and/or represent the maximum voltage that can be safely applied to the loudspeaker.

Excursion arm: the maximum number used by the excursion arm can comprise and/or represent a manufacturer's maximum allowed excursion level.

Excursion Bypass Arm: the maximum number used by the excursion bypass arm can comprise and/or represent an allowed maximum band gain ratio times the value for the Excursion arm, or the amplifier clipping level, whichever is less.

11.5.4 Compression Threshold

In some implementations, a compression threshold can be set at about 15 dB below the hard limiting level, however other values are within the scope of present implementations.

11.5.5 Attack Time Constant

The compression threshold can be compared to an output of an "Energy Detector", which can also be referred to interchangeably as an "Envelope Detector":

Envelope detector: can be provided with a first order (RC=Attack Time Constant) filtered version of the absolute value of the signal. In some implementations, an Attack Time Constant of about 0.1 ms can be used, however other values are within the scope of present implementations.

11.5.6 Compression Ratio

Below a threshold (e.g. $V_t$), the output (e.g. $V_0$) rises dB-for-dB with the input (e.g. $V_i$). Above the threshold, the output level rises 1 dB for every R dB rise of the input where R is the compression ratio. Hence, in some implementations, a very high (essentially infinite) Compression Ratio can be used i.e. the output level is not allowed to rise above the threshold level.

11.5.7 Hold Time

The compression gain can be held at the level it was last set by the attack criteria for an interval of "Hold Time" seconds before beginning the decay. (When the compression level is re-set during the hold interval, the hold interval can be re-started). In some implementations, the Hold Time can be set to about twice the period of the lowest frequency in the corresponding compression band, however other values are within the scope of present implementations.

11.5.8 Decay Time

After the compression gain has been last set by the attack criteria, then after the Hold Time, the compression gain will exponentially approach unity with a time constant equal to the Decay Time. In some implementations, the Decay Time can be set to about 400 ms, however other values are within the scope of present implementations.

11.5.9 Makeup Gain

Some implementations can include a (constant) Makeup Gain after compression. In some implementations, the Makeup Gain can be set to 0 dB, however other values are within the scope of present implementations.

11.5.10 Sanity checks

In some implementations, a "sanity check" can be performed on one or more of the parameters that have logical limits. For example, it can be determined whether the cross-over frequency is within a logical limit (e.g. <about 600 Hz) and, when not, the fallback arm can be used.

11.6 Voltage Compression Example

A non-limiting example of voltage compression is now described. Below threshold ($V_t$), the output ($V_0$) rises dB for dB with the input ($V_i$). Above the threshold, the output level rises 1 dB for every R dB rise of the input where R is the compression ratio as follows:

$$V_0 = \begin{cases} V_i \text{ for } V_i < V_t \\ V_t + \dfrac{(V_i - V_t)}{R} \text{ for } V_i \geq V_t \end{cases} \tag{61}$$

Equation (61) can also be written in terms of compression gain (G):

$$G = \begin{cases} 0 \text{ for } V_i < V_t \\ (V_i - V_t)\left(\dfrac{1}{R} - 1\right) \text{ for } V_i \geq V_t \end{cases} \tag{62}$$

Figure 65:
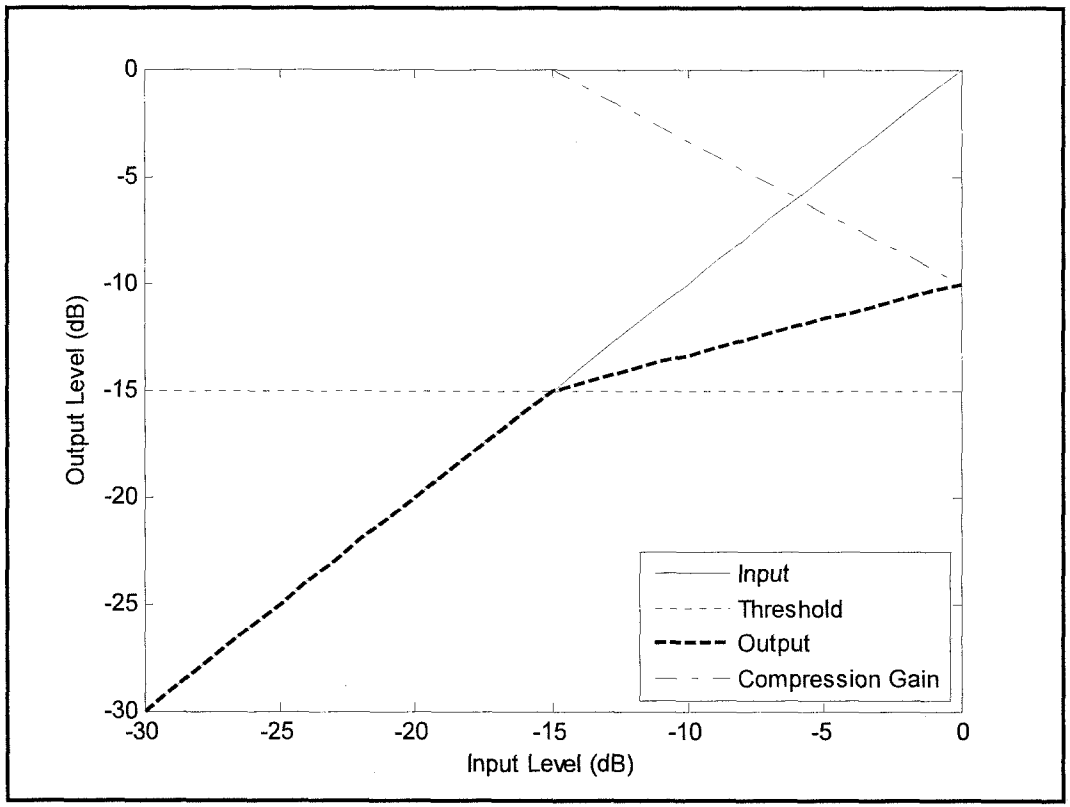
FIG. 65 depicts definitions of various compression parameters, according to non-limiting implementations.
Figure 66:
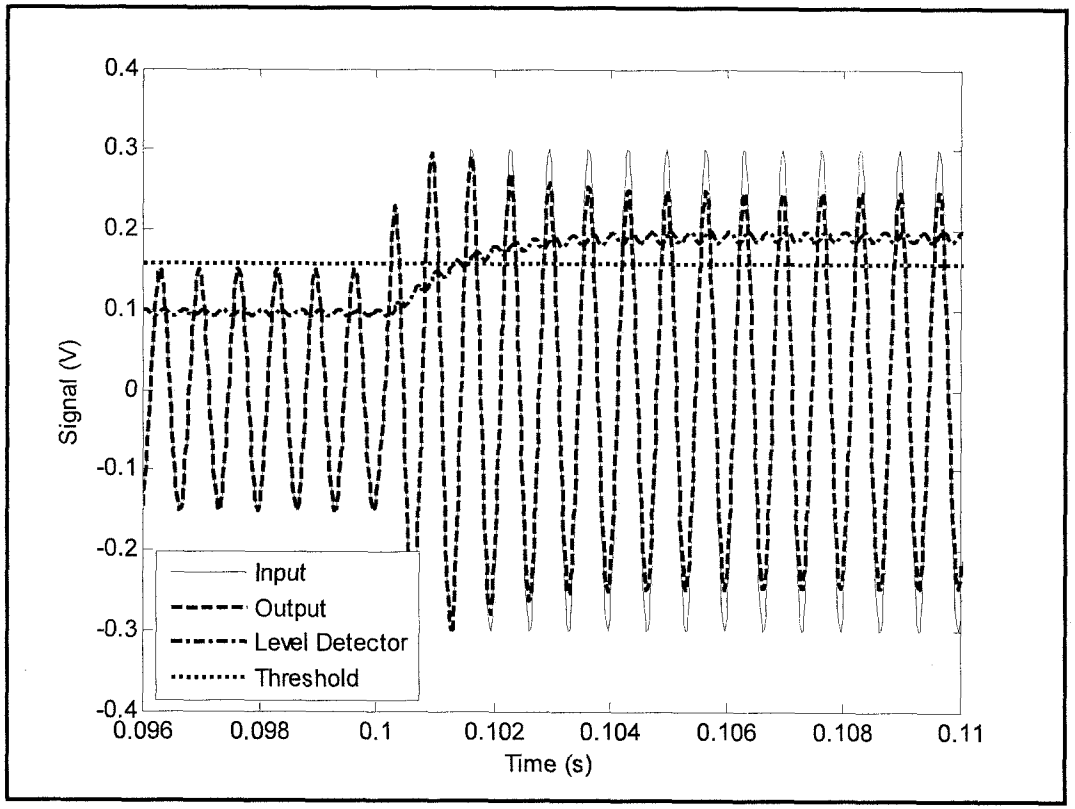
FIG. 66 depicts an example of compressor attack, according to non-limiting implementations.
Figure 67:
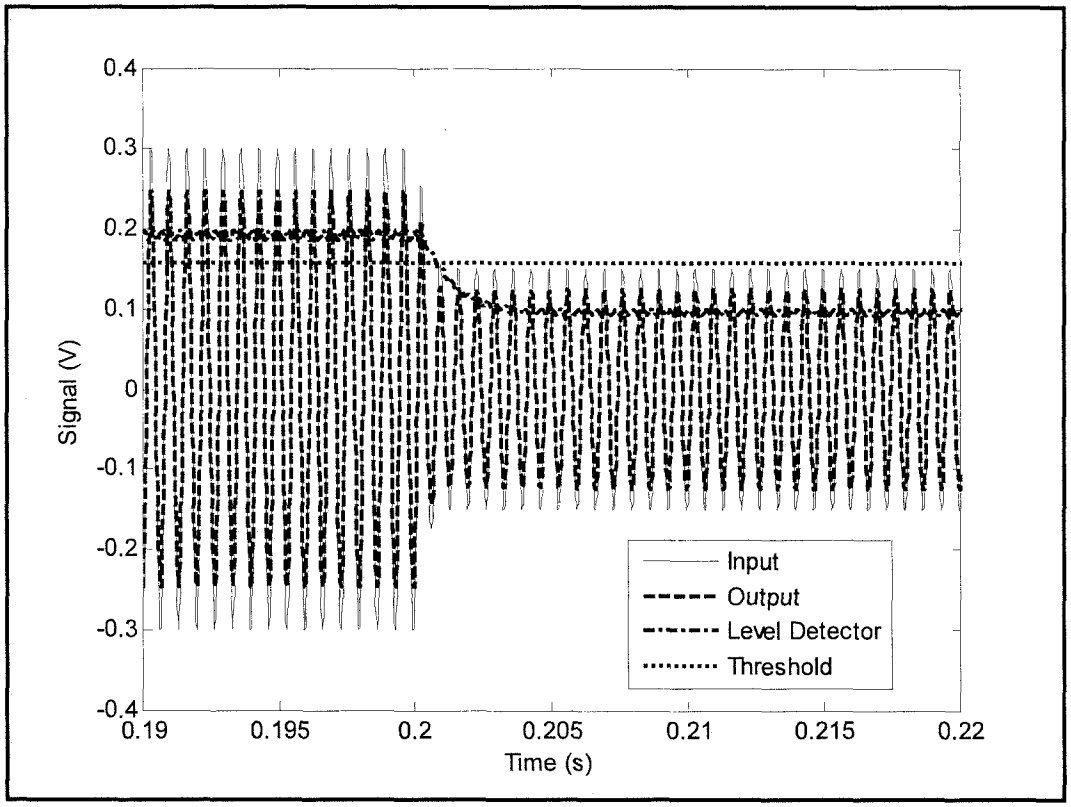
FIG. 67 depicts an example of compressor decay, according to non-limiting implementations.
Figure 68:
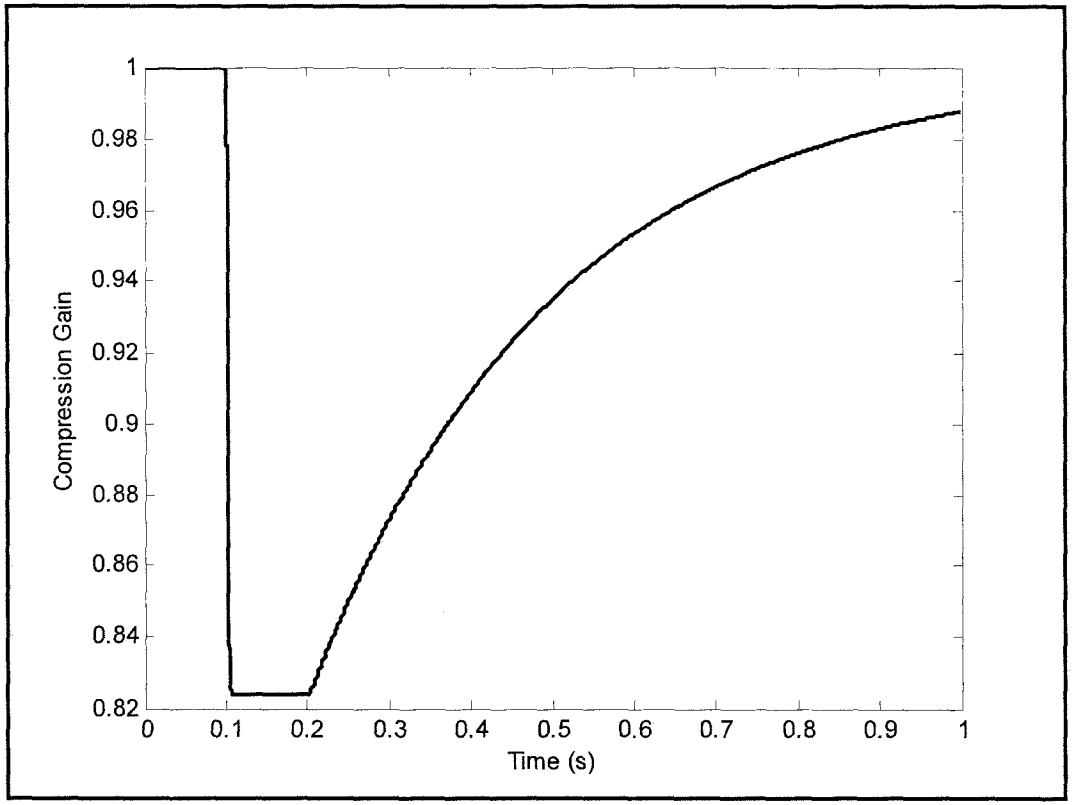
FIG. 68 depicts an example of compressor gain, according to non-limiting implementations.
Figure 69:
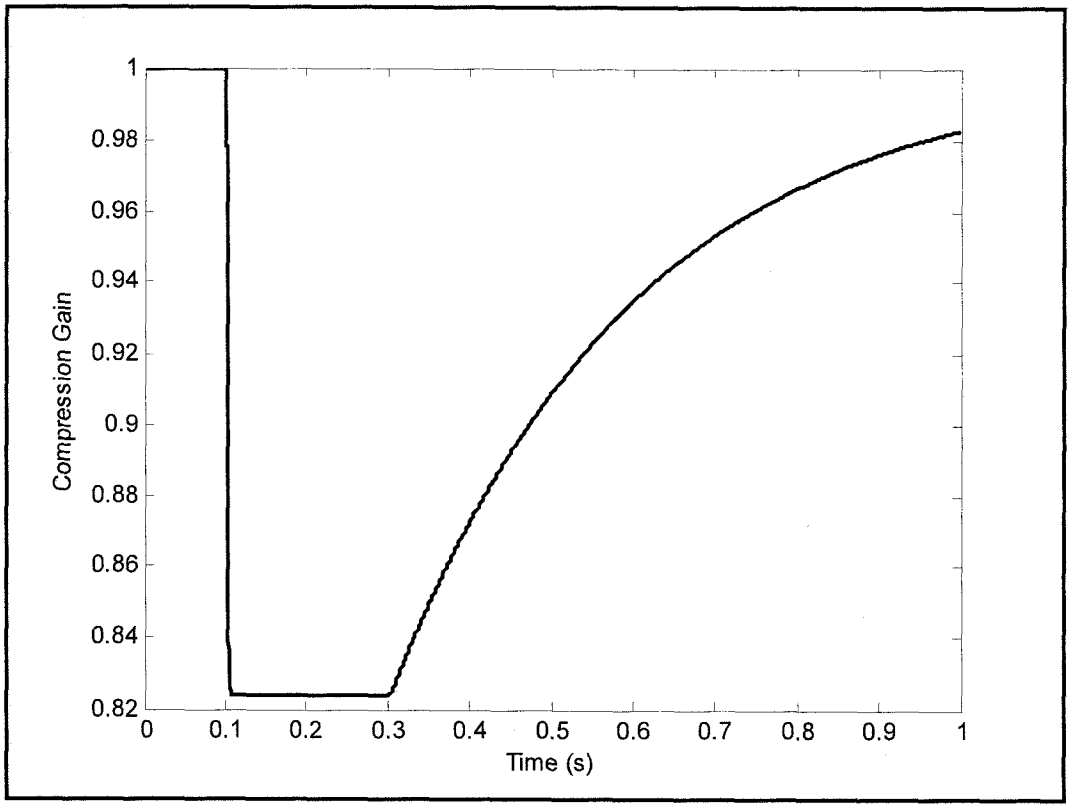
FIG. 69 depicts an example of compressor hold time, according to non-limiting implementations.

Equation (61) is further depicted in FIG. 65.

Gain can also be expressed as linear values, (except R which is still expressed in dB):

$$G = \begin{cases} 1 \text{ for } V_i < V_t \\ \left(\dfrac{V_i}{V_t}\right)^{\left(\frac{1}{R}-1\right)} \text{ for } V_i \geq V_t \end{cases} \tag{63}$$

The resulting "Attack Time", "Decay time", "Compression Gain" and "Hold Time" are respectively depicted in FIGS. 66, 67, 68 and 69. These Figures show that increasing the hold time to the maximum period for that band stopped the compression gain from varying for a periodic input.

11.7 Band Filtering

Figure 70:
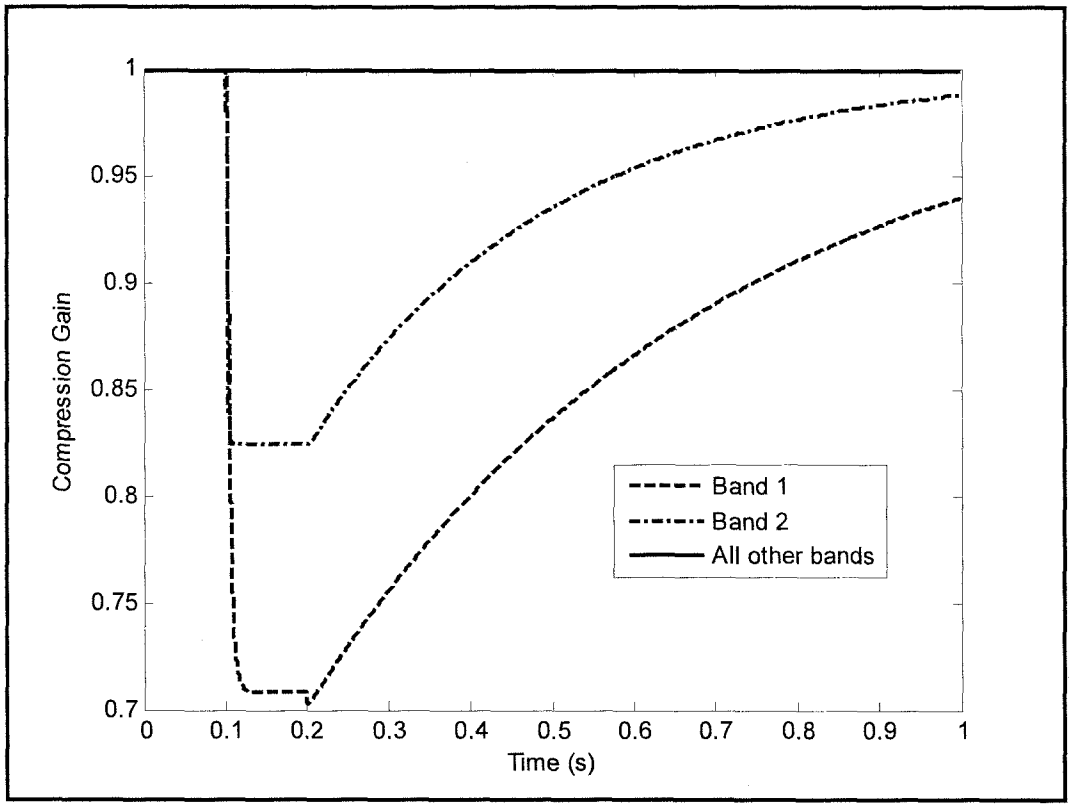
FIG. 70 depicts an example of sinusoidal wave compression at a frequency between bands, according to non-limiting implementations.

The compression can applied in different frequency bands. In some implementations, an input signal can first be split into 4 bands, and compression is performed in each band; the results are then combined, and a $5^{th}$ compressor can be applied to the sum. When a sine wave is applied between bands, both bands respond to apply the compression as depicted in FIG. 70

Figure 71:
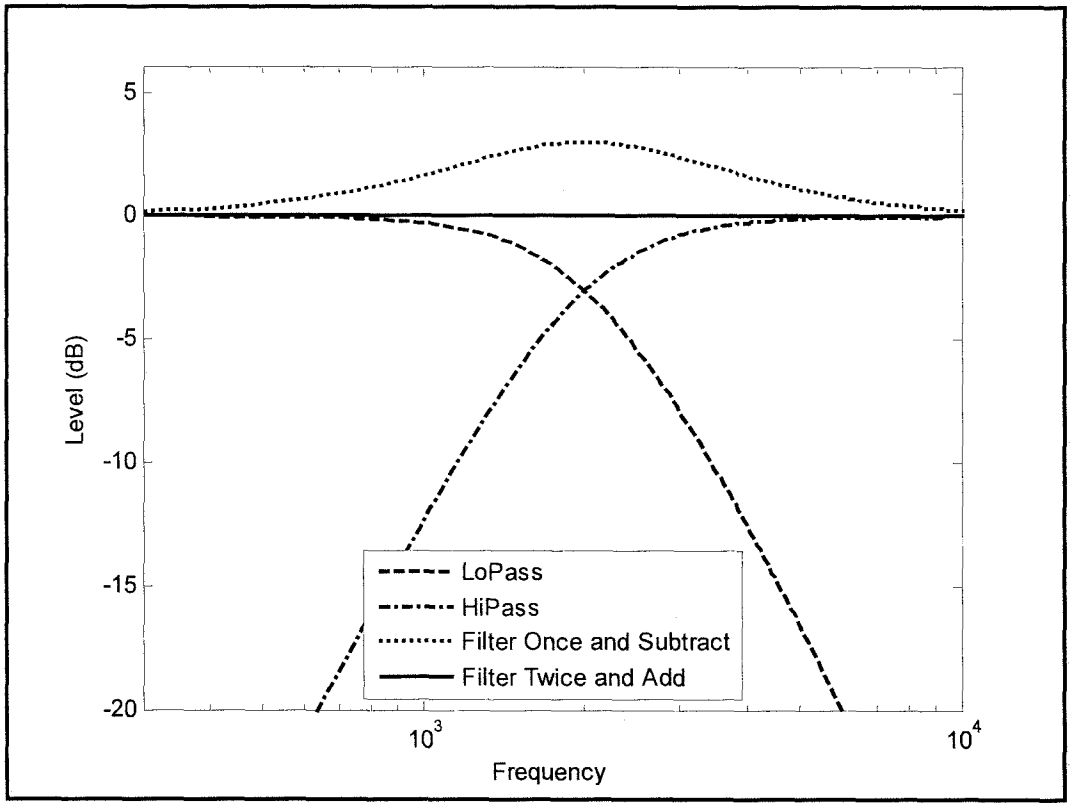
FIG. 71 depicts a special property of Butterworth filters amplitude, according to non-limiting implementations.
Figure 72:
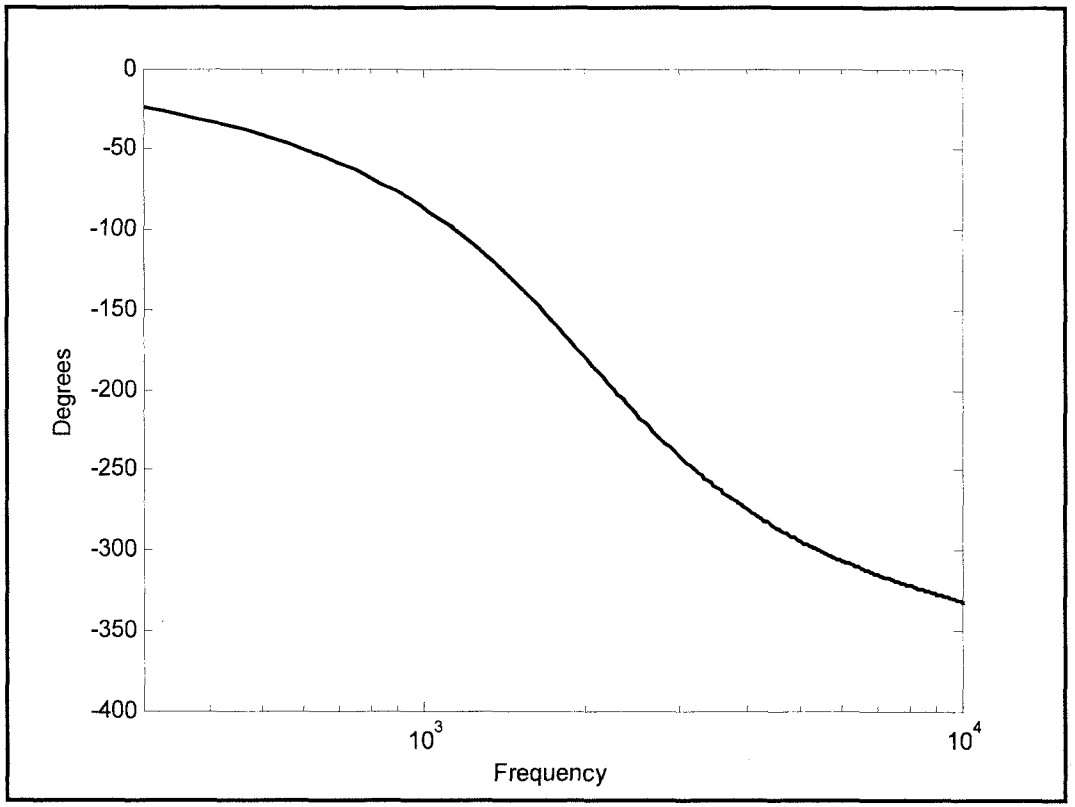
FIG. 72 depicts a special property of Butterworth filters phase, according to non-limiting implementations.

For two bands, there a useful property of second order Butterworth Filters can be used, as depicted in FIGS. 71 and 72: when the data is sent through the filters twice (making the filter order 4), then adding the results back together provides a flat frequency band with a slow phase change that is within acceptable limits.

Unfortunately, such this cannot be applied to more than two bands. Using given crossover frequencies, which can be selected based on the bandwidth of the input signal, and/or be set at fixed valued (for example, 1350, 4500 and 9500 Hz), a sum of multiple Butterworth Filters can be used, as depicted in FIG. 73.

Figure 73:
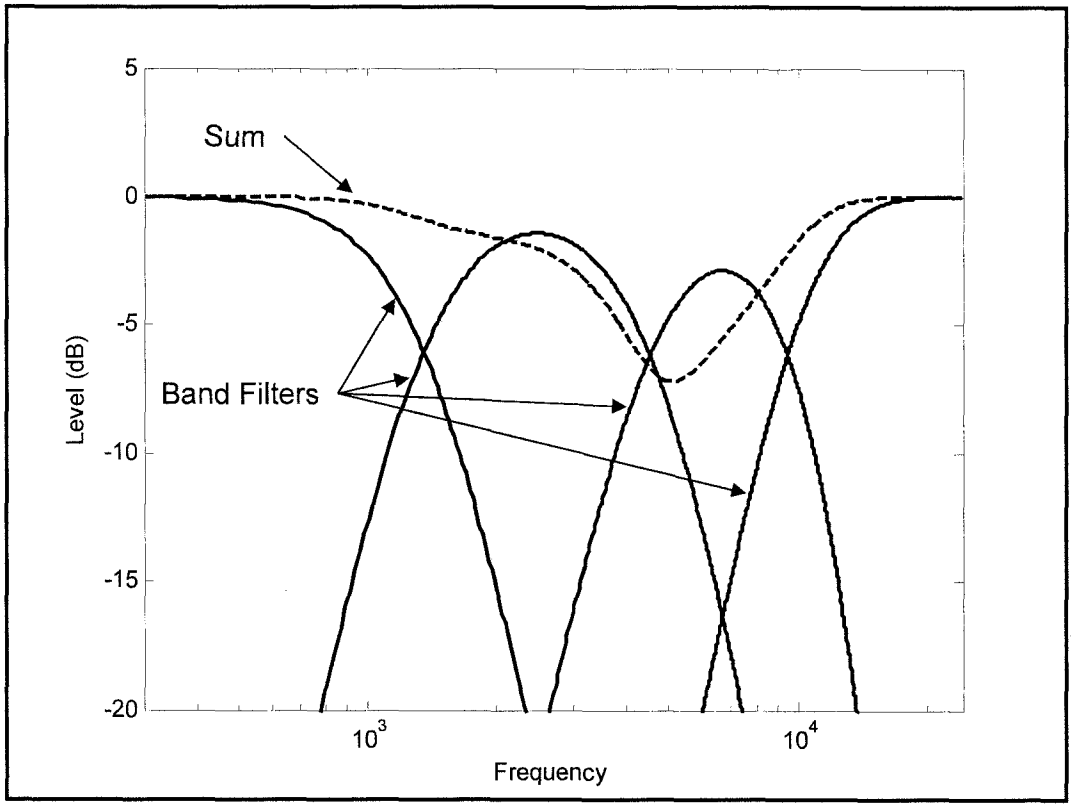
FIG. 73 depicts a use of multiple Butterworth filters, according to non-limiting implementations.
Figure 74:
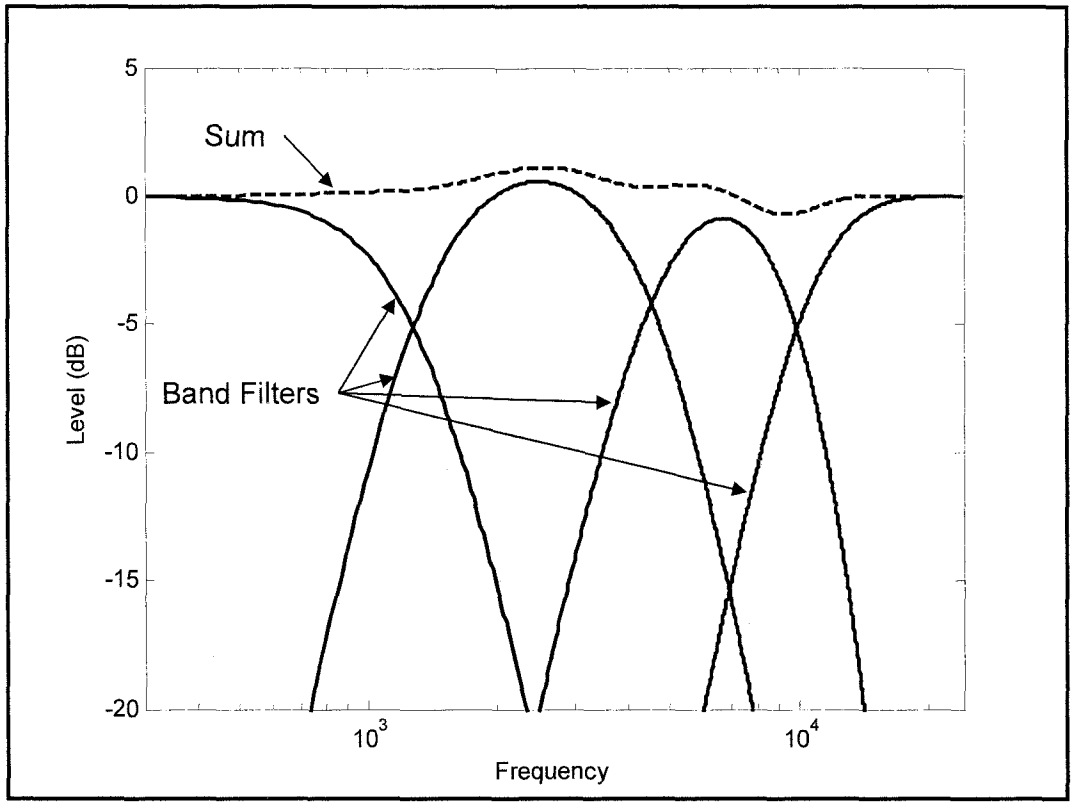
FIG. 74 depicts an amplitude of another implementation of multiple Butterworth filters, according to non-limiting implementations.
Figure 75:
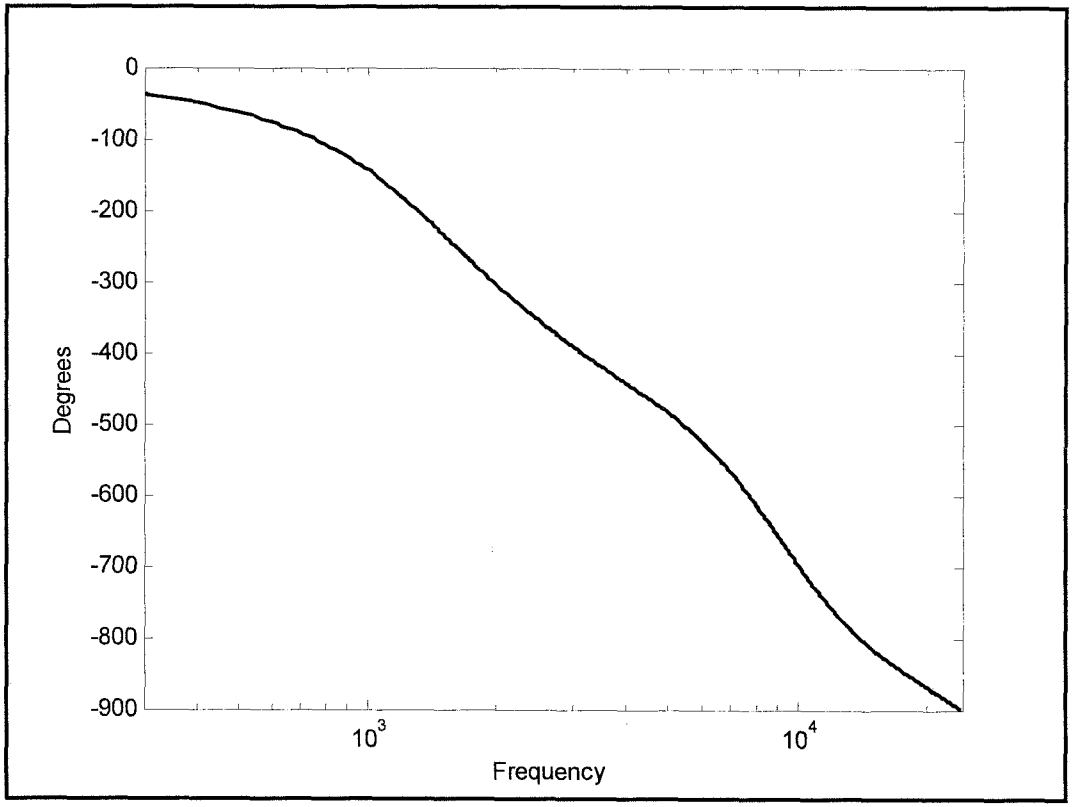
FIG. 75 depicts a phase of another implementation of multiple Butterworth filters, according to non-limiting implementations.

The notch depicted in FIG. 73 around 5 kHz is caused by interference between the band filters. However, when the first two bands are added, and the last two bands are subtracted, the result is a set of band filters that adds up to a fairly flat response. In some implementations and additional gain can be added to bands 2 and 3, for example about 0.7 dB, so that the summed band is flat within 0.5 dB. The amplitude and phase of this result is shown in FIGS. 74 and 75 respectively 11.8 Excursion Domain Gain Balancing/EQ/Compression/Limiting Present implementations can generally enable compression in the excursion domain using, for example, equalization, compression and/or limiting. Unlike traditional EQ, the presently disclosed EQ (i.e. equalization) can be dynamic, depending on the excursion. Furthermore, a determination of absolute excursion, as disclosed herein, can provide calibration of a relative acoustic level, and/or an absolute acoustic level produced by a loudspeaker. In particular, the following describes implementations of the "Excursion EQ Compression and Limiting" portion of loudspeaker control system 100 in FIG. 64.

11.8.1 Loudspeaker Relative Level

The major causes of sensitivity variation among loudspeakers are voice coil variations and mechanical suspension variations. Both of these affect the excursion of a loudspeaker but using techniques described herein, excursion of a voice coil can be determined regardless of these variations. Loudspeakers of similar design will have the same acoustic output for the same excursion. By adjusting drive gain to make the excursions between loudspeakers similar, techniques disclosed herein can be used to effectively eliminate and/or reduce and/or minimize loudspeaker sensitivity variations due to these causes, for example in systems of loudspeakers.

Such a technique can be used to automatically balance the sensitivity of multiple drivers within a multi-way loudspeaker enclosure (e.g. in a loudspeaker system comprising a plurality of loudspeakers, for example a woofer, and a tweeter). Such a technique can also be used for automatically balancing sensitivity of stereo pairs, and/or sensitivity in multiple loudspeaker enclosures such as in concert halls and for outdoor concerts.

11.8.2 Loudspeaker Absolute Level

From elementary loudspeaker theory, the pressure, p, at a distance r from a simple loudspeaker with a sealed back cavity is given by:

$$p = \frac{\rho S_d}{4\pi r}\ddot{x} \tag{64}$$

Where ρ is the density of a medium, $S_d$ is an area of the loudspeaker diaphragm, and $\ddot{x}$ is a second time derivative of the excursion-from-voltage transfer function, for example as defined in Equation (13). The pressure p can also be estimated when the back cavity is not sealed, for example when further information about the back cavity is available. For example, in a ported or vented enclosure, information about the geometry of the port and volume of the back cavity is often sufficient to determine the acoustic response, which can be stored in a memory. If it is assumed that the medium is air and $S_d$ (area of the loudspeaker diaphragm) is known, for example stored in a memory at a device, an absolute sensitivity of the loudspeaker can be determined (i.e., an absolute loudness produced at a distance r). Such analysis can occur at frequencies where an acoustic system cannot alter volume velocity (e.g. a front resonator can alter volume velocity), in particular frequencies below a given frequency; for many smart phones available today, the given frequency can be about 4 kHz, such that such analysis occurs below about 4 kHz.

One potential application of determining absolute acoustic level is the emanation of a sound at a particular absolute acoustic level for use, for example, in calibration procedures.

11.8.3 Loudspeaker Dependent EQ

Figure 76:
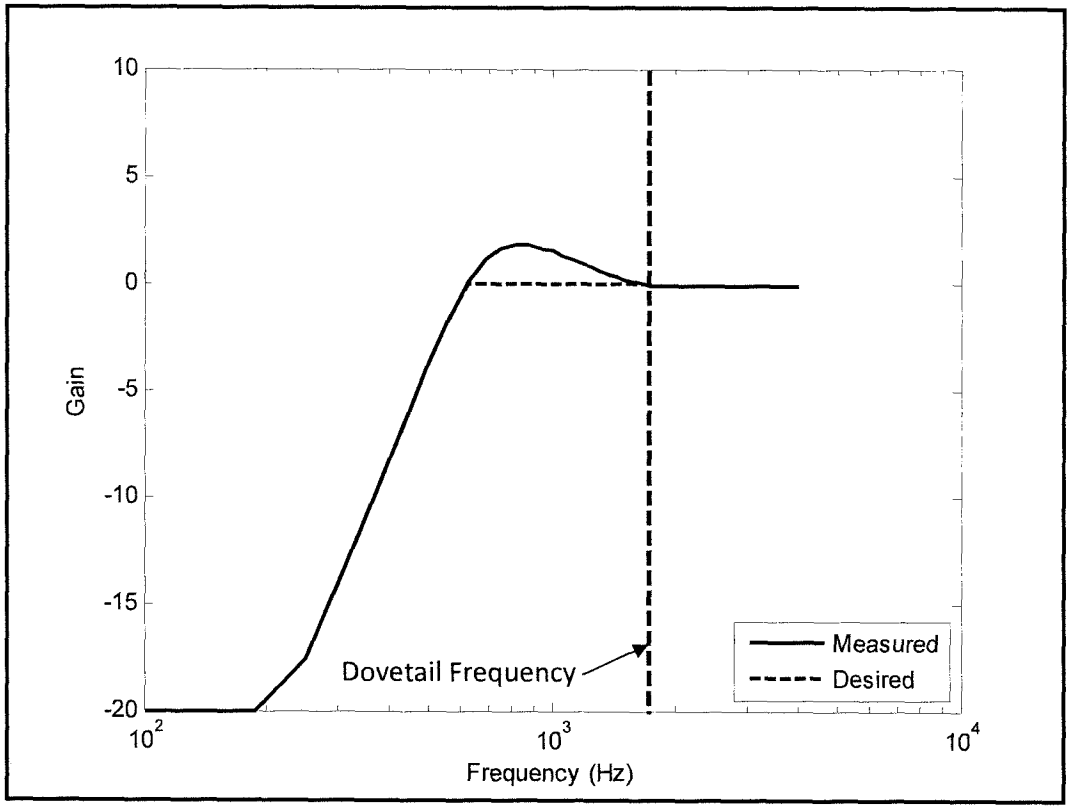
FIG. 76 depicts a desired equalized loudspeaker frequency response around a resonant frequency, according to non-limiting implementations.

When $S_d$ and/or ρ are not known, the relative acoustic frequency response can be derived from the excursion-from-voltage transfer function using Equation (64) (i.e. assuming $S_d$ and/or ρ are constants). The acoustic frequency response of a loudspeaker can rise at about 12 dB/oct at low frequencies, have a bump at the resonance frequency and then asymptotically approach the high frequency sensitivity. Using techniques disclosed herein, equalization can be applied to remove the "bump" associated with the resonance of the loudspeaker as is shown in FIG. 76. The result is a flatter frequency response and reduced excursion at resonance. The dovetail frequency ($f_1$) is indicated by the vertical dotted line in FIG. 76. The equalized frequency response in FIG. 76 is derived by making the dovetail frequency the maximum level in the curve, described hereafter, and discussed in further detail below with respect to method 300, described with reference to FIG. 92.

11.8.4 Loudspeaker and level dependent EQ

Figure 77:
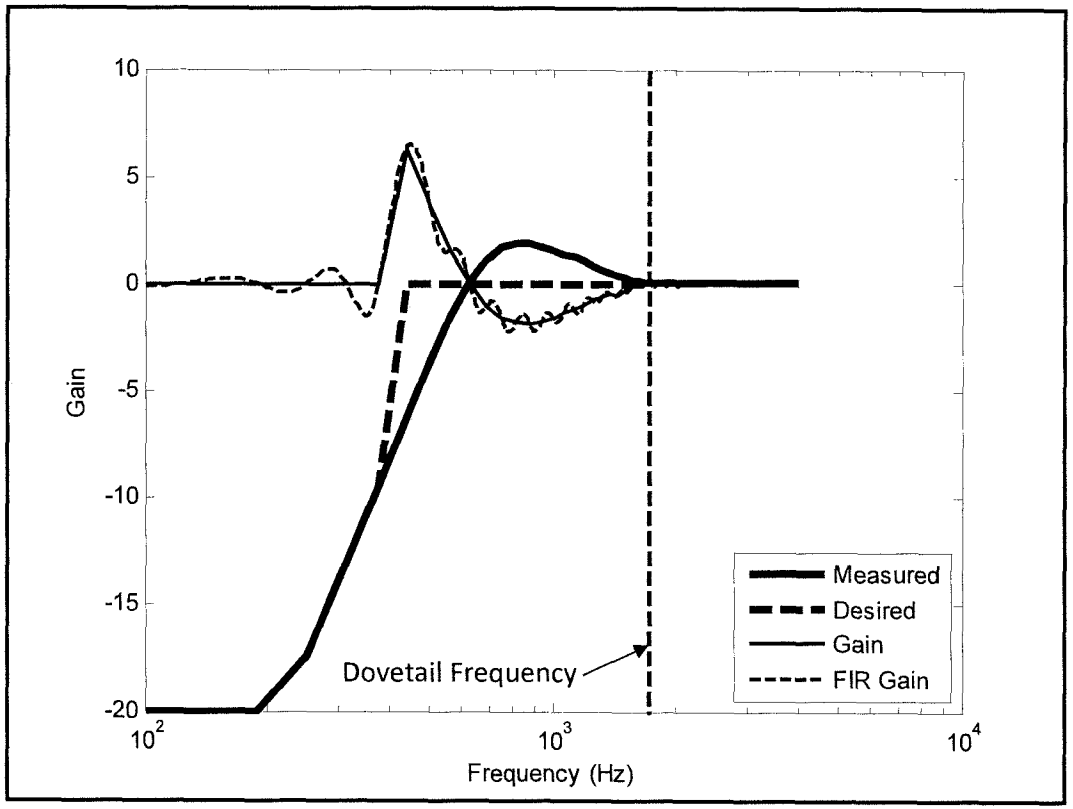
FIG. 77 depicts a desired equalized loudspeaker frequency response around and below a resonant frequency as well as an FIR implementation, according to non-limiting implementations.

Since the acoustic frequency response can be calculated at "low" frequencies (e.g. frequencies below the dovetail frequency indicated by the vertical dotted line in FIG. 77), a boost at low frequencies can be provided to extend the frequency response as depicted in FIG. 77. This can occur when the loudspeaker is playing at levels where no EQ results in a diaphragm excursion below the maximum allowed. At these levels, the EQ can boost the low frequencies where the natural response of the loudspeaker drops off. These signals can be boosted to a threshold where the diaphragm excursion increases but still stays below the maximum allowed as follows. First, a calculation of how far the excursion level is below the limit can occur, which becomes the gain to be used; second, application of a safety factor to the gain can optionally occur; and third, the determined gain can be used to flatten the frequency response. Finally, all points on a normalized frequency response curve which are below unity by that available gain or less can be boosted to unity.

Programmable limits can be placed on the maximum gain applied and the minimum frequency equalized. When the conditions change, the equalization can be changed gradually to its new value by a programmable time constant.

Figure 78:
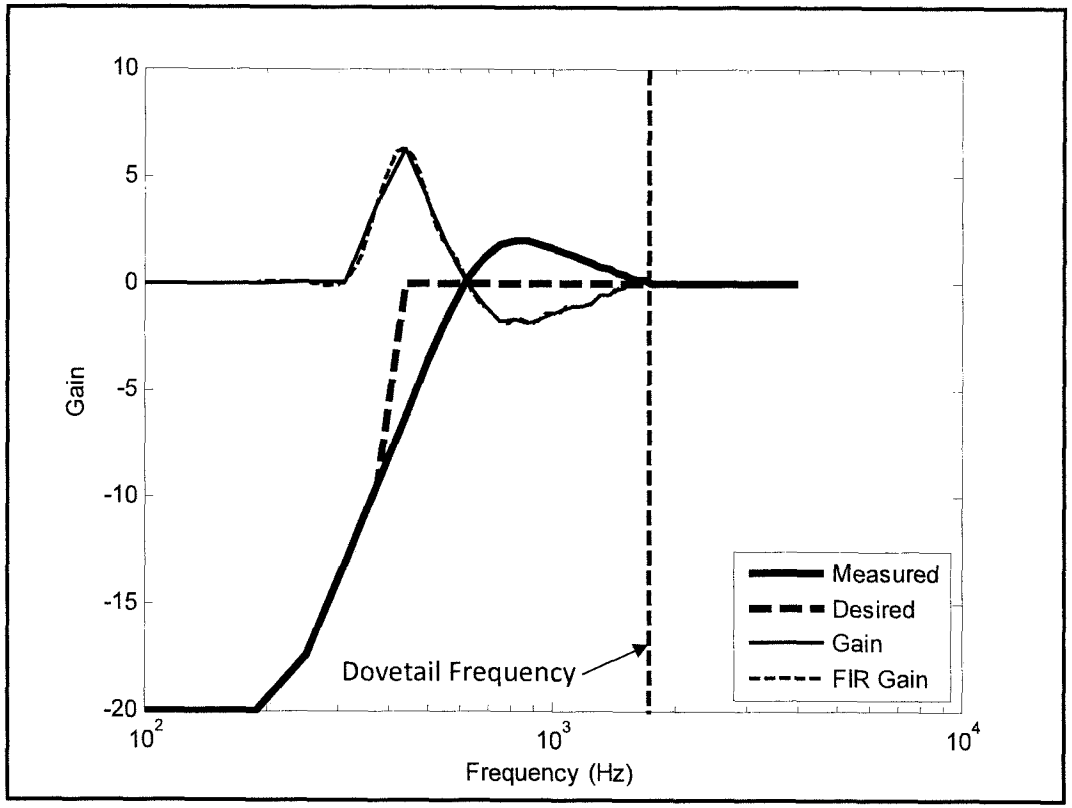
FIG. 78 depicts an improved FIR implementation, according to non-limiting implementations.

Also depicted in FIG. 77 is the equalization used to provide a "desired" curve and the corresponding FIR filter response. The ripples in the FIR EQ implementation are due to the very fast change in the EQ at low frequencies when the gain is no longer applied, around 440 Hz in FIG. 77. This effect was lessened by mirroring the gain below this 440 Hz point as depicted in FIG. 78.

11.8.5 Compression

In general, the compression criteria will be the output ($X_{env}$) of an excursion envelope detector with an "attack" time constant. The threshold ($X_{thresh}$) can be set somewhat higher than can usually be used (in a non-limiting example, about 6 dB below maximum (rather than 15 dB below maximum as in the voltage compression) as the spikes which pass through this with will be caught and/or filtered with subsequent limiting.

12 Stereo Considerations

Present implementations can be further adapted for individual loudspeakers in a device and, in general, output signals that result from present implementations can be different for a left loudspeaker and a right loudspeaker in a stereo implementation. For example, a processor, DSP, loudspeaker circuit and the like can be processing a respective input signal for loudspeaker of the device and/or present algorithms and/or methods can occur as different instantiations being processed at a processor, DSP and/or loudspeaker circuit, one instantiation for each loudspeaker.

12.1 Stereo Linking

A compressor in "stereo linking" mode can apply the same amount of gain reduction to both the left and right channels. This can be done to prevent image shifting that can occur when both channels are compressed individually. It can become noticeable when a loud element that is panned to either edge of the stereo field raises the level of the program to the compressor's threshold, causing its image to shift toward the center of the stereo field.

This technique can be applied to present implementations. For example, all the compressor/limiter gains can be linked (whether for excursion or for voltage) to apply the maximum gain reduction used for any channel to all channels.

12.1.1 Stereo Linking from Mono Source

To save hardware and/or MIPs, stereo linking can be implemented by calculating the gain reduction from a mono signal averaged from left and right channels. The gain reduction can then be applied to both channels. Although the left and right excursions can be averaged, and that mono signal used to calculate the gain reduction in both channels, in some instances that average may not represent the maximum excursion. For example, stereo signals can occur where the average excursion is less than the excursion of the individual loudspeakers. Hence, in present implementations, rather than the average excursion, a maximum excursion magnitude can be used for calculating the gain reduction.

Indeed, in some present implementations, even when the gain reduction from a mono source is calculated, implementation of the voltage-from-excursion ((V←X) in FIG. 64) and excursion-from-voltage transfer functions ((X←V) in FIG. 64) can be applied to both loudspeakers, though MIPs savings can be marginal.

12.2 Left and Right Loudspeaker Sensitivity Difference

In stereo loudspeaker systems, left/right balance can be skewed by the absolute sensitivity of the loudspeakers. In "conventional" compression this is ignored because it is the voltage signal which is being controlled. However, in present implementations, diaphragm excursion is controlled rather than the applied voltage, hence one loudspeaker can require gain reduction before the other even when the same voltage signal is applied to both.

Hence, in present implementations, an estimate the absolute excursion sensitivity of the loudspeaker (to the extent that Bl is constant) can be determined. Furthermore, the stereo balance can be adjusted to make the excursion (and effectively the acoustic) sensitivities the same and/or similar. In this adjusted balance, a mono signal sent to the stereo loudspeaker pair can require compression at the same level for both loudspeakers. Further, in present implementations, the acoustic stereo balance can be automatically set to a respective optimum acoustic value, adjusting for the left/right loudspeaker sensitivity differences.

13 Cross-Domain Compression

Heretofore compression has been applied in the excursion domain, and then a transform back to the voltage domain occurs. However, it can be advantageous to apply the compression in the voltage domain. Such compression in the voltage domain can lead to:

1. Elimination of determining the voltage-from-excursion transfer function
2. Elimination of applying the bounding function and its associated complications in the excursion by-pass arm filter.
3. Elimination of artifacts when the signal drops below the level where any compression is warranted
4. Lower distortion due to retention of the waveforms in hold-type limiting.

In short, compression in the voltage domain can be significantly simpler and be less MIPs intensive than compression in the excursion domain.

Hence, in some implementations, a determination of the attenuation used in the excursion domain can occur, but that attenuation can then be applied in the voltage domain. Note that the signal takes some time to pass through the FIR filter which converts it to the excursion signal (typically a fraction of a millisecond). This delay time is determined as the maximum in a cross-correlation between the voltage and excursion signals. If such an implementation is applied as a limiter, it would use a fast compressor (the fastest possible, i.e., sample by sample) with a hold-time. The hold-time is generally selected to be longer than the excursion-from-voltage impulse response, so that any peaks in the excursion domain are quashed and/or reduced in the voltage domain. Furthermore, a short lead time of a few milliseconds or so can also be advantageous because, for example, the cross-correlation method may not provide the exact delay through the excursion-from-voltage filter. This added lead time can furthermore obviate accurately determining the delay that the excursion signal undergoes through the transform (with any error getting absorbed into the lead time).

Figure 79:
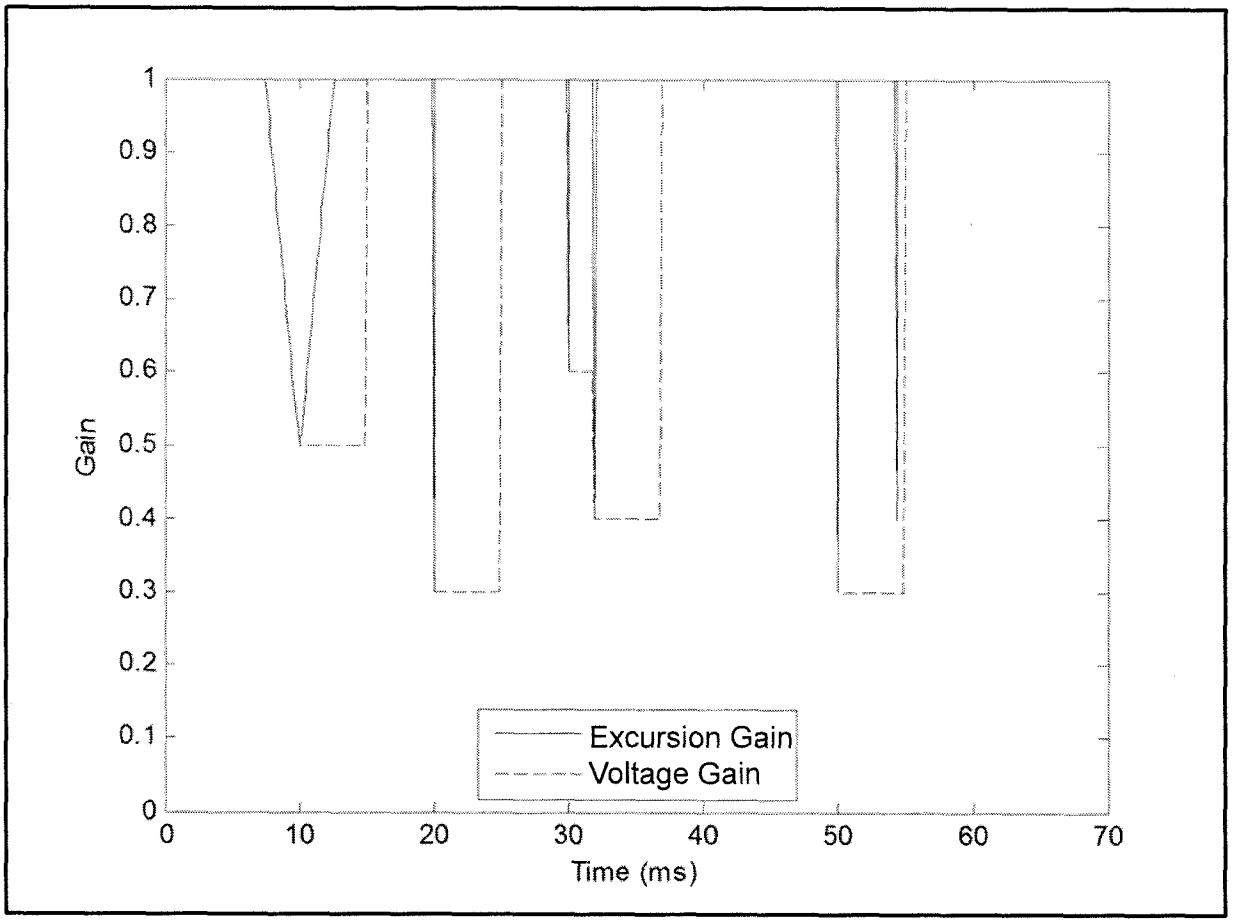
FIG. 79 depicts an implementation of compressor hold time, according to non-limiting implementations.
Figure 80:
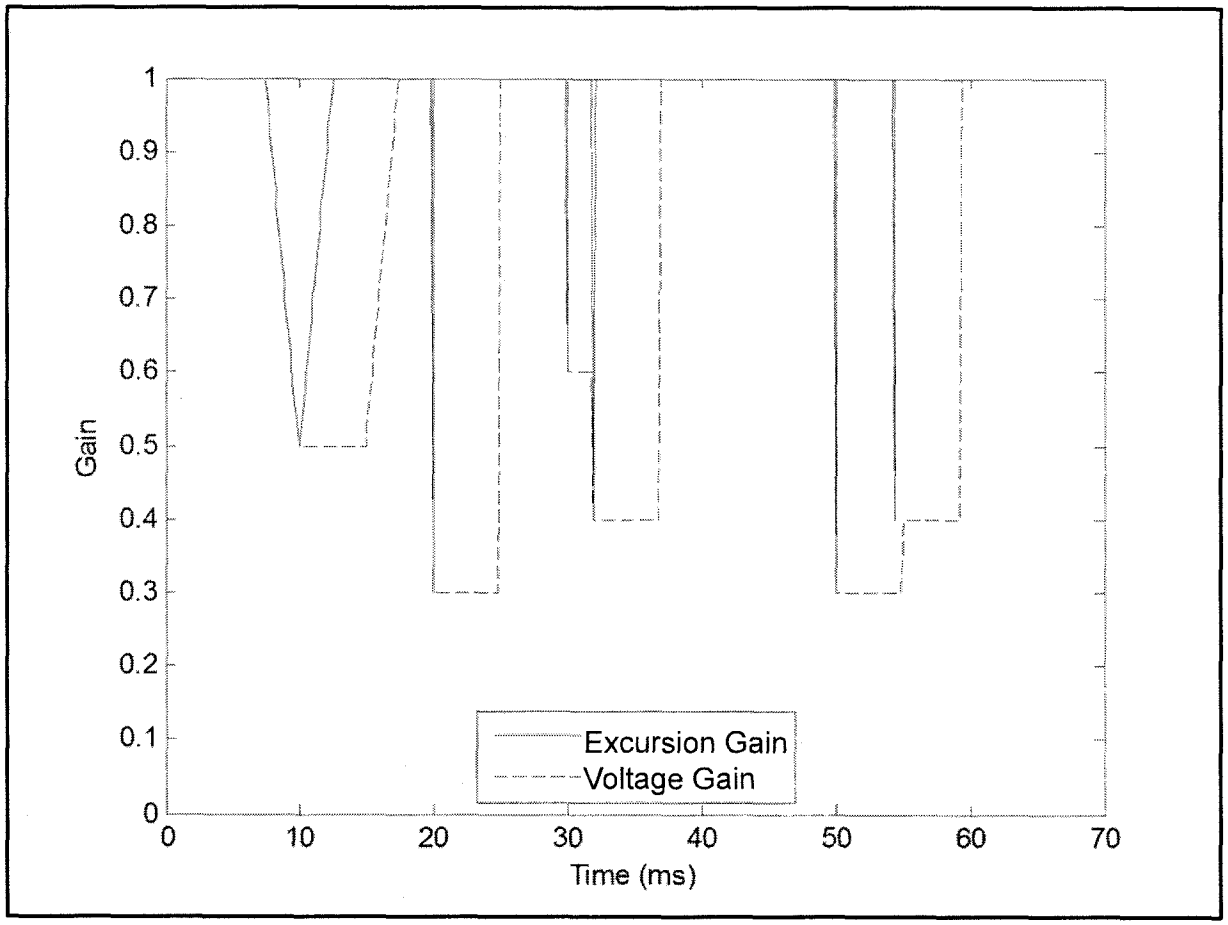
FIG. 80 depicts an implementation of Look-Back-Time, according to non-limiting implementations.

Indeed, current definitions of hold-time are modified in these implementations in order to keep the excursion below a specified maximum. For example, presently implemented hold-times could be referred to as "look-back-times" as they uses the same concept used for "look-ahead-time", except "look-back-times" look in the past. The gain applied is the minimum gain used in the excursion domain within the "look-back-time". FIG. 79 and FIG. 80 depict the difference between hold-time and look-back-time.

Specifically, FIG. 79 depicts the gain applied using a traditional "hold-time" of 5 ms. Once the gain has dropped, the gain stays down for the hold time then returns to the current value. This produces a desired result for the triangular peak at 10 ms and the sharp peak at 20 ms. The peak at 30 ms is followed by another peak lower than the first within the hold time, so the hold time is taken from the new peak also producing the desired result. At 50 ms, a short duration peak in the excursion gain comes just before the hold is complete. In this case, the second peak is higher than the first and the hold time will not be taken from this peak. This represents a failure case because the second peak can produce an over-excursion.

FIG. 80 depicts the gain applied using a 5 ms Look Back Time implementation. In the Look Back Implementation the gain is calculated as the minimum value of the excursion gain achieved within the "look-back-time". This technique is similar to a "hold-time", but handles the failure case at 50 ms and indeed results in proper limiting of the excursion.

Figure 81:
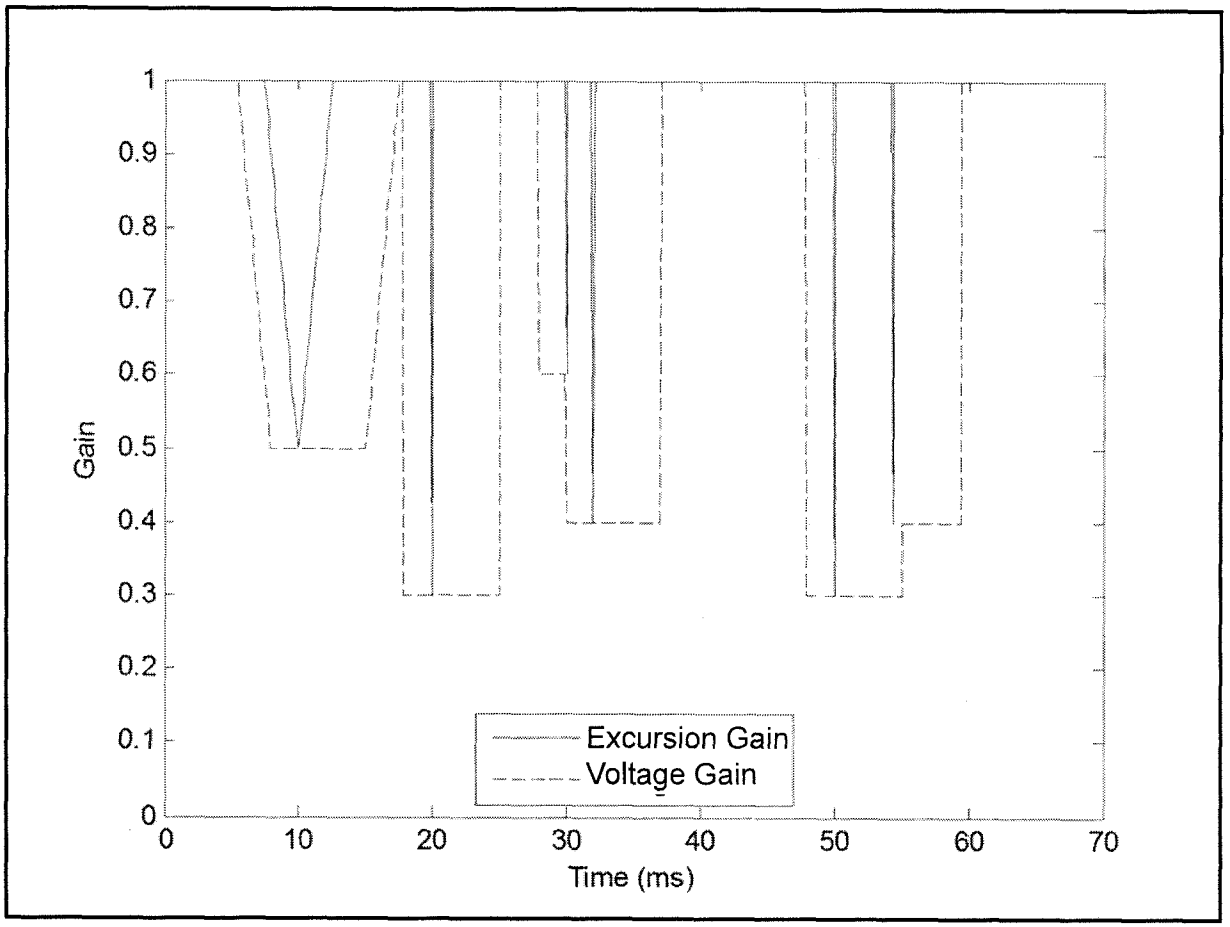
FIG. 81 depicts an Implementation of Look-Ahead and Look-Back, according to non-limiting implementations.

FIG. 81 depicts the result when a 2 ms Look Ahead and a 5 ms Look Back are used.

Hence, this technique yields good results as the perceived distortion is less than applying the attenuation to the excursion and then applying a voltage-from-excursion transfer function. Perceived speech levels could be increased up to about 15 dB while keeping the maximum excursion constant and the distortion below annoying levels.

The parameters shown in Table 3 show values of compressor parameters that can be used in non-limiting implementations of a successful prototype, as well as those discussed above for a cross-domain compressor sensing the excursion and acting as a limiter in the voltage domain.

TABLE 3

Typical Cross Domain Compressor Parameters

| Parameter | Value |
|---|---|
| Attack time constant | 0 s |
| Decay time constant | 0 s |
| Look-back time | 5 ms |
| Look-ahead time | 1.5 ms |
| Limiter type | Soft (e.g. tanh) |

FIGS. 82, 83, 84 and 85 show the effectiveness of the cross-domain limiting technique in terms of keeping the excursion below the allowed limit for a particular program material sample. The program material is identical in each figure and the horizontal lines represent the maximum allowed excursion.

Figure 82:
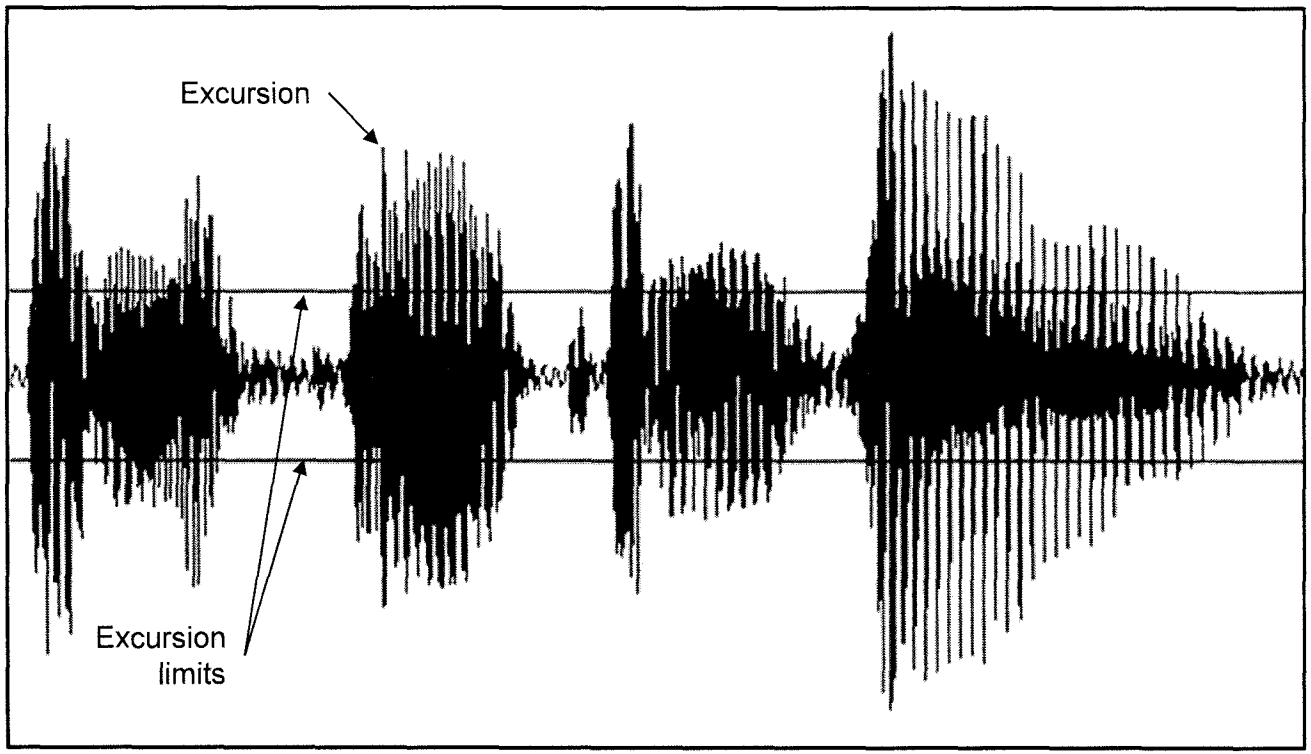
FIG. 82 depicts an excursion due to a voltage signal, according to non-limiting implementations.

FIG. 82 shows the excursion that results when no limiting is applied.

Figure 83:
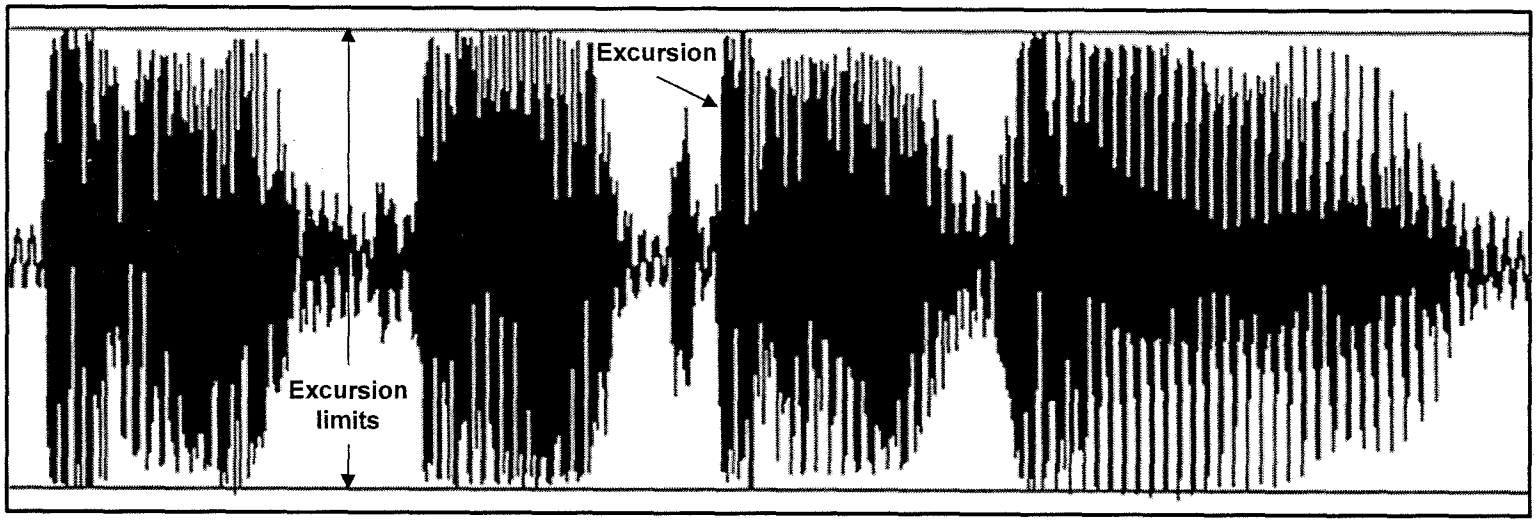
FIG. 83 depicts an excursion due to the voltage signal of FIG. 82 limited with Look-Back and applied in the excursion domain, according to non-limiting implementations.

FIG. 83 shows the excursion that results when look-back is used and the compression is applied in the excursion domain. The result was then transformed to the voltage domain and applied to the loudspeaker.

Figure 84:
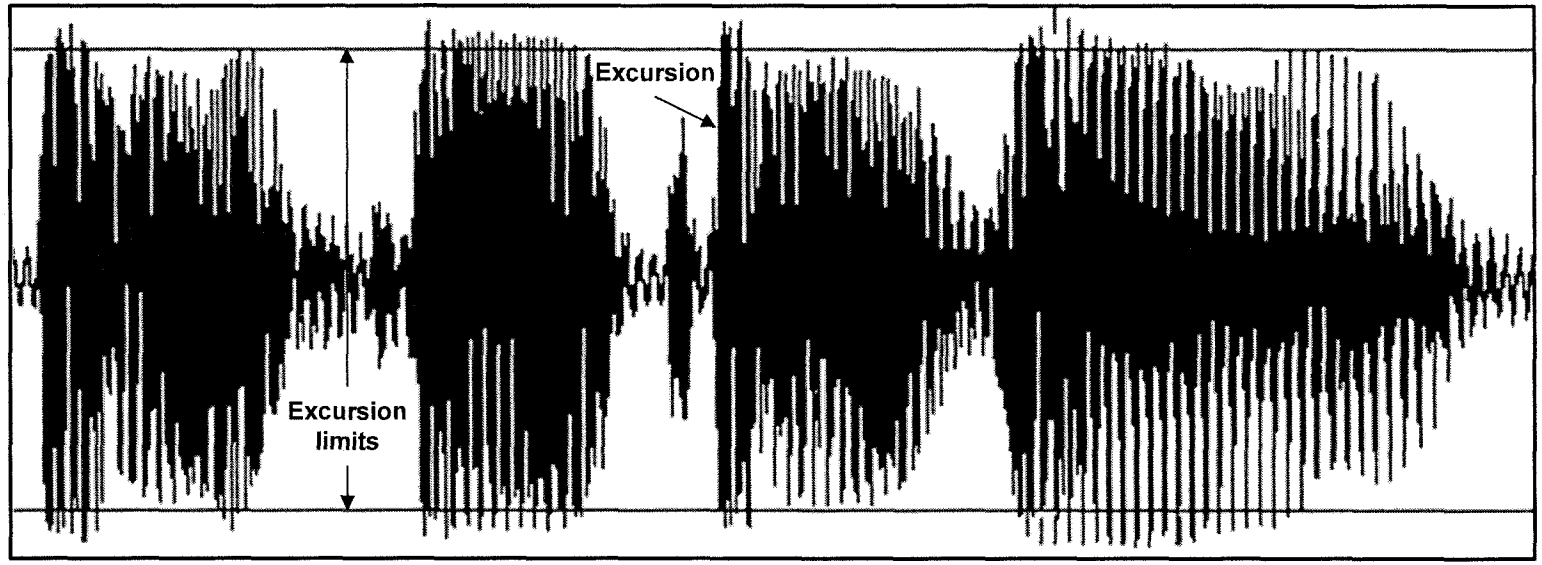
FIG. 84 depicts an excursion due to the voltage signal of FIG. 82 limited with Look-Back and applied in the voltage domain, according to non-limiting implementations.

FIG. 84 shows the excursion that results when look-back is used and the compression is applied directly to the voltage domain.

Figure 85:
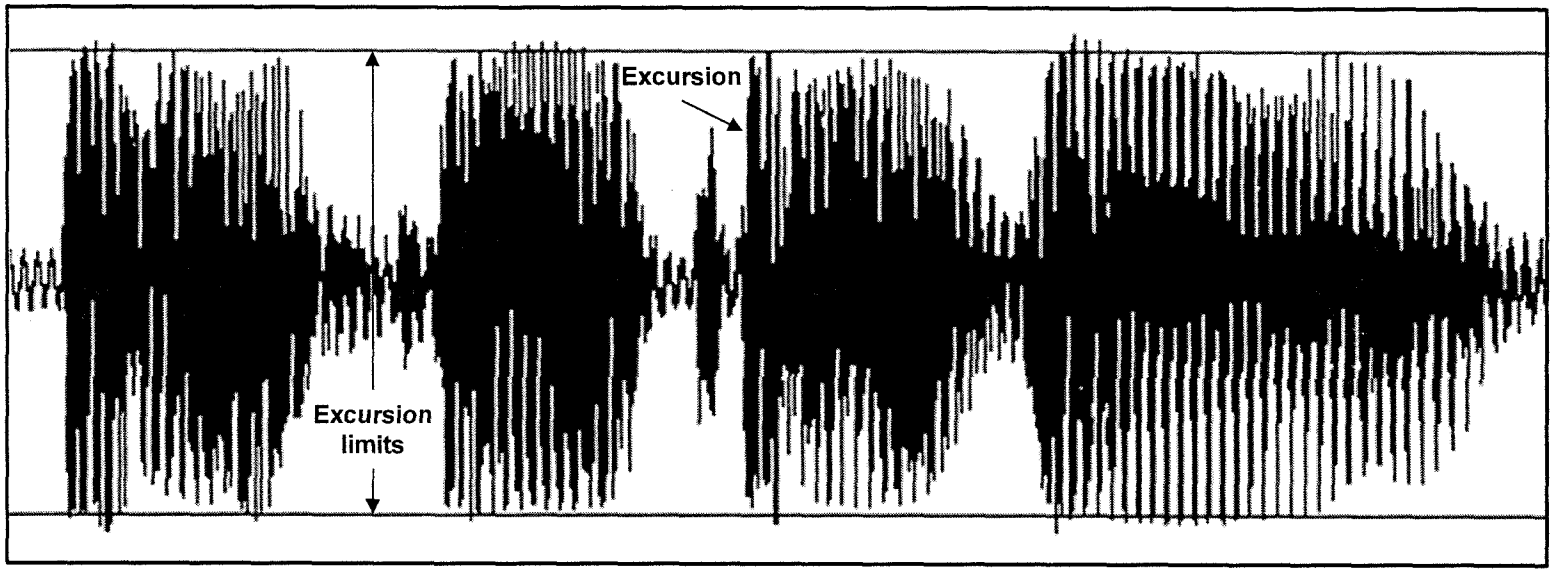
FIG. 85 depicts an excursion due to the voltage signal of FIG. 82 limited with Look-Back and Look-Ahead and applied in the voltage domain, according to non-limiting implementations.

FIG. 85 shows the excursion that results when both look-back and look-ahead are used and the compression is applied directly to the voltage domain.

Figure 86:
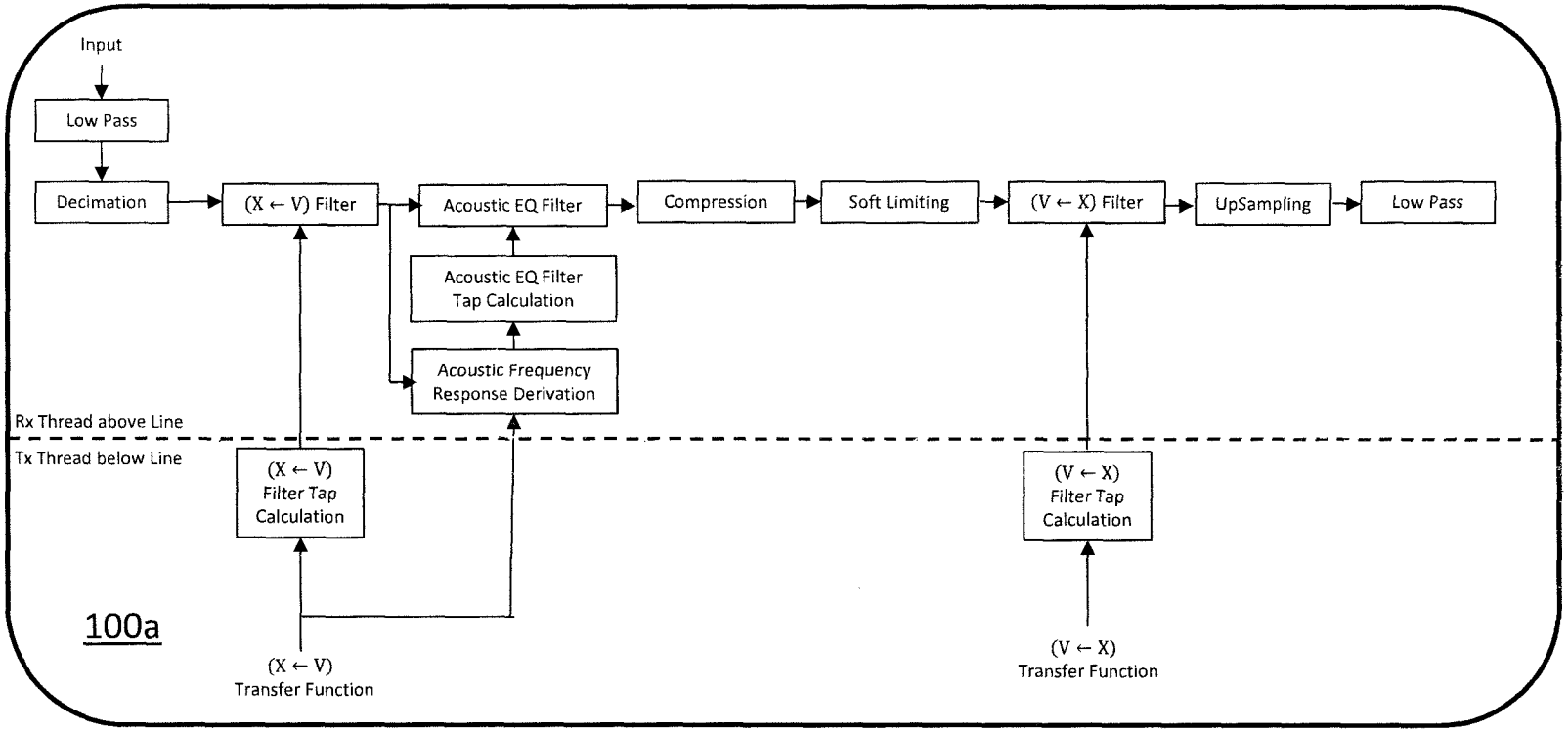
FIG. 86 depicts details of the section of FIG. 64, denoted as "100*a*", according to non-limiting implementations.

Attention is further directed to FIG. 86 which depicts more details inside the demarked area 100*a* of loudspeaker control system 100 in FIG. 64. In particular, the Excursion EQ compression and limiting portion comprises: an Acoustic EQ Filter, that includes a derivation of an acoustic frequency response from the excursion-from-voltage (X←V) transfer function and output from the excursion-from-voltage filter (X←V) filter, as well as calculation of acoustic EQ filter taps, which are used as input to the acoustic EQ filter. Respective compression portions and soft limiting portions provide compression and soft limiting to the output from the acoustic EQ filters. Furthermore, upsampling can be followed by a further low pass filtering.

Figure 87:
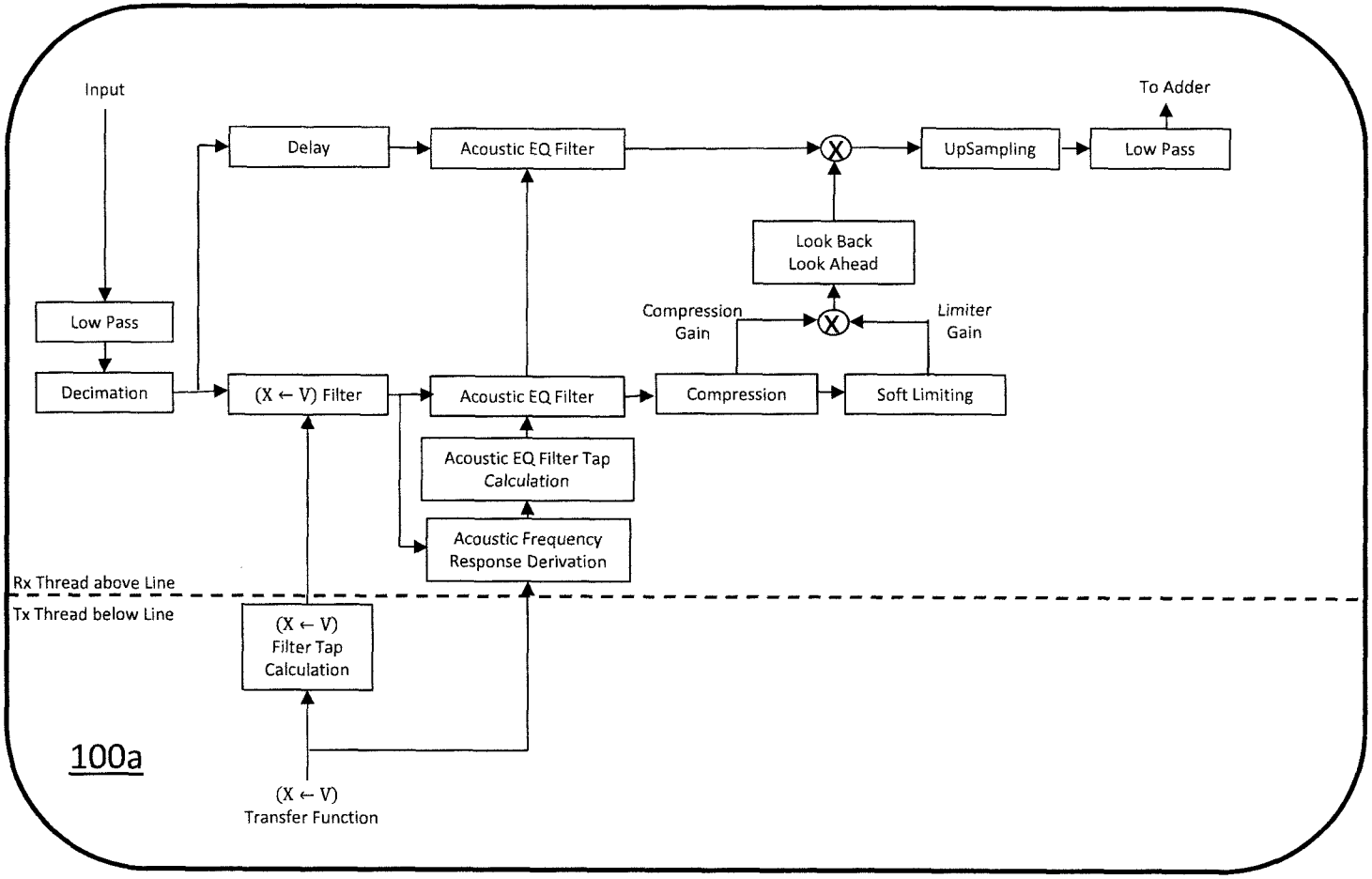
FIG. 87 depicts alternate details of the section of FIG. 64, denoted as "100*a*", according to non-limiting implementations.

FIG. 87 shows an alternative implementation of the demarked area 100*a* of FIG. 64. In particular details of this section of the loudspeaker control system 100 inside the demarked area 100*a* of FIG. 64 can be adapted for cross-domain compression technique described in this section. In other words, FIG. 87 is substantially similar to FIG. 86, with like elements having like names. However, in FIG. 87 the voltage-from-excursion (V←X) filter is absent and determination of associated tap filters and voltage-from-excursion (V←X) function does not occur.

Rather, the input signal to the excursion-from-voltage filter (X←V) filter is also input into a parallel arm in which a delay occurs (to allow for application of excursion-from-voltage filter (X←V) filter and acoustic EQ filtering) and acoustic EQ filtering is applied similar to the acoustic EQ filtering described above (i.e. similar acoustic EQ filtering is applied both to the delayed input signal and to the excursion-from-voltage filtered signal).

A first multiplier is then used to combine output from the compression component and the soft limiting component. This product is then modified by the "look back" and "look ahead" times as described above. A second multiplier is then used to combine output from the look back/look ahead component with the delayed input signal (both signals should now be temporally aligned).

In other words, scaling factors are determined from limiting and compressing the excursion. These scaling factors are multiplied in the first multiplier and adjusted using the look ahead and look back techniques. The adjusted scaling factor is then applied in the second multiplier to the corresponding portion of the input signal to produce a portion of an output signal driving the voice coil, over the time period over which the scaling factor was valid. For example, the scaling factor can comprises a factor for bringing peaks within the time period which exceed a maximum excursion to less than or about equal to the maximum excursion, and this scaling factor is applied to the portion of the input signal within the time period.

14 Fixed Point C Issues in Specific Implementations

In implementations of the loudspeaker protection algorithms (i.e. the loudspeaker excursion domain limiting), as disclosed herein, on a digital signal processor (DSP), finite precision arithmetic is generally used. More specifically, cost constraints can generally dictate implementations at devices and/or mobile devices that comprise a DSP that supports only fixed-point arithmetic (e.g. as opposed to floating-point arithmetic available at a processor of personal computer). This places constraints on the allowable dynamic range of signals (voltage and current) and the coefficients and outputs of mathematical operations used by the presently disclosed algorithms, such FIR and IIR filtering, level estimation, and compression, as well as other methods and/or algorithms disclosed herein. In these implementations, signal processing methods can be used that maximize numerical precision of signals and operations on fixed-point DSPs, by selecting an appropriate word width (including, but not limited to, 16 bits, 32 bits, and the like) and assuming a radix point at each point in the algorithm's processing chain.

However, such signal processing methods can be difficult to apply given the potentially large dynamic range of signals and filtering operations used by algorithms disclosed herein. For example, voltage signal samples can be acquired in the range of about −8 volts to about 8 V which can be represented accurately with 16 bits of precision (i.e., a 16-bit word width). The excursion-from-voltage transfer function, and voltage-from-excursion transfer functions, respectively denoted as $H_{XV}(\omega)$ and $H_{VX}(\omega)$, generally use larger dynamic range in their respective FIR coefficients to convert voltage time-domain samples to excursion time-domain samples in the range of, for example, about −1 mm to about 1 mm, and a correspondingly large dynamic range in respective FIR coefficients to convert excursion time-domain samples back to voltage samples. While it is possible to represent the respective transfer function FIR coefficients using a correspondingly larger word width, say 32 bits, maintaining full fixed-point precision from the input to the $H_{XV}(\omega)$ transfer function to the output of the $H_{VX}(\omega)$ transfer function can use increasingly larger word widths (48-64 bits) at each point in the intermediate gain/loss calculations used to limit the excursion. In practice DSPs generally offer a maximum supported word width and a finite set of input/output word width combinations in their fixed-point multiplication operations; hence, present implementations can use word width of signals and coefficients of given lengths.

For example disclosed hereafter is method that can be used to decouple a signal path through the transfer functions from gain/loss calculations which are calculated and applied to the excursion signal. Simultaneously, the word widths of the respective transfer function coefficients and intermediate signals can be reduced to sizes that are either more manageable by a fixed point C DSP, and/or to a supported word width size of a fixed point C DSP.

The method comprises:

1. Normalizing respective transfer function coefficients of each of $H_{XV}(\omega)$ and $H_{VX}(\omega)$, each with respect to a 0 dB (or unity) magnitude response and a positive or negative power-of two bit shift. This results in two normalized transfer functions as follows:

$$H_{\overline{XV}}(\omega)=2^{n}H_{XV}(\omega) \text{ where } \max\{|H_{\overline{XV}}(\omega)|\}=1$$

$$H_{\overline{VX}}(\omega)=2^{m}H_{VX}(\omega) \text{ where } \max\{|H_{\overline{VX}}(\omega)|\}=1 \quad (65)$$

(Note: normalizing the transfer functions reduces the dynamic range of the resulting respective FIR coefficients, and can reduce the coefficient word width, e.g., from 32 to 16 bits).

2. Calculating the normalized excursion signal $\overline{x}(n)$ using the normalized excursion-from-voltage transfer function $H_{\overline{XV}}(\omega)$.

3. Calculating the physical excursion signal x(n) by de-normalizing the normalized excursion signal using the corresponding de-normalized scale factor:

$$x(n)=2^{n}\overline{x}(n) \quad (66)$$

4. Calculating a required gain function and/or a required loss function on the physical excursion signal x(n) using the compression and limiting operations described elsewhere in the present specification. This gain or loss operation is presently denoted as $G\{\cdot\}$.

5. Applying the required gain function and/or required loss function on the normalized excursion signal to produce a normalized excursion-limited signal $\tilde{x}(n)$:

$$\tilde{x}(n)=G\{\overline{x}(n)\} \quad (67)$$

6. Calculating a normalized recovered voltage signal $\tilde{v}(n)$ using the normalized voltage-from-excursion transfer function $H_{\overline{VX}}(\omega)$.

7. Calculating a physical recovered voltage signal by de-normalizing the normalized recovered voltage signal using the corresponding sum of de-normalizing scale factors.

Figure 88:
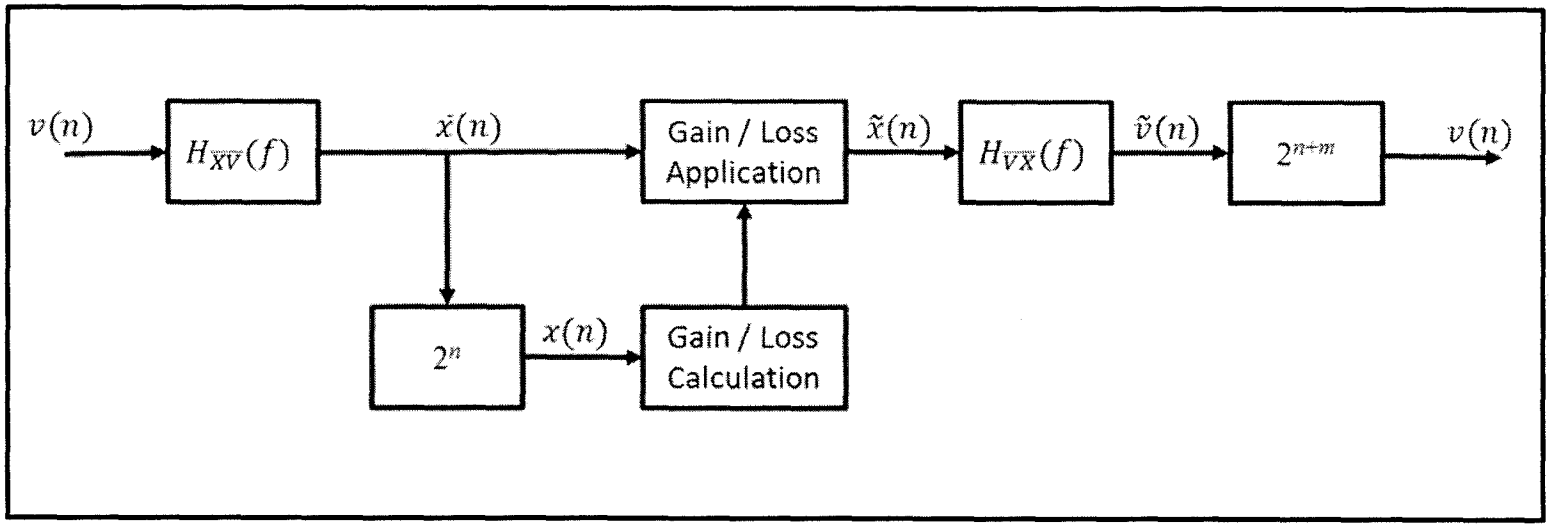
FIG. 88 depicts a flowchart for a method to accommodate issues arising from fixed point C implementations, according to non-limiting implementations.

This method is depicted graphically in FIG. 88, where the input and output voltage time-domain signals are denoted v(n), respectively.

Note that while the steps of the method are described as occurring in a given order, at least a portion of the steps can occur in parallel with each other, and indeed, the steps need not specifically occur in the order described.

15 Time Domain Excursion Determination

As described above, Equation (13) gives a frequency domain expression for the excursion-from-voltage transfer function. The formulation could also be used to give the excursion directly in the time domain. For example Equation (11) can be written in the time domain as $$V_b = V_a - I_a R_{vc} - L_{vc}\frac{dI_a}{dt} \tag{68}$$

So that, Equation (13) becomes:

$$x(t) = \frac{1}{Bl}\int^{t}\left[V(t) - I(t)R_{vc} - L_{vc}\frac{dI(t)}{dt}\right] \tag{69}$$

Where:

x(t) is the excursion as a function of time.

V(t) is the instantaneous Voltage applied to the signal.

I(t) is the instantaneous electrical current through the loudspeaker.

Using Equation (69), the instantaneous excursion can be determined from the time digitized version of the loudspeaker voltage and current signals directly. Because an integral is involved, a slow time constant is used, tending the result toward zero over "long" times (of the order of seconds) to accommodate errors that can accumulate in the integral due to numerical precision and noise.

An equivalent form of Equation (13) can be derived in the time domain. The corresponding excursion-from-voltage impulse response ($h_{IV}$) can also be used to determine the excursion from an applied voltage. $h_{IV}$ can be derived from the measured loudspeaker voltage and current for example, through LMS techniques. Equation (11) can be written in the time domain as follows:

$$V_b = V_a - I_a R_{vc} - L_{vc}\frac{dI_a}{dt} \tag{70}$$

As before, $V_b$=Bl$\dot{x}$ can be substituted, where $\dot{x}$ is the time derivative of the excursion. This gives the excursion as a function of $h_{IV}$ and the loudspeaker electrical parameters (Bl, $R_{vc}$ and $L_{vc}$) and any input voltage signal V(t):

$$x(t) = \frac{1}{Bl}\left\{\int^{t} V(t)\,dt - R_{vc}\int^{t} V(t) * h_{IV}\,dt - L_{vc}V(t) * h_{IV}\right\} \tag{71}$$

Alternatively, a numerical calculation can give the excursion (x(t)) for a given voltage signal V(t) from Equation 70 as follows. The current I(t) as a function of time can first be derived:

$$I(t)=V(t)*h_{IV} \tag{72}$$

$$\frac{dI(t)}{dt}$$

can be obtained by numerically differentiating the current with respect to time. The velocity ($\dot{x}$(t)) can then be derived by substituting $V_b$=Bl$\dot{x}$ into Equation 70:

$$\dot{x}(t) = V - I(t)R_{vc} - L_{vc}\frac{dI(t)}{dt} \tag{73}$$

The excursion can then be obtained by numerically integrating Equation 73 with respect to time.

16 Further Considerations 16.1 Restrictions

In some implementations of systems, methods and apparatus described herein, the following restrictions can optionally be applied:

A maximum delay can be set to less than one or more of 10 ms, 22 ms, and 100 ms, however other maximum delays are within the scope of present implementations. The maximum delay can be different or the same for each of Multimedia audio data and Voice audio data.

Furthermore, the system can be configured to process signal bandwidths of 3.4, 8, 16 and 24 kHz, however other bandwidths are within the scope of present implementations.

Furthermore, parameters described herein can vary depending on signal bandwidths.

Excursion can be performed at about 10 kS/s whereas temperature predictions can be performed at about 48 kS/s 16.2 Nonlinear Effects Assuming the loudspeaker excursion and voice coil temperature remain within the manufacturer's specifications, the main nonlinear effects in loudspeakers being controlled using present implementations can be due to:

1. Deformation of the diaphragm at large excursions (i.e. close to and/or exceeding a preferred maximum and/or threshold excursion).

2. Increasing instantaneous spring constant as a function of excursion.

3. Decreasing instantaneous Bl product as a function of excursion.

The first effect (deformation of the diaphragm at large excursions) generally results in some acoustic compression however, no damage results as long as the excursion remains within the manufacturer's specification.

The second and third effects both tend to decrease the excursion from what it would be in a linear case. Therefore, the linear case can comprise a conservative estimate of the nonlinear excursion.

The impedance under linear conditions can be obtained by measurement when the excursion is relatively small (in the quieter portions of the program material). However, the impedance can change significantly when higher power is applied to the loudspeaker.

The small signal linear components under nonlinear conditions can be obtained by measuring the impedance over the small portions of time when the voice coil is traversing its mechanical equilibrium point. This point can be recognized as it will be the point of maximum $V_b$ because the diaphragm velocity is maximal at that point and the voice coil magnetic field coupling (effective Bl product) is also maximal at this point. A side benefit is that since $V_b$ is maximal here, it is also the point of measurement least prone to error. Note that knowing the point of minimum excursion can also gives time position of xmax.

17 Implementation Compromise Decisions

In some specific non-limiting implementations, comprises can occur between including all features disclosed herein, processing time and/or cost of implementation.

17.1 Compensation for External Components above Dovetail Frequency

For example, in some implementations, compensation for external components above a dovetail frequency does not occur. Compensation for Rpresense and Rpostsense occurs so that the voltage on the loudspeaker becomes what is calculated for a proper excursion, and compensation does occur above the dovetail frequency ($f_1$). The unity response above $f_1$ can be adjusted to a gain that makes the frequency response continuous at $f_1$. Implementing the filter stand-alone can have a significant MIPs impact, however the filter can be implemented with essentially no MIPs impact by multiplying the transfer function by the excursion bypass arm filter. However this can introduce complexity into the system.

Once dovetailed, the compensation can correct the frequency response above $f_1$ of the order of a dB or so, as depicted in FIG. 63.

The benefit of not using compensation for external components above a dovetail frequency is that it decreases complexity and increases testability. However, although the excursion limiting will not be affected, the frequency response can have a minor defect.

17.2 Rotate Hxv and Hvx to be Fully Causal

In these implementations, each of the excursion-from-voltage (Hxv) and voltage-from-excursion (Hvx) impulse response filters are rotated fully ½ the number of taps. There is a compromise that can be made between delay and distortion. The overall delay can be reduced by rotating less, however this would come with increased aliasing distortion 17.3 Make the Bounding Function Static In some implementations, the bounding function and the bypass arm filter characteristic can be determined at design time instead of at run time as the excursion transfer function may not change much over the life of a device. In some implementations, the excursion-from-voltage transfer function can have a second maximum right at the point where an automatic choice of the dovetail frequency may jump back and forth to either side. Changes in the excursion transfer function could still be accommodated, unless they required significantly more or less bandwidth to describe. Such implementations where the bounding function and the bypass arm filter characteristic are not dynamic lead to decreased complexity, and decreased MIPs, and less risk of audible artifacts; however such implementations could have an impact when the dovetail frequency changes, and noise could be amplified when the transfer function drops to levels comparable with the noise within the fixed bandwidth.

17.4 Modify the Multiband Compressors to Use 3 Bands Instead of 5

In some implementations, multiband compressors can be configured to only divide an audio input signal into 2 frequency bands and one overall band for compression. Such an implementation decreases MIPs roughly by a factor of 2, and leads to both reduced complexity and faster tuning. However, this can also lead to reduced control. However, in tested prototypes, 2 channels nonetheless lead to good results, at least subjectively.

17.5 Use Bounding Function to Mop up Filter Corrections

In implementations of a present prototype, the decimation filters ($H_{lp}$) and the high pass bypass arm filter ($H_{hp}$) are implemented as: two 84 tap FIRs and a 168 tap FIR respectively. The bounding function is given by $G(f) \propto 1/f^6$ and: $H_{hp}=1-H_{lp}^2G$ Alternatively, the 3 filters could be constructed as 4-6 tap IIR (infinite impulse response) filters, and then the bounding function can be used to "mop up" the differences in the filters: $G=(H_{hp}-1)/H_{lp}^2$ Unlike the filters, a complicated $G(f)$ can be easy to implement because its transfer function can be multiplied by the inverse excursion transfer function, and hence filter tap calculations are not necessary.

The differences can be made as small as needed by using more IIR taps, and the corrections provided by G can result in almost perfectly matched arms Such implementations can lead to substantially decreases in MIPs, and faster tuning.

17.6 Remember the Previous Transfer Function for Startup

In some implementations, the previous transfer function can be used to obviate a new derivation thereof, which can obviate using processing time to derive it again, for example about 100 ms using current processor. The temperature can be measured, and the transfer function adjusted for the new temperature. The transfer function is then updated as described above. Such implementations can reduce start up time, and further reduce starting transients. Furthermore, such implementations can accommodate program materials (e.g. input signals) which begin spectrally sparse.

17.7 Further Ideas

In yet further implementations, denominator rationalization and division can be used instead of polar representation of complex numbers to invert the transfer function. In yet other implementations, the fallback arm can be processed only when needed and/or kept in a "warmed-up state", for example, loaded into a memory of a processor and/or DSP but not processed until needed.

18 Review of Features

Provided herein is a methodology to predict the full, complex excursion-from-voltage transfer function from measurements of the loudspeaker voltage and loudspeaker current and the Bl product. The calculation is generally direct and does not require any curve fitting procedures. The calculation does not require any audible test tones, prerequisite measurements or preprogrammed parameters (other than the Bl product). Furthermore, predicted excursion is relatively immune to noise and/or inaccuracies in the impedance measurement. Neither is the predicted excursion critically dependent on accurate values of the Bl product: errors in the Bl product translate dB for dB into error in the excursion. In addition, the described linear system is a conservative estimate as nonlinear effects tend to reduce excursion.

19 Further Uses and/or Implementations

In some implementations, microphone input data can be used, along with, or alternatively to, excursion data, to derive an instantaneous excursion vs current curve.

19 Implementation in a Device

Figure 89:
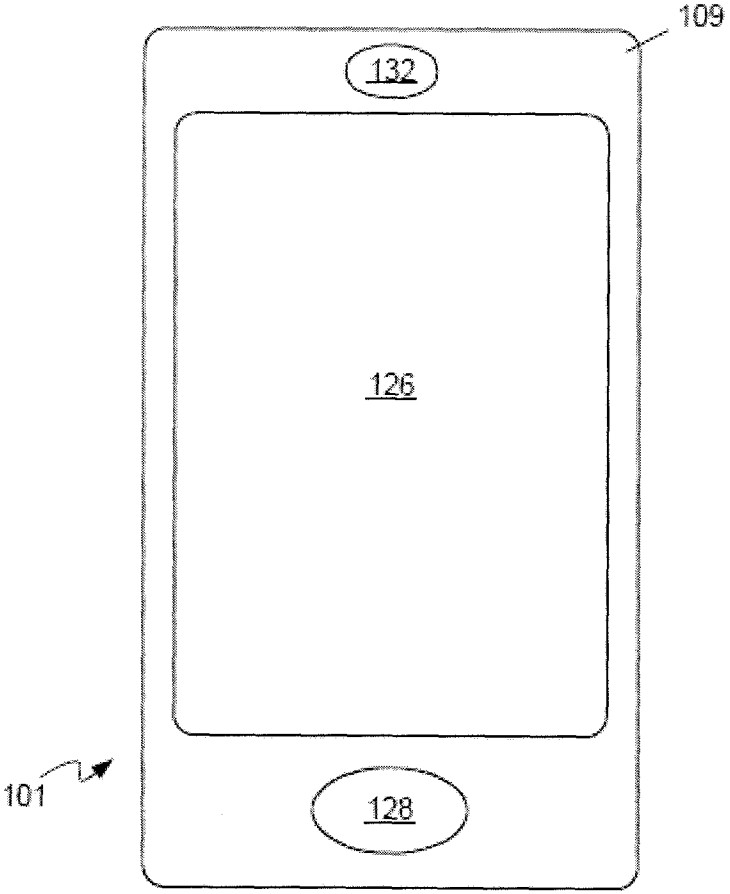
FIG. 89 depicts a device configured for loudspeaker excursion domain processing, according to non-limiting implementations.
Figure 90:
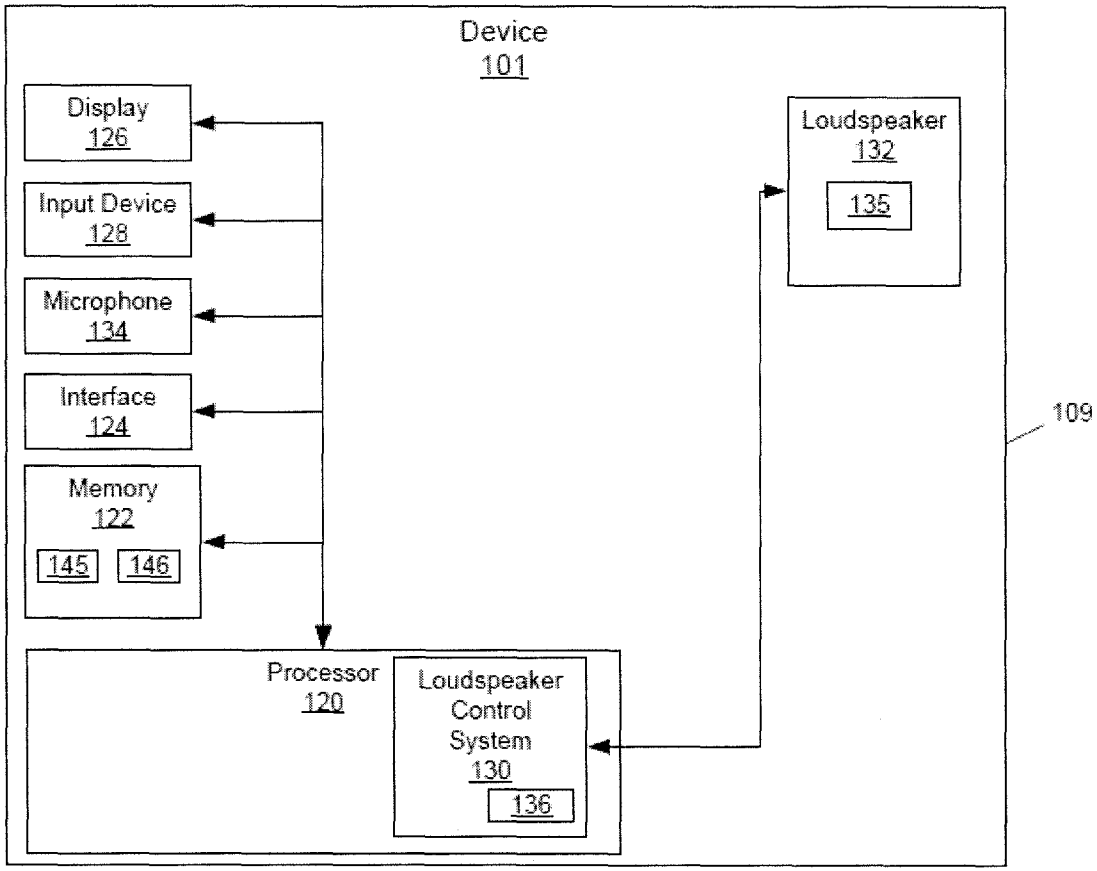
FIG. 90 depicts schematic block diagram of the device of FIG. 89, according to non-limiting implementations.

Attention is next directed to FIG. 89 and FIG. 90 which respectively depict a front perspective view and a schematic diagram of a mobile electronic device 101, referred to interchangeably hereafter as device 101. Device 101 comprises: a processor 120, a loudspeaker 132 comprising a voice coil 135, one or more devices 136 configured to determine loudspeaker voltage and loudspeaker current, and a memory 122 storing a Bl product 145 for the loudspeaker. As depicted processor 120 comprises a loudspeaker control system 130 which can comprise the one or more devices 130. However, in other implementations, loudspeaker control system 130 is implemented as one or more separate processor and/or DSPs.

Furthermore, in other implementations, the one or more devices 136 can be implemented as separate from loudspeaker control system 130 and/or processor 120. While optional, device 101 further comprises a communication interface 124 (interchangeably referred to hereafter as interface 124), a microphone 136 and an input device 128.

Processor 120 and/or loudspeaker control system 130 is generally configured to: receive a plurality of loudspeaker currents I(t) and a corresponding plurality of loudspeaker voltages V(t) from the one or more devices 136 as a function of time, t; derive a current-from-voltage transfer function $H_{IV}$ from the plurality of loudspeaker currents I(t) and the corresponding plurality of loudspeaker voltages V(t), as a function of frequency, ω; determine a Fourier space excursion-from-voltage transfer function $H_{XV}(\omega)$ using:

$$H_{XV}(\omega) = \frac{1}{Bl}\left[\frac{1 - H_{IV}R_{vc}}{j\omega} - L_{vc}H_{IV}(\omega)\right]$$

where: j denotes a square root of −1; $R_{vc}$ comprises a resistance of voice coil 135; and $L_{vc}$ comprises an inductance of the voice coil; determine filter coefficients using the Fourier space excursion-from-voltage transfer function, $H_{XV}(\omega)$; and, apply a filter to an input signal for the loudspeaker 132 using the filter coefficients.

Device 101 can be any type of electronic device that can be used in a self-contained manner to communicate with one or more communication networks. Device 101 can include, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations.

It should be emphasized that the shape and structure of device 101 in FIGS. 89 and 90. are purely examples, and contemplate a device that can be used for both wireless voice (e.g. telephony) and wireless data communications (e.g. email, web browsing, text, and the like). However, FIG. 89 contemplates a device that can be used for any suitable specialized functions, including, but not limited, to one or more of, telephony, computing, appliance, and/or entertainment related functions. In other words, in other implementations, device 101 can comprise any device that comprises one or more loudspeakers that converts sound data to sound, including, but not limited to, a television, a stereo system, an entertainment device, and the like.

With reference to FIGS. 89 and 90, device 101 comprises at least one input device 128 generally configured to receive input data, and can comprise any suitable combination of input devices, including but not limited to a keyboard, a keypad, a pointing device (as depicted in FIG. 89), a mouse, a track wheel, a trackball, a touchpad, a touch screen and the like. Other suitable input devices are within the scope of present implementations. In particular, at least one input device 128 can comprise a volume device configured to set a volume of loudspeaker 132.

Input from input device 128 is received at processor 120 and/or loudspeaker control system 130 (each of which can be implemented as a plurality of processors, and/or as one or more DSPs including but not limited to one or more central processors (CPUs)). Processor 120 and/or loudspeaker control system 130 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 and/or loudspeaker control system 130 which makes appropriate utilization of volatile storage during the execution of such programming instructions. Those skilled in the art will now recognize that memory 122 is an example of computer readable media that can store programming instructions executable on processor 120 and/or loudspeaker control system 130. Furthermore, memory 122 is also an example of a memory unit and/or memory module.

Memory 122 further stores an application 146 that, when processed by processor 120 and/or loudspeaker system 130, enables processor 120 and/or loudspeaker control system 130 to: receive a plurality of loudspeaker currents I(t) and a corresponding plurality of loudspeaker voltages V(t) from the one or more devices 136 as a function of time, t; derive a current-from-voltage transfer function $H_{IV}(\omega)$ from the plurality of loudspeaker currents I(t) and the corresponding plurality of loudspeaker voltages V(t), as a function of frequency, ω; determine a Fourier space excursion-from-voltage transfer function $H_{XV}(\omega)$ using:

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1; $R_{vc}$ comprises a resistance of voice coil 135; and $L_{vc}$ comprises an inductance of the voice coil 135; determine filter coefficients using the Fourier space excursion-from-voltage transfer function, $H_{XV}(\omega)$; and, apply a filter to an input signal for the loudspeaker 132 using the filter coefficients.

Furthermore, memory 122 storing application 146 is an example of a computer program product, comprising a non-transitory computer usable medium having a computer readable program code adapted to be executed to implement a method, for example a method stored in application 146.

While not depicted, memory 122 can further store values, manufacturer values, and the like of: the resistance $R_{vc}$ of voice coil 135; and/or the inductance $L_{vc}$ of the voice coil 135. Alternatively, memory 122 can store last determined filter coefficients and the like.

Processor 120 can be further configured to communicate with display 126, and microphone 134. Display 126 comprises any suitable one of, or combination of, flat panel displays (e.g. LCD (liquid crystal display), plasma displays, OLED (organic light emitting diode) displays, capacitive or resistive touchscreens, CRTs (cathode ray tubes) and the like. Microphone 134 comprises any suitable microphone for receiving sound and converting to audio data. In some implementations, input device 128 and display 126 are external to device 101, with processor 120 in communication with each of input device 128 and display 126 via a suitable connection and/or link.

Processor 120 also connects to communication interface 124 (interchangeably referred to interchangeably as interface 124), which can be implemented as one or more radios and/or connectors and/or network adaptors, configured to wirelessly communicate with one or more communication networks (not depicted). It will be appreciated that interface 124 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2G, 2.5G, 3G, 4G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access) and the like, wireless data, Bluetooth links, NFC (near field communication) links, WLAN (wireless local area network) links, WiFi links, WiMax links, packet based links, the Internet, analog networks, the PSTN (public switched telephone network), access points, and the like, and/or a combination.

While also not depicted, device 101 further comprises a power source, not depicted, for example a battery or the like. In some implementations the power source can comprise a connection to a mains power supply and a power adaptor (e.g. and AC-to-DC (alternating current to direct current) adaptor).

In particular, loudspeaker control system 130 (and one or more devices 136) can comprise the loudspeaker control system 100 of FIG. 64 described previously (with either demarked area 100*a* as disclosed in either of FIG. 86 or 87). Furthermore, one or more devices 136 can comprise one or more of: at least one amplifier; at least one Class D amplifier; at least one analog to digital converter; at least one ohmmeter; at least one voltmeter; and the like.

In any event, it should be understood that a wide variety of configurations for device 101 are contemplated.

Figure 91:
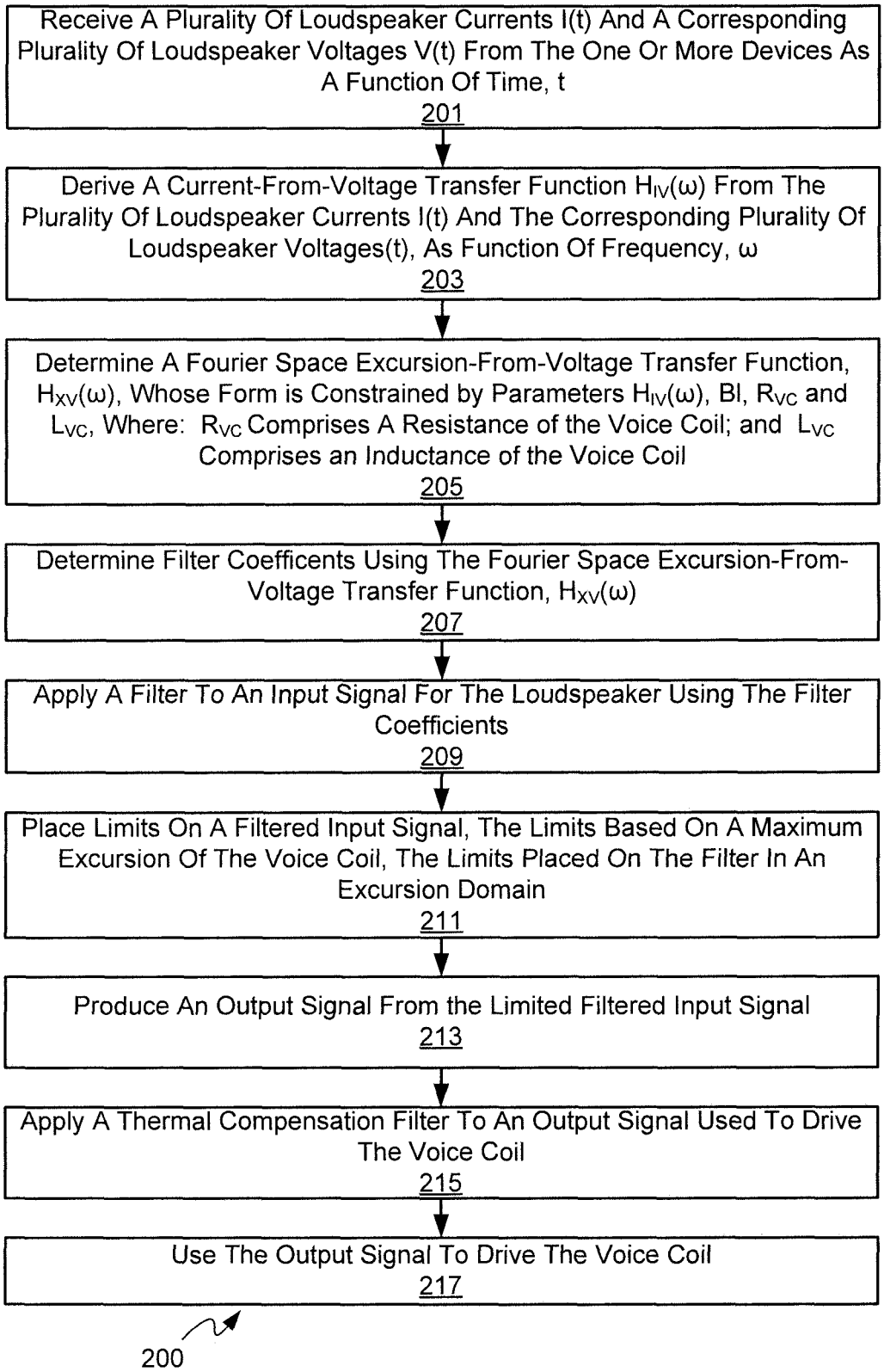
FIG. 91 depicts a method of loudspeaker excursion domain processing, according to non-limiting implementations.

Attention is now directed to FIG. 91 which depicts a flowchart of a method 200 for loudspeaker excursion domain processing and optional thermal limiting, according to non-limiting implementations. In order to assist in the explanation of method 200, it will be assumed that method 200 is performed using device 101, and specifically by processor 120 and/or loudspeaker control system 130 of device 101, for example when processor 120 and/or loudspeaker control system 130 processes application 146. Indeed, method 200 is one way in which device 101 can be configured. Furthermore, the following discussion of method 200 will lead to a further understanding of device 101, and its various components. However, it is to be understood that device 101 and/or method 200 can be varied, and need not work exactly as discussed herein in conjunction with each other, and that such variations are within the scope of present implementations.

Regardless, it is to be emphasized, that method 200 need not be performed in the exact sequence as shown, unless otherwise indicated; and likewise various blocks may be performed in parallel rather than in sequence; hence the elements of method 200 are referred to herein as "blocks" rather than "steps". It is also to be understood, however, that method 200 can be implemented on variations of system 100 as well.

At block 201, processor 120 and/or loudspeaker control system 130 receives a plurality of loudspeaker currents I(t) and a corresponding plurality of loudspeaker voltages V(t) from the one or more devices 136 as a function of time, t.

At block 203, processor 120 and/or loudspeaker control system 130 derives a current-from-voltage transfer function $H_{IV}(\omega)$ from the plurality of loudspeaker currents I(t) and the corresponding plurality of loudspeaker voltages V(t), as a function of frequency, ω;

At block 205, processor 120 and/or loudspeaker control system 130 determines a Fourier space excursion-from-voltage transfer function $H_{XV}(\omega)$ whose form is constrained by parameters $H_{IV}(\omega)$, Bl, $R_{vc}$, and $L_{vc}$, where: $R_{vc}$ comprises a resistance of voice coil 135; and $L_{vc}$ comprises an inductance of voice coil 135. For example, $H_{XV}(\omega)$ can be determined using:

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1. However, other equations for determining a Fourier space excursion-from-voltage transfer function are within the scope of present implementations. Indeed, $H_{IV}(\omega)$ and/or $R_{vc}$ and/or $L_{vc}$ can each be expressed using different mathematical conventions and/or different units and an equation for $H_{XV}(\omega)$ can be adapted accordingly. For example, the plurality of loudspeaker currents I(t) and/or the corresponding plurality of loudspeaker voltages V(t) can be measured on a non-absolute scale (i.e. in units other than ohms or volts), and hence conversion factors can be incorporated into an equation for $H_{IV}(\omega)$ and/or an equation for $H_{XV}(\omega)$. Furthermore, block 205 can include processor 120 determining a Fourier space excursion-from-voltage transfer function $H_{XV}(\omega)$ whose form is constrained by only parameters $H_{IV}(\omega)$, Bl, $R_{vc}$, and $L_{vc}$, though each of $H_{IV}(\omega)$, Bl, $R_{vc}$, and $L_{vc}$ can be expressed in various formats. In yet further implementations, block 205 can include processor 120 determining a Fourier space excursion-from-voltage transfer function $H_{XV}(\omega)$ containing all information in parameters $H_{IV}(\omega)$), Bl, $R_{vc}$, and $L_{vc}$, though each of $H_{IV}(\omega)$, Bl, $R_{vc}$, and $L_{vc}$ can be expressed in various formats. In yet further implementations, block 205 can include processor 120 determining a Fourier space excursion-from-voltage transfer function $H_{XV}(\omega)$ which is unconstrained by a model and/or an assumption of $H_{IV}(\omega)$, In other words, $H_{IV}(\omega)$ is derived without fitting the plurality of loudspeaker currents I(t) and/or the corresponding plurality of loudspeaker voltages V(t) to a loudspeaker model. Similarly, a Fourier space excursion-from-voltage transfer function $H_{XV}(\omega)$ is derived without fitting the parameters thereof to a loudspeaker model. At block 207, processor 120 and/or loudspeaker control system 130 determines filter coefficients using the Fourier space excursion-from-voltage transfer function, $H_{XV}(\omega)$.

At block 209, processor 120 and/or loudspeaker control system 130 applies a filter to an input signal for the loudspeaker using the filter coefficients.

At block 211, processor 120 and/or loudspeaker control system 130 places limits on a filtered input signal, the limits based on a maximum excursion of the voice coil, the limits placed on the filter in an excursion domain. The maximum excursion can also be stored in memory 122 and can comprise a manufacturer's maximum excursion, and the like.

At block 213, processor 120 and/or loudspeaker control system 130 produce an output signal from the limited filtered input signal.

At block 215, processor 120 and/or loudspeaker control system 130 applies a thermal compensation filter to an output signal used to drive the voice coil 135.

At block 217, processor 120 and/or loudspeaker control system 130 uses the output signal to drive the voice coil 135, for example using the filtered output signal produced at block 215.

Hence, when an excursion-from-voltage transfer function $H_{XV}(\omega)$ is determined by observing the excursion limiting behaviour of a loudspeaker; and, when using the plurality of loudspeaker currents I(t) and/or the corresponding plurality of loudspeaker voltages V(t) that produced an output signal of the loudspeaker, the determined excursion-from-voltage transfer function $H_{XV}(\omega)$ is arbitrary (i.e. produced without use of a loudspeaker model), and/or cannot and/or need not be fit to a loudspeaker model, a system that drives the loudspeaker is implementing method 200.

In any event, method 200 can be implemented using the loudspeaker control system 100 of FIG. 64 described above, and further can be adapted based on any techniques and/or algorithms and/or methods described above. For example, processor 120 and/or loudspeaker control system 130 can be further configured to determine the Fourier space excursion-from-voltage transfer function $H_{XV}(\omega)$ one or more of continuously and periodically, and update the filter accordingly.

Furthermore, processor 120 and/or loudspeaker control system 130 can be further configured to determine the resistance, $R_{vc}$, from one or more of: a value of the resistance, $R_{vc}$, stored in memory 122; determining the resistance, $R_{vc}$, by adding a tone to the input signal of a frequency where the impedance of voice coil 135 is about a DC (direct current) electrical resistance of voice coil 135; and filtering the tone out of a voltage sense signal and a current sense signal and taking the quotient.

Furthermore, processor 120 and/or loudspeaker control system 130 can be further configured to determine the inductance, $L_{vc}$, from one or more of: value of the inductance, $L_{vc}$, stored in the memory; determining the inductance, $L_{vc}$, by adding a tone to the input signal at a frequency where impedance of the voice coil is about a sum of electrical impedance of voice coil inductance and voice coil resistance; and filtering the tone out of a voltage sense signal and a current sense signal the deriving the inductance, $L_{vc}$, using a given value of the resistance, $R_{vc}$.

Furthermore, processor 120 and/or loudspeaker control system 130 can be further configured to: determine an inverse of the Fourier space excursion-from-voltage transfer function, $H_{XV}(\omega)$; determine inverse filter coefficients using the inverse of the Fourier space excursion-from-voltage transfer function, $H_{XV}(\omega)$; and, convert a filtered input signal to an output signal using a voltage-from-excursion transfer function filter, derived from the inverse filter coefficients, to drive voice coil 135.

Furthermore, processor 120 and/or loudspeaker control system 130 can be further configured to derive a scaling factor for a portion of the input signal from a ratio of a pre-filter excursion of the input signal prior to applying the filter, and a post-filter excursion after applying the filter; and, apply the scaling factor to the portion of the input signal to produce a portion of an output signal driving voice coil 135. The portion of the input signal can comprise a given time period of the input signal, and processor 120 and/or loudspeaker control system 130 can be further configured to derive respective scaling factors for each of a plurality of given time periods and apply the respective scaling factors to the input signal for each of the plurality of the given time periods.

Furthermore, processor 120 and/or loudspeaker control system 130 can be further configured to apply an equalization filter to a filtered input signal, prior to placing limits on the filtered input signal, by one or more of: flattening the filtered input signal; and equalizing one or more of peaks and trends in the filtered input signal.

Furthermore, processor 120 and/or loudspeaker control system 130 can be further configured to apply a thermal compensation filter to an output signal used to drive voice coil 135 by: determining whether a temperature of voice coil 135 will rise above a given maximum allowed temperature, $T_{max}$, of voice coil 135 stored in the memory based on determining whether: $T+\tau_{attack}dT/dt>T_{max}$, where T comprises a current temperature of voice coil 135, $\tau_{attack}$ comprises a given compressor time constant, and dT/dt comprises a time derivative of the temperature; when $T+\tau_{attack}$ is greater than $T_{max}$, exponentially reducing a thermal compression gain, $g_T$, from a current value, the thermal compression gain, $g_T$, comprising a number between 0 and 1, inclusive; and, when $T+\tau_{attack}$ is not greater than $T_{max}$, exponentially increasing the thermal compression gain, $g_T$, from the current value, using a given time constant $\tau_{decay}$. Furthermore, processor 120 and/or loudspeaker control system 130 can be further configured to determine the temperature of voice coil 135 by measuring voice coil resistance.

Figure 92:
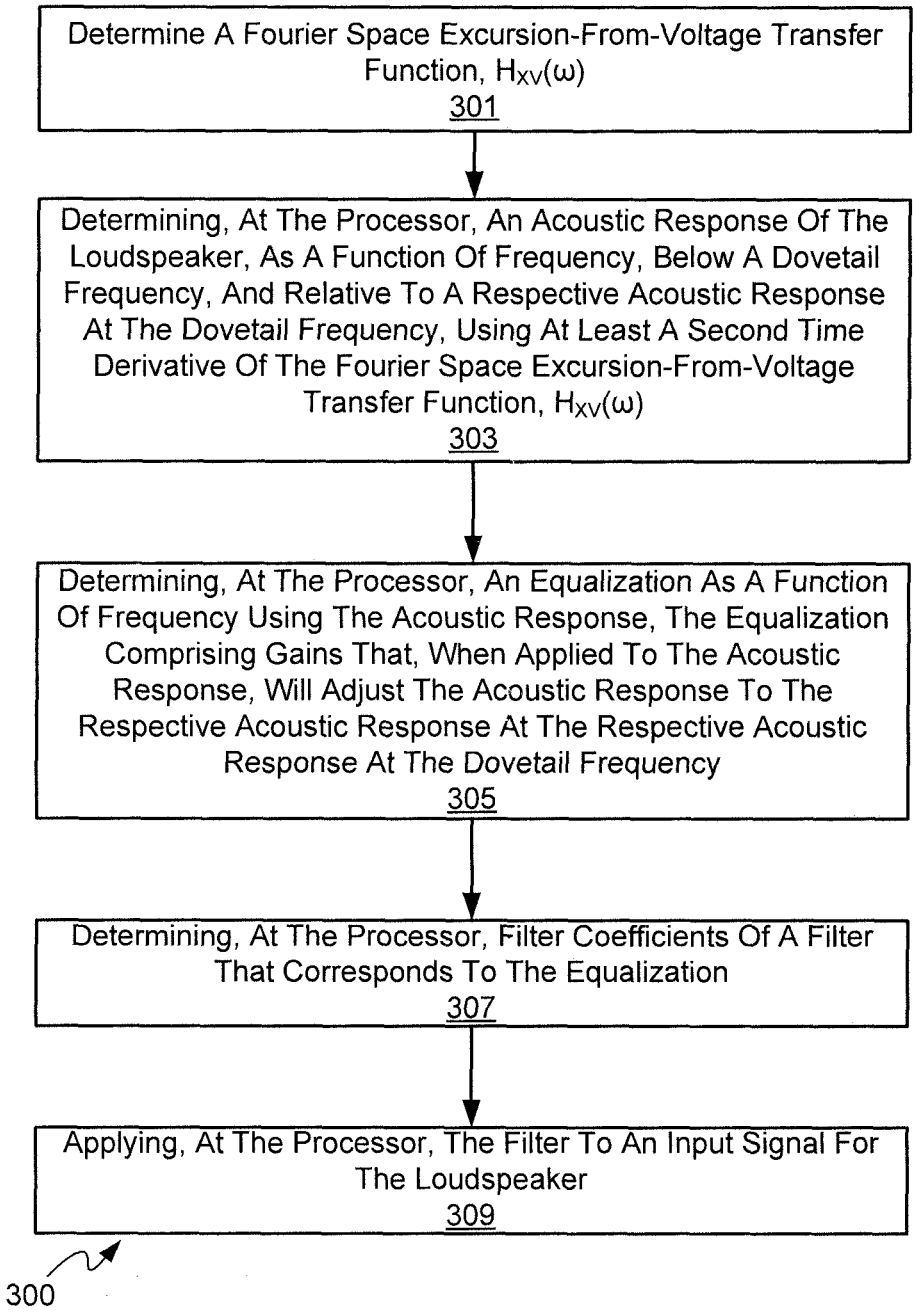
FIG. 92 depicts a method for determining equalization in loudspeaker excursion domain processing, according to non-limiting implementations.

Attention is now directed to FIG. 92 which depicts a flowchart of a method 300 for determining equalization, according to non-limiting implementations. In order to assist in the explanation of method 300, it will be assumed that method 300 is performed using device 101, and specifically by processor 120 and/or loudspeaker control system 130 of device 101, for example when processor 120 and/or loudspeaker control system 130 processes application 146. Indeed, method 300 is one way in which device 101 can be configured. Furthermore, the following discussion of method 300 will lead to a further understanding of device 101, and its various components. However, it is to be understood that device 101 and/or method 300 can be varied, and need not work exactly as discussed herein in conjunction with each other, and that such variations are within the scope of present implementations.

Regardless, it is to be emphasized, that method 300 need not be performed in the exact sequence as shown, unless otherwise indicated; and likewise various blocks may be performed in parallel rather than in sequence; hence the elements of method 300 are referred to herein as "blocks" rather than "steps". It is also to be understood, however, that method 300 can be implemented on variations of system 100 as well.

In particular, method 300 represents an implementation of Excursion EQ compression and limiting portion of loudspeaker control system 100. It is further assumed in method 300 that device 101 comprises a volume device configured to set a volume of loudspeaker 132. Such a volume device can correspond to at least one input device 128, as described above.

At block 301, processor 120 determines Fourier space excursion-from-voltage transfer function $H_{XV}(\omega)$. For example, $H_{XV}(\omega)$ can be determined, using Equation (13):

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1; $R_{vc}$ comprises a resistance of voice coil 135; $L_{vc}$ comprises an inductance of voice coil 135; and, $H_{IV}(\omega)$ comprises a current-from-voltage transfer function derived from a plurality of loudspeaker currents I(t) and a corresponding plurality of loudspeaker voltages V(t) measured by the one or more devices, as described above. Alternatively, $H_{XV}(\omega)$ can be determined using another equation as discussed in detail with reference to method 200.

At block 303, processor 120 determines an acoustic response of loudspeaker 132, as a function of frequency, below a dovetail frequency, and relative to a respective acoustic response at the dovetail frequency, using at least a second time derivative of the Fourier space excursion-from-voltage transfer function $H_{XV}(\omega)$. For example, attention is directed to FIGS. 76 and 77 as described above.

At block 305, processor 120 determines an equalization as a function of frequency using the acoustic response, the equalization comprising gains that, when applied to the acoustic response, will adjust the acoustic response to the respective acoustic response at the respective acoustic response at the dovetail frequency. Attention is directed to FIG. 77 as described above.

At block 307, processor 120 determines filter coefficients of a filter that corresponds to the equalization. Such a determination is similar to determination of filter coefficients described above with respect to method 200.

At block 309, processor 120 applies the filter to an input signal for the loudspeaker 132.

While not depicted, method 300 can further comprise: determining available excursion of voice coil 135 at frequencies below the dovetail frequency, at a volume setting of volume device, the available excursion comprising a difference between respective excursions at respective frequencies, as determined from the acoustic response, and an excursion limit of the voice coil, and wherein the determining the equalization as a function of the frequency at block 305 comprises using the available excursion.

At block 303, determining the acoustic response of loudspeaker 135 can comprise determining an absolute acoustic response expressed with respect to pressure, p, and assuming that loudspeaker 132 comprises a sealed back cavity, using:

$$p = \frac{\rho S_d}{4\pi r}\ddot{x},$$

where r is distance from loudspeaker 132, ρ is the density of a medium surrounding voice coil 135 (e.g. air and the like), $S_d$ is an area of a diaphragm of loudspeaker 132, and $\ddot{x}$ can be taken as the second time derivative of the excursion-from-voltage transfer function, $H_{XV}(\omega)$. In these implementations, ρ and $S_d$ are assumed to be known and/or stored at memory 122.

Furthermore, method 300 can be applied between a minimum frequency for which the equalization can be applied to the acoustic response without exceeding the excursion limit and the dovetail frequency. Hence, method 300 can further comprise: determining a minimum frequency for which the equalization can be applied to the acoustic response without exceeding the excursion limit and the dovetail frequency; and, determining at least the equalization between the minimum frequency and the dovetail frequency.

As described in more detail above, the dovetail frequency can comprise a maximum frequency above which the excursion of the voice coil is one or more of below a minimum excursion and the excursion is not significantly affected.

Furthermore, limits can be applied to the gains determined at block 305 using one or more of a maximum applied gain and a minimum equalization frequency.

In addition, the gains can be adjusted to match a respective excursion of at least one other loudspeaker. For example, loudspeaker 132 can comprise a first loudspeaker of a pair of two stereo loudspeakers, and method 300 can further comprise adjusting the gains to match a respective excursion of at least a second loudspeaker of the pair of two stereo loudspeakers. Indeed, within implementations that include multiple loudspeakers and/or a plurality of loudspeakers, loudspeaker 132 can be controlled to emit a sound at a given absolute acoustic level in a calibration procedure, so that acoustic levels between the loudspeakers can be matched and/or controlled relative to one another.

In any event, described herein is a system in which an excursion-from-voltage transfer function is determined using current and voltages measurements from a loudspeaker; the excursion-from-voltage transfer function is used to place excursion limits on an output signal used to drive excursion of a voice coil in the loudspeaker. Predictive logic of temperature of the voice coil can also be used to apply a gain to the output signal to prevent the loudspeaker from exceeding a maximum temperature.

For a given loudspeaker implementation, the acoustic response is directly proportional to the diaphragm acceleration. This can enable sensitivity matching in loudspeakers, for example, in home stereo or commercial systems. Woofers and tweeters within a single multi-way loudspeaker enclosure can also be automatically gain balanced because the excursion can be determined.

As described above, when the loudspeaker diaphragm area is known, for example stored in memory 122 in a provisioning process and/or at a factory, the absolute acoustic sensitivity can be determined from the excursion when the loudspeaker back enclosure is sealed (it can also be estimated when the back cavity is not sealed, when further information about the back cavity is available, for example stored at memory 122). This can enable the emanation of a sound at a particular absolute acoustic level for use for example in calibration procedures.

Equation 13 places no limits on the shape of the excursion-from-voltage transfer function. Previously, excursion-from-voltage transfer functions have been approximated as a 3 parameter mechanical circuit model, however the use of such a model limits the allowed transfer functions to those represented by such a model. Use of Equation 13 can hence enable use of any model of the excursion-from-voltage transfer function which cannot be reduced to such a 3 parameter model.

Those skilled in the art will appreciate that in some implementations, the functionality of device 101 and/or the loudspeaker control system 100 of FIG. 64 can be implemented using pre-programmed hardware or firmware elements (e.g., application specific integrated circuits (ASICs), electrically erasable programmable read-only memories (EEPROMs), etc.), or other related components. In other implementations, the functionality of device 101 and/or the loudspeaker control system 100 of FIG. 64 can be achieved using a computing apparatus that has access to a code memory (not depicted) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Furthermore, the computer-readable program can be stored as a computer program product comprising a computer usable medium. Further, a persistent storage device can comprise the computer readable program code. The computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever Persons skilled in the art will appreciate that there are yet more alternative implementations and modifications possible, and that the above examples are only illustrations of one or more implementations. The scope, therefore, is only to be limited by the claims appended hereto.

What is claimed is:

1. A device comprising:

a processor, a loudspeaker comprising a voice coil, one or more devices configured to determine loudspeaker voltage and loudspeaker current, and a memory storing a Bl product for the loudspeaker, the processor configured to:

receive a plurality of loudspeaker currents I(t) and a corresponding plurality of loudspeaker voltages V(t) from the one or more devices as a function of time, t;

derive a current-from-voltage transfer function $H_{IV}(\omega)$ from the plurality of loudspeaker currents I(t) and the corresponding plurality of loudspeaker voltages V(t), as a function of frequency, ω;

determine a Fourier space excursion-from-voltage transfer function $H_{XV}(\omega)$, whose form is constrained by parameters $H_{IV}(\omega)$, Bl, $R_{vc}$, and $L_{vc}$, where: $R_{vc}$ comprises a resistance of the voice coil; and $L_{vc}$ comprises an inductance of the voice coil;

determine filter coefficients using the Fourier space excursion-from-voltage transfer function, $H_{XV}(\omega)$; and, apply a filter to an input signal for the loudspeaker using the filter coefficients.

2. The device of claim 1, wherein the Fourier space excursion-from-voltage transfer function $H_{XV}(\omega)$ is determined using:

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1.

3. The device of claim 1, wherein the processor is further configured to determine the resistance, $R_{vc}$, of the voice coil from one or more of: a value of the resistance, $R_{vc}$, stored in the memory; determining the resistance, $R_{vc}$, by adding a tone to the input signal at a frequency where impedance of the voice coil is about a DC (direct current) electrical resistance of the voice coil; and filtering the tone out of a voltage sense signal and a current sense signal and taking the quotient.

4. The device of claim 1, wherein the processor is further configured to determine the inductance, $L_{vc}$, of the voice coil from one or more of: value of the inductance, $L_{vc}$, stored in the memory; determining the inductance, $L_{vc}$, by adding a tone to the input signal at a frequency where impedance of the voice coil is about a sum of electrical impedance of voice coil inductance and voice coil resistance; and filtering the tone out of a voltage sense signal and a current sense signal the deriving the inductance, $L_{vc}$, using a given value of the resistance, $R_{vc}$.

5. The device of claim 1, wherein the processor is further configured to determine the Fourier space excursion-from-voltage transfer function $H_{XV}(\omega)$ one or more of continuously and periodically, and update the filter accordingly.

6. The device of claim 1, wherein the processor is further configured to place limits on a filtered input signal, the limits based on a maximum excursion of the voice coil, the limits placed on the filter in an excursion domain.

7. The device of claim 1, wherein the processor is further configured to:

determine an inverse of the Fourier space excursion-from-voltage transfer function, $H_{XV}(\omega)$;

determine inverse filter coefficients using the inverse of the Fourier space excursion-from-voltage transfer function, $H_{XV}(\omega)$; and, convert a filtered input signal to an output signal using a voltage-from-excursion transfer function filter, derived from the inverse filter coefficients, to drive the voice coil.

8. The device of claim 1, wherein the processor is further configured to:

derive a scaling factor for a portion of the input signal from a ratio of a pre-filter excursion of the input signal prior to applying the filter, and a post-filter excursion after applying the filter; and, apply the scaling factor to the portion of the input signal to produce a portion of an output signal driving the voice coil.

9. The device of claim 8, wherein the portion of the input signal comprises a given time period of the input signal, and the processor is further configured to derive respective scaling factors for each of a plurality of given time periods and apply the respective scaling factors to the input signal for each of the plurality of the given time periods.

10. The device of claim 1, wherein the processor is further configured to apply an equalization filter to a filtered input signal, prior to placing limits on the filtered input signal, by one or more of flattening the filtered input signal; and equalizing one or more of peaks and trends in the filtered input signal.

11. The device of claim 1, wherein the processor is further configured to apply a thermal compensation filter to an output signal used to drive the voice coil by:

determining whether a temperature of the voice coil will rise above a given maximum allowed temperature, $T_{max}$, of the voice coil stored in the memory based on determining whether:

$$T + \tau_{attack}\frac{dT}{dt} > T_{max}$$

where T comprises a current temperature of the voice coil, $\tau_{attack}$ comprises a given compressor time constant, and $$\frac{dT}{dt}$$

comprises a time derivative of the temperature;

when $T+\tau_{attack}$ is greater than $T_{max}$, exponentially reducing a thermal compression gain, $g_T$, from a current value, the thermal compression gain, $g_T$, comprising a number between 0 and 1, inclusive; and, when $T+\tau_{attack}$ is not greater than $T_{max}$, exponentially increasing the thermal compression gain, $g_T$, from the current value, using a given time constant $\tau_{decay}$.

12. A method comprising:

receiving, at a processor of a device, a plurality of loudspeaker currents I(t) and a corresponding plurality of loudspeaker voltages V(t) from one or more devices configured to determine loudspeaker voltage and loudspeaker current as a function of time, t, the device comprising: the processor, a loudspeaker comprising a voice coil, the one or more devices, and a memory storing a Bl product for the loudspeaker;

deriving, at the processor, a current-from-voltage transfer function $H_{IV}(\omega)$ from the plurality of loudspeaker currents I(t) and the corresponding plurality of loudspeaker voltages V(t), as a function of frequency, ω;

determining, at the processor, a Fourier space excursion-from-voltage transfer function $H_{XV}(\omega)$, whose form is constrained by parameters $H_{IV}(\omega)$, Bl, $R_{vc}$, and $L_{vc}$, where: $R_{vc}$ comprises a resistance of the voice coil; and $L_{vc}$ comprises an inductance of the voice coil;

determining, at the processor, filter coefficients using the Fourier space excursion-from-voltage transfer function, $H_{XV}(\omega)$; and, applying, at the processor, a filter to an input signal for the loudspeaker using the filter coefficients.

13. The method of claim 12, wherein the Fourier space excursion-from-voltage transfer function $H_{XV}(\omega)$ is determined using:

$$H_{XV}(\omega) = \frac{1}{Bl}\left[\frac{1 - H_{IV}(\omega)R_{vc}}{j\omega} - L_{vc}H_{IV}(\omega)\right]$$

where: j denotes a square root of −1.

14. The method of claim 12, further comprising determining the resistance, $R_{vc}$, of the voice coil from one or more of: value of the inductance, $L_{vc}$, stored in the memory; determining the inductance, $L_{vc}$, by adding a tone to the input signal at a frequency where impedance of the voice coil is about a sum of electrical impedance of voice coil inductance and voice coil resistance; and filtering the tone out of a voltage sense signal and a current sense signal the deriving the inductance, $L_{vc}$, using a given value of the resistance, $R_{vc}$.

15. The method of claim 12, further comprising determining the inductance, $L_{vc}$, of the voice coil from one or more of: a value of the inductance, $L_{vc}$, stored in the memory; determining the inductance, $L_{vc}$, at a frequency of the voice coil where the voice coil impedance is determined only by voice coil electrical inductance; determining the inductance, $L_{vc}$, at the frequency of the voice coil using frequencies of an output signal driving the voice coil, the output signal resulting from applying the filter to the input signal; and adding the frequency to the output signal.

16. The method of claim 12, further comprising placing limits on a filtered input signal, the limits based on a maximum excursion of the voice coil, the limits placed on the filter in an excursion domain.

17. The method of claim 12, further comprising:

determining an inverse of the Fourier space excursion-from-voltage transfer function, $H_{XV}(\omega)$;

determining inverse filter coefficients using the inverse of the Fourier space excursion-from-voltage transfer function, $H_{XV}(\omega)$; and, converting a filtered input signal to an output signal using a voltage-from-excursion transfer function filter, derived from the inverse filter coefficients, to drive the voice coil.

18. The method of claim 12, further comprising:

deriving a scaling factor for a portion of the input signal from a ratio of a pre-filter excursion of the input signal prior to applying the filter, and a post-filter excursion after applying the filter; and, applying the scaling factor to the portion of the input signal to produce a portion of an output signal driving the voice coil.

19. The method of claim 18, wherein the portion of the input signal comprises a given time period of the input signal, and the method further comprises deriving respective scaling factors for each of a plurality of given time periods and applying the respective scaling factors to the input signal for each of the plurality of the given time periods.

20. The method of claim 12, further comprising applying an equalization filter to a filtered input signal, prior to placing limits on the filtered input signal, by one or more of flattening the filtered input signal; and equalizing one or more of peaks and trends in the filtered input signal.

21. The method of claim 12, further comprising applying a thermal compensation filter to an output signal used to drive the voice coil by:

determining whether a temperature of the voice coil will rise above a given maximum allowed temperature, $T_{max}$, of the voice coil stored in the memory based on determining whether:

$$T + \tau_{attack}\frac{dT}{dt} > T_{max}$$

where T comprises a current temperature of the voice coil, $\tau_{attack}$ comprises a given compressor time constant, and $$\frac{dT}{dt}$$

comprises a time derivative of the temperature;

when $T+\tau_{attack}$ is greater than $T_{max}$, exponentially reducing a thermal compression gain, $g_T$, from a current value, the thermal compression gain, $g_T$, comprising a number between 0 and 1, inclusive; and, when $T+\tau_{attack}$ is not greater than $T_{max}$, exponentially increasing the thermal compression gain, $g_T$, from the current value, using a given time constant $\tau_{decay}$.

22. A computer program product, comprising a non-transitory computer usable medium having a computer readable program code adapted to be executed to implement a method comprising:

receiving, at a processor of a device, a plurality of loudspeaker currents I(t) and a corresponding plurality of loudspeaker voltages V(t) from one or more devices configured to determine loudspeaker voltage and loudspeaker current as a function of time, t, the device comprising: the processor, a loudspeaker comprising a voice coil, the one or more devices, and a memory storing a Bl product for the loudspeaker;

deriving, at the processor, a current-from-voltage transfer function $H_{IV}(\omega)$ from the plurality of loudspeaker currents I(t) and the corresponding plurality of loudspeaker voltages V(t), as a function of frequency, ω;

determining, at the processor, a Fourier space excursion-from-voltage transfer function $H_{XV}(\omega)$, whose form is constrained by parameters $H_{IV}(\omega)$, Bl, $R_{vc}$, and $L_{vc}$, where: $R_{vc}$ comprises a resistance of the voice coil; and $L_{vc}$ comprises an inductance of the voice coil;

determining, at the processor, filter coefficients using the Fourier space excursion-from-voltage transfer function, $H_{XV}(\omega)$; and, applying, at the processor, a filter to an input signal for the loudspeaker using the filter coefficients.

* * * * *